US005434034A

United States Patent [19]

Asami

[11] Patent Number: 5,434,034

[45] Date of Patent: Jul. 18, 1995

[54] METHOD FOR FORMING A COLOR-IMAGE

[75] Inventor: Masahiro Asami, Minami-ashigara, Japan

[73] Assignee: Fuji Photo Film Co., Ltd., Kanagawa, Japan

[21] Appl. No.: 46,747

[22] Filed: Apr. 15, 1993

[30] Foreign Application Priority Data

Apr. 15, 1992 [JP] Japan ..... 4-119910

[51] Int. Cl.[6] ..... G03C 7/46

[52] U.S. Cl. ..... 430/384; 430/385; 430/467; 430/470; 430/558; 430/376; 430/399

[58] Field of Search ..... 430/384, 385, 558, 567, 430/505, 376, 467, 470, 399

[56] References Cited

U.S. PATENT DOCUMENTS

| | | | |
|---|---|---|---|
| 4,791,053 | 12/1988 | Ogawa | 430/567 |
| 4,830,958 | 5/1989 | Okumura et al. | 430/567 |
| 4,910,127 | 3/1990 | Sakaki et al. | 430/540 |

FOREIGN PATENT DOCUMENTS

| | | |
|---|---|---|
| 0488248 | 6/1992 | European Pat. Off. . |
| 61-70552 | 4/1986 | Japan . |
| 63-106655 | 5/1988 | Japan . |
| 2136855 | 5/1990 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material and a method for forming a color image using said color photographic material. The silver halide color photographic material comprises silver halide emulsion grains comprising silver chlorobromide having a high silver chloride content and being substantially free from silver iodide, and a cyan dye-forming coupler represented by formula (I) or (II), and said silver halide emulsion grains being formed by adding a water-soluble bromide at the grain formation step, and/or during the period from the completion of the formation of the grains to the coating of the cyan dye-forming layer onto the support:

formula (I)

formula (II)

wherein Za and Zb each represent —N= or —C($R_3$)=, with one of Za and Zb being —N= and the other being —C($R_3$)=; $R_1$ and $R_2$ each represent an electron-attracting group, whose Hammett substituent constant $\sigma_p$ value is 0.20 or more, with the sum of the $\sigma_p$ values of $R_1$ and $R_2$ being 0.65 or more; $R_3$ represents a hydrogen atom or a substituent; X represents a hydrogen atom or a releasing-off group and $R_1$, $R_2$, $R_3$, or X may become a bivalent group to form a dimer or a higher polymer, or may bond to a polymer molecular chain to form a homopolymer or a copolymer.

17 Claims, No Drawings

METHOD FOR FORMING A COLOR-IMAGE

FIELD OF THE INVENTION

The present invention relates to a color photographic material, and more particularly to a color photographic material that can provide a color print excellent in resistance to damage by pressure and also excellent in color reproduction, and a method for forming a color image that can produce the above excellent color print rapidly and stably by a low-replenishment color development.

BACKGROUND OF THE INVENTION

In color photographs that are now widely produced, particularly color prints, use is made of color reproduction based on the so-called subtractive color process, wherein a yellow dye, a magenta dye, and a cyan dye are used as color dyes. Since the color reproduction range of the obtainable dye image is determined by the hues of the above respective dyes that are used as subtractive colors, an important subject to those skilled in the art is how to develop a dye having excellent absorption characteristics.

In photographic materials, such as color photographic printing papers, usually, a technique is used wherein emulsion layers containing silver halide emulsions sensitive to light in the range of wavelengths of blue, green, and red are provided and, in the emulsion layers, so-called couplers (generally a combination of couplers is used, which will form dyes having complementary relationships to the lights having wavelengths to which the emulsions are sensitive) are contained. The couplers will form the above-described dyes upon coupling reactions with the oxidized product of an aromatic primary amine developing agent, that is produced when the silver halide emulsions exposed to light are developed after the photographic material is exposed to light imagewise and is processed with a color developer containing that aromatic primary amine developing agent, whereby a color image is formed. As these dye-forming couplers, so-called active methylene compounds are commonly used, and specific examples are pivaloylacetoanilides as yellow dye-forming couplers, 5-pyrazolones or pyrazoloazoles as magenta dye forming couplers, and phenols and naphthols as cyan dye-forming couplers.

Out of these dye-forming couplers, phenols or naphthols used as cyan dye-forming couplers have such defects as that the short wavelength side of the major absorption of the red light region that will present cyan hue is broad, and they have subsidiary absorption in the blue light region in addition to the major absorption.

With respect to cyan couplers that obviate these defects, various suggestions have been made, for example, imidazole couplers described, for example, in JP-A ("JP-A" means unexamined published Japanese patent application) No. 226653/1988 or 61946/1991, and couplers having a structure wherein a pyrazole ring is condensed with a nitrogen-containing heterocyclic 6-membered ring, as described in JP-A No. 135442/1990 or 136855/1990, can be mentioned, but they are not satisfactory in view of the color hue and the color-forming property.

On the other hand, in the production of color prints, to meet the shortening of the time for delivery and the demand for high efficiency, a technique of processing rapidly a silver halide emulsion having a high silver chloride content is disclosed in International Publication WO 87/04534. Further, for the purpose of saving resources and reducing pollution, a method of reducing the replenishing amounts of color development processing solutions and decreasing the discharge is disclosed in JP-A No. 70552/1986 or 106655/1988.

From this viewpoint, the inventors investigated couplers whose color hue is sharp and without undesirable absorption, which couplers have high color-forming property, and found a cyan coupler represented by formula (I) or (II) given below, but when evaluating a photographic material by combining the cyan coupler with a high-silver-chloride emulsion useful for rapid processing, it became apparent that there was a grave problem that had not been expected hitherto. That is, it was found that when the cyan coupler is combined with a silver halide emulsion having a high silver chloride content to prepare a photographic material, fogging readily occurs at the part of the photographic material where pressure has been applied. This phenomena is noticeable when a projection under a light load is passed on the photographic material surface at a high speed and this risk is expected to happen when a print is formed by using a high-speed printer commonly used in usual color photofinishers and the like. If such a problem occurs, the print quality is impaired conspicuously. It is a serious obstruction when a photographic material in which the cyan coupler of the present invention is combined with a high-silver-chloride emulsion is put to practical use.

When such a photographic material was continuously processed with the replenishing amount of a color developer decreased, a problem arose that the contrast lowered with an increase of the processed amount.

SUMMARY OF THE INVENTION

As is apparent as described above, an object of the present invention is to provide a color photographic material that can rapidly supply a color print excellent in color reproduction and color-forming property with high resistance to damage by applied pressure.

Another object of the present invention is to provide a method for forming a color image that can produce the above color print stably in a continuous process of a low-replenishing type which is advantageous in terms of saving resources and reducing pollution.

Other and further objects, features and advantages of the invention will appear more evident from the following description.

DETAILED DESCRIPTION OF THE INVENTION

The above objects have been achieved by providing:

(1) A silver halide color photographic material having at least one yellow dye-forming layer, at least one magenta dye-forming layer, and at least one cyan dye-forming layer, on a support, wherein said cyan dye-forming layer contains silver halide emulsion grains comprising silver chlorobromide having a silver chloride content of 90 mol % or more, and being substantially free from silver iodide, and at least one cyan dye-forming coupler represented by formula (I) or (II), said silver halide emulsion grains being formed by adding at a grain formation step, a water-soluble bromide in a total amount of 0.0005 to 0.01 mol per mol of the silver halide, to a system containing initially formed silver halide grains in a short period of time when any part of the silver halide grains corresponding to 20% or less of the volume of the grains is formed, and/or by adding a water-soluble bromide in a total amount of 0.0005 to 0.01 mol per mol of the silver halide to an initially formed silver halide emulsion at any time of period from the completion of the formation of the initial silver halide grains to coating of the cyan dye-forming layer onto the support:

formula (I)

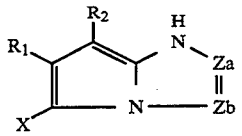

formula (II)

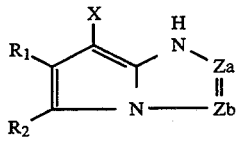

In formulas (I) and (II), Za and Zb each represent —N= or —C($R_3$)=, with one of Za and Zb being —N= and the other being —C($R_3$)=; $R_1$ and $R_2$ each represent an electron-attracting group, whose Hammett substituent constant $\sigma_p$ value is 0.20 or more, with the sum of the $\sigma_p$ values of $R_1$ and $R_2$ being 0.65 or more; $R_3$ represents a hydrogen atom or a substituent; X represents a hydrogen atom or a group capable of being released upon coupling reaction with the oxidized product of an aromatic primary amine developing agent; and $R_1$, $R_2$, $R_3$, or X may become a bivalent group to form a dimer or a higher polymer, or may bond to a polymer molecular chain to form a homopolymer or a copolymer, (2) A silver halide color photographic material stated under (1) above, wherein, among photosensitive emulsion layers constituting the photographic material, said cyan dye-forming layer is positioned farthest from the support, (3) A silver halide color photographic material stated under (1) or (2) above, wherein the silver halide grains incorporated in said cyan dye-forming layer contain an iridium compound, and 60% or more of the said iridium compound is localized near the surface of the grains, and (4) A method for forming a color image, which comprises exposing imagewisely a silver halide color photographic material defined under (1), (2), or (3) above, and then processing there with a color developer with the replenishing amount of the color developer being 25 ml to 100 ml per square meter of said silver halide color photographic material.

In the present invention, it is required that the silver halide emulsion grains used together with the above cyan coupler comprise silver chlorobromide having a silver chloride content of 90 mol % or more, and being substantially free from silver iodide, and the grains are formed by adding at a grain formation step, a water-soluble bromide in a total amount of 0.0005 to 0.01 mol per mol of the silver halide, to a system containing initially formed silver halide grains in a short period of time when any part of the silver halide grains corresponding to 20% or less of the volume of the grains is formed, and/or by adding a water-soluble bromide in a total amount of 0.0005 to 0.01 mol per mol of the silver halide to an initially formed silver halide emulsion at any time of period from the completion of the formation of the initial silver halide grains to coating of the cyan dye-forming layer onto the support.

When a water-soluble bromide is added to silver chloride or silver chlorobromide grains, silver bromide with a smaller solubility product deposits on the grains and the so-called halogen conversion reaction takes place. Consequently, the silver bromide content of the grains becomes the value of the silver bromide content of the original grains plus the amount of the added water-soluble bromide.

In the present invention, it is required that the silver chloride content of the finally obtained emulsion grains be 90 mol % or over, and the amount of the water-soluble bromide to be added is to be in the range of 0.0005 to 0.01 mol per mol of a silver halide. Either pure silver chloride or silver chlorobromide is used for the halogen composition of the emulsion grains before the addition of the water-soluble bromide, and it is recommended to set restriction such that, even when the amount of the water-soluble bromide is added, the final silver bromide content does not exceed 10 mol %.

If the silver bromide content of the silver halide grains exceeds 10 mol %, the rapid processability is impaired. Due to the need to add the water-soluble bromide, the minimum silver bromide content is 0.05 mol %.

The step of preparing the silver halide emulsion to be used in the present invention comprises the step of forming grains by reacting a water-soluble silver salt with a water-soluble halide; the step of physically ripening the silver halide grains; the step of removing water-soluble salts (the desalting/washing step); and the chemical sensitizing step. When the emulsion of the present invention is spectrally sensitized, a spectrally sensitizing dye may be added in any of the above steps.

The obtained silver halide emulsion is mixed with a dispersion of a coupler that is a dye-forming element, a stabilizer, a coating assistant, such as a surface-active agent and a viscosity modifier, gelatin, etc. to prepare a coating solution.

The time at which the water-soluble bromide is added may be any time during the above process as long as it is before the emulsion is applied onto a support. That is, any time may be selected, for example, from the time during or after the formation of the grains; the time during the physical ripening; the time during the desalting step; the time before, during, or after the chemical sensitization; and the time during the coating solution preparation step.

If the water-soluble bromide is added during the formation of the grains, the period for that addition is a short period of time when any part corresponding to 20% or less of the volume of the grains is formed and the length of the short period of time includes the case of adding the water-soluble bromide all at once. If the addition of the water-soluble bromide is continued during the formation of a part exceeding 20% of the volume of the grains, the effect of the present invention is difficult to be obtained. A preferable addition period is the period during which any part corresponding to 10% or less of the volume of the grains is formed, and more preferably the period during which any part corresponding to 5% or less of the volume of the grains is formed. The time when the water-soluble bromide is added is preferably after the formation of 50% or more, more preferably 80% or more, of the volume of the silver halide grains.

In the present invention, the addition of the water-soluble bromide is preferably carried out after the completion of the formation of the initial silver halide grains and before the preparation of a coating solution, and more preferably after the start of the chemical sensitization and before the preparation of a coating solution.

The addition of the water-soluble bromide makes it possible to efficiently suppress pressure marks (fogging caused by pressure), which will occur when the cyan coupler according to the present invention is used. The addition of the water-soluble bromide in this range can also suppress lowering of contrast when a continuous process is carried out with the replenishing amount of a color developer being small. If the amount of the added water-soluble bromide is smaller than the above-defined amount, the effect of the present invention cannot be obtained, while if that amount is excessive, desensitization will occur when pressure is applied, which is a problem.

The amount of the water-soluble bromide to be added in the present invention is in the range of 0.0005 to 0.01 mol, preferably 0.001 to 0.008 mol, per mol of a silver halide. If the water-soluble bromide is added in portions separately, suitably the sum is in the above range. As the water-soluble bromide, an alkali metal salt (e.g., Na salt, K salt, and Li salt) of bromine is preferable.

Where the cyan coupler according to the present invention is used in the emulsion layer containing high-silver-chloride emulsion grains according to the present invention, the above effect is noticeable when, among photosensitive emulsion layers, said emulsion layer is positioned farthest from the support. If the emulsion layer containing said cyan coupler is positioned near the support, although occurrence of fogging when pressure is applied is alleviated, the extent of lowering of contrast in a low-replenishing continuous process increases unpreferably.

In the present invention, it is preferable to incorporate an iridium compound in the high-silver chloride emulsion grains, such that most of the iridium compound may be present near the surface of the grains. Through inclusion of the iridium compound, pressure marks can be suppressed to a lower level, which is a subject of the present invention, and the so-called reciprocity law failure, which is the change in sensitivity and gradation due to a change in the illumination intensity at the time of exposure of the photographic material to light, can be reduced.

As the iridium compound used in the present invention, a trivalent or tetravalent water-soluble compound is preferably used. A particularly preferable example is a hexachloroiridate(II), a hexachloroiridate (IV), a hexammineiridate(III), a hexammineiridate(IV), a trioxalatoiridate (III), or a trioxalatoiridate(IV).

The amount of the iridium compound preferably used in the present invention is in the range of $10^{-9}$ to $10^{-4}$ mol, more preferably $10^{-8}$ to $10^{-5}$ mol, per mol of a silver halide.

In order to incorporate the iridium compound near the surface of the emulsion grains, the iridium compound is added into the reaction vessel or the reaction liquid in the later stage of the formation of the grains. In the present invention, preferably 60 mol % or more of the iridium compound is added at a stage after 50 mol % or more of the water-soluble silver salt used for the formation of the grains is added. Further, it is also possible to add the iridium compound before the start of the physical ripening of the emulsion grains, and to carry out the ripening so that the iridium compound may be incorporated near the surface of the grains.

The present photographic material can preferably be applied to a low-replenishing-type continuous process wherein the replenishing amount of a color developer is small. The demand for reducing of the replenishing amount of a color developer has been increasing more and more in recent years, with a view toward saving resources and reducing pollution. By reducing the replenishing amount, the amount of the waste liquor can also be reduced, to make slight the adverse effect on the environment.

The smaller the replenishing amount of the color developer is, the more preferable it is, but if the replenishing amount is set below the amount of the carry-over from the developing bath by the photographic material, the amount of the liquid in continuous processing cannot be kept constant, and therefore it is difficult to set the replenishing amount below 20 ml per square meter of the photographic material. In the present invention, preferably, the processing is carried out with the replenishing amount being 20 to 100 ml per square meter of the photographic material.

Next, the compound of formulae (I) or (II) will be described.

Specifically, the cyan couplers of the present invention are represented by the following formulae (I-a), (I-b), (II-a), and (II-b):

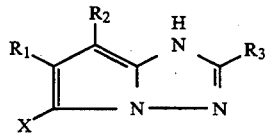
formula (I-a)

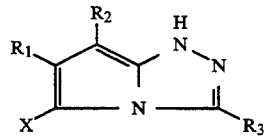
formula (I-b)

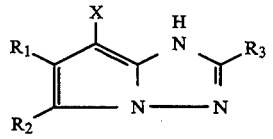
formula (II-a)

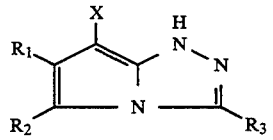
formula (II-b)

wherein $R_1$, $R_2$, $R_3$, and X each have the same meanings as defined in formula (I) or (II).

$R_3$ represents a hydrogen atom or a substituent and as the substituent, for example, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic-oxy group, an azo group, an acyloxy group, a carbamoyloxy group, a silyloxy group, an aryloxycarbonylamino group, an imido group, a heterocyclic-thio group, a sulfinyl group, a phosphonyl group, an aryloxycarbonyl group, an acyl group, and azolyl group can be mentioned, which may further be substituted by such substituents as those mentioned as examples of $R_3$.

More particularly, $R_3$ represents a hydrogen atom, a halogen atom (e.g., a chlorine atom and a bromine atom), an alkyl group (e.g., a straight-chain or branched-chain alkyl group having 1 to 32 carbon atoms, an aralkyl group, an alkenyl group, an alkynyl group, a cycloalkyl group, and a cycloalkenyl group, such as methyl, ethyl, propyl, isopropyl, t-butyl, tridecyl, 2-methanesulfonylethyl, 3-(3-pentadecylphenoxy)-propyl, 3-{4-{2-[4-(4-hydroxyphenylsulfonyl)phenoxy]-dodecanamido}phenyl}propyl, 2-ethoxytridecyl, trifluoromethyl, cyclopentyl, and 3-(2,4-di-t-amylphenoxy)-propyl), an aryl group (e.g., phenyl, 4-t-butylphenyl, 2,4-di-t-amylphenyl, and 4-tetradecanamidophenyl), a heterocyclic group (e.g., 2-furyl, 2-thienyl, 2-pyrimidinyl, and 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxy-phenoxy)-dodecanamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octyl-phenylthio, 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., N-ethylsulfamoyl, N,N-dipropyl- sulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic-oxy group (e.g., 1-phenyltetrazole-5-oxy and 2-tetrahydropyranyloxy), an azo group (e.g., phenylazo, 4-methoxyphenylazo, 4-pivaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclicthio group (e.g., 2-benzothiazolylthio, 2,4-di-phenoxy-1,3,5-triazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, and 4-dodecyloxybenzoyl), or an azolyl group (e.g., imidazolyl, pyrazolyl, 3-chloropyrazol-1-yl, and triazolyl).

Preferably $R_3$ represents, for example, an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an acyloxy group, a carbamoyloxy group, an aryloxycarbonylamino group, an imido group, a heterocyclicthio group, a sulfinyl group, a phosphonyl group, an aryloxycarbonyl group, an acyl group, or an azolyl group.

More preferably, $R_3$ represents an alkyl group or an aryl group, which, in view of cohesiveness, preferably has at least one substituent, and further more preferably $R_3$ represents an alkyl group or an aryl group having at least one alkoxy group, alkylamino group, sulfonyl group, sulfamoyl group, carbamoyl group, acylamido group, or sulfonamido group as a substituent.

particularly preferably $R_3$ represents an aryl group having an alkoxy group or an alkylamino group at the ortho position. Among them, an alkoxy group is preferable, and the alkyl residue of said alkoxy group may be a straight-chain alkyl group, a branched-chain alkyl group, or an alkyl group further substituted. As concrete examples of this alkyl residue, for example, can be mentioned methyl, ethyl, hexyl, 2-ethylhexyl, octyl, and benzyl, but the invention is not limited to them. The alkylamino group may be a monoalkylamino group or a dialkylamino group. This alkyl residue may be a straight-chain-type, a branched-chain-type, or a type further substituted. As concrete examples of alkylamino group, can be mentioned, for example monomethylamino group, dimethylamino group, and diethylamino group, but the invention is not limited to them. The aryl group having an alkoxy group or an alkylamino group on ortho position may be further substituted by other substituents. As examples of these substituents, an aliphatic or aromatic acylamido group, a sulfonamido group, or a halogen atom can be mentioned.

In the cyan coupler of the present invention, $R_1$ and $R_2$ are both electron-attracting groups having Hammett substituent constant $\sigma_p$ values of 0.20 or over and the sum $\sigma$f of the $\sigma_p$ values of $R_1$ and $R_2$ is 0.65 or over, so that color formation for a cyan image is made. The sum of the $\sigma_p$ values of $R_1$ and $R_2$ is preferably 0.70 or over and the upper limit thereof is preferably about 1.8.

Preferably $R_1$ and $R_2$ are electron-attracting groups having Hammett substituent constant $\sigma_p$ values of 0.30 or over. Preferably the upper limit of the Hammett substituent constant $\sigma_p$ values of the electron-attracting groups is 1.0. The Hammett rule is an empirical rule advocated by L. P. Hammett in 1935 to discuss quantitatively the influence of substituents on reactions or equilibriums of benzene derivatives, and its appropriateness is now widely recognized.

Substituent constants determined by the Hammett rule include $\sigma_p$ and $\sigma_m$ values and many of them are listed in common books; for example they are listed in detail by J. A. Dean in *Lange's Handbook of Chemistry,* Vol. 12, 1979 (Mc Graw-Hill), and in *Kagaku no Ryoiki, an extra issue,* No. 122, pages 96 to 103, 1979 (Nankodo). In the present invention, although $R_1$ and $R_2$ are defined by Hammett substituent constant $\sigma_p$ values, the substituents represented by $R_1$ and $R_2$ are of course not limited to only those substituents whose Hammett substituent constant $\sigma_p$ values are known and listed in these books, but also include substituents whose Hammett substituent constant $\sigma_p$ values are not known in the literature but fall in the above ranges when measured based on the Hammett rule.

Specific examples of the electron-attracting groups $R_1$ and $R_2$ having $\sigma_p$ values of 0.20 or over include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by other electron-attracting group having a $\sigma_p$ value of 0.20 or over, a heterocyclic group, a halogen atom, an azo group, and a selenocyanate group. Out of these substituents, those substituents which can have a further substituent may have such a substituent as described for $R_3$.

In more detail, examples of the electron-attracting groups represented by $R_1$ and $R_2$, whose $\sigma_p$ value is 0.20 or over include an acyl group (e.g., acetyl, 3-phenylpropanoyl, benzoyl, and 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, and N-{3-(2,4-di-t-amylphenoxy)propyl}carbamoyl), an alkoxycarbonyl group (e.g., methoxycarbonyl, ethoxycarbonyl, iso-propyloxycarbonyl, tert-butyloxycarbonyl, isobutyloxycarbonyl, butyloxycarbonyl, dodecyloxycarbonyl, and octadecyloxycarbonyl), an aryloxycarbonyl group (e.g., a phenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl and octanesulfonyl), an arylsulfonyl group (e.g., benzenesulfonyl and toluenesulfonyl), a sulfonyloxy group (e.g., methanesulfonyloxy and toluenesulfonyloxy), an acylthio group (e.g., acetylthio and benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl.), a thiocyanate group, a thiocarbonyl group (e.g., methylthiocarbonyl and phenylthiocarbonyl), a halogenated alkyl group (e.g., trifluoromethyl and heptafluoropropyl), a halogenated alkoxy group (e.g., trifluoromethyloxy), a halogenated aryloxy group (e.g., pentachlorophenyloxy), a halogenated alkylamino group (e.g., N,N-di-(trifluoromethyl)amino), a halogenated alkylthio group (e.g., difluoromethylthio and 1,1,2,2-tetrafluoroethylthio), an aryl group substituted by other electron-attracting group whose $\sigma_p$ value is 0.20 or over (e.g., 2,4-dinitrophenyl, 2,4,6-trichlorophenyl, and pentachlorophenyl), a heterocyclic group (e.g., 2-benzoxazolyl, 2-benzothiazolyl, 1-phenyl-2-benzimidazolyl, 5-chloro-1-tetrazolyl, and 1-pyrrolyl), a halogen atom (e.g., a chlorine atom and a bromine atom), an azo group (e.g., phenylazo), and a selenocyanate group.

Preferably, $R_1$ and $R_2$ each represent, for example, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by two or more other electron-attracting groups whose $\sigma_p$ is 0.20 or over, or a heterocyclic group, with more preference given to an acyl group, an alkoxycarbonyl group, an aryloxycarbonyl group, a nitro group, a cyano group, an arylsulfonyl group, a carbamoyl group, or a halogenated alkyl group.

Most preferably $R_1$ represents a cyano group. $R_2$ represents particularly preferably an aryloxycarbonyl group or an alkoxycarbonyl group, and most preferably a branched alkoxycarbonyl group or an alkoxycarbonyl group having an electron-attracting group.

X represents a hydrogen atom or a group capable of being released upon coupling reaction with the oxidized product of an aromatic primary amine color developing agent (a coupling-off group) and in particular the coupling-off group includes, for example, a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkylthio group, an arylthio group, a heterocyclic-thio group, an alkylsulfinyl group, an arylsulfinyl group, a carbamoylamino group, a 5- or 6-membered nitrogen-containing heterocyclic group, an imido group, and an arylazo group, which may further be substituted by a group allowable as a substituent of $R_3$.

More particularly, X represents, for example, a halogen atom (e.g., a fluorine atom, a chlorine atom, and a bromine atom), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (e.g., acetoxy, tetradecanoyloxy and benzoyloxy), an alkylsulfonyloxy or arylsulfonyloxy group (e.g., methanesulfonyloxy and toluenesulfonyloxy), an acylamino group (e.g., dichloroacetylamino and heptafluorobutylylamino), an alkylsulfonamido or arylsulfonamido group (e.g., methanesulfonamino, trifluoromethanesulfonamino, p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an alkylthio, arylthio, or heterocyclic-thio group (e.g., dodecylthio, 1-carboxydodecylthio, phenylthio, 2-butoxy-5-t-octylphenylthio, and tetrazolylthio), an alkylsulfinyl or arylsulfinyl group (e.g., isopropylsulfinyl and phenylsulfinyl), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxo-1-pyridyl), an imido group (e.g., succinimido and hydantoinyl), or an arylazo group (e.g., phenylazo and 4-methoxyphenylazo). Further, X may be in the form of a bis-type coupler obtained by condensing a 4-equivalent coupler with aldehydes or ketones as a coupling-off group bonded through the carbon atom. X may also contain a photographically useful group such as a development restrainer and a development accelerator.

Preferably, X represents a halogen atom, an alkoxy group, an aryloxy group, an alkylthio or arylthio group, an alkylsulfinyl or arylsulfinyl group, or a 5- or 6-membered nitrogen-containing heterocyclic group bonded through the nitrogen atom to the coupling active site, more preferably a halogen atom, an alkylthio or arylthio group, or an alkylsulfinyl or arylsulfinyl group, and particularly preferably an arylthio group or an arylsulfinyl group.

With respect to the cyan coupler represented by formula (I) or (II), $R_1$, $R_2$, $R_3$, or X may be a divalent group to form a dimer or more higher polymer or to bond to a polymer chain to form a homopolymer or copolymer. A typical example of the homopolymer or copolymer formed by bonding to a polymer chain is a simple polymer or copolymer of an addition-polymerizable ethylenically unsaturated compound having a cyan coupler residue represented by formula (I) or (II). In this case, with respect to the cyan color forming repeating unit having a cyan coupler residue represented by formula (I) or (II), one or more different types of such units may be contained in the polymer, and the copolymer may contain one or more non-color-forming ethylenically unsaturated monomers as copolymerization components. The cyan color forming repeating unit having a cyan coupler residue represented by formula (I) or (II) is preferably represented by the following formula (P):

formula (P)

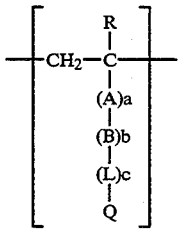

wherein R represents a hydrogen atom, an alkyl group having 1 to 4 carbon atoms, or a chlorine atom, A represents —CONH—, —COO—, or a substituted or unsubstituted phenylene group, B represents a substituted or unsubstituted alkylene group, phenylene group, or aralkylene group, L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—, a, b, and c are each 0 or 1, and Q represents a cyan coupler residue formed by releasing a hydrogen atom from $R_1$, $R_2$, $R_3$, or X of a compound represented by formula (I) or (II).

Preferably the polymer is a copolymer of the cyan color-forming monomer represented by the coupler unit of formula (I) or (II) with a non-color-forming ethylenically unsaturated monomer that does not couple with the oxidation product of an aromatic primary amine developing agent.

The non-color-forming ethylenically unsaturated monomer that does not couple with the oxidation product of an aromatic primary amine developing agent includes, for example, acrylic acid, α-chloroacrylic acid, an α-alkylacrylic acid (e.g., methacrylic acid), an amide or ester derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxymethacrylate), a vinyl ester (e.g., vinyl acetate, vinyl propionate, and vinyl laurate), acrylonitrile, methacrylonitrile, an aromatic vinyl compound (e.g., styrene and its derivatives, such as vinyltoluene, divinylbenzene, vinylacetophenone, and sulfostyrene), itaconic acid, citraconic acid, crotonic acid, vinylidene chloride, a vinyl alkyl ether (e.g., vinyl ethyl ether), a maleate, N-vinyl-2-pyrrolidone, N-vinylpyridine, 2-vinylpyridine, and 4-vinylpyridine.

In particular, acrylates, methacrylates, and maleates are preferable. Two or more of these non-color-forming ethylenically unsaturated monomers can be used in combination. For example, use is made of a combination of methyl acrylate with butyl acrylate, a combination of butyl acrylate with styrene, a combination of butyl methacrylate with methacrylic acid, or a combination of methyl acrylate with diacetone acrylamide.

As is well known in the field of polymer couplers, the ethylenically unsaturated monomer to be copolymerized with a vinyl monomer corresponding to formula (I) or (II) can be selected such that the physical properties and/or chemical properties of the copolymer to be formed, such as the solubility, the compatibility with the binder in the photographic colloid composition, for example with gelatin, the flexibility, and the heat stability, are favorably influenced.

To incorporate the cyan coupler of the present invention into the silver halide photographic material,—preferably into the red sensitive silver halide emulsion layer,—preferably the cyan coupler is made into a so-called incorporated coupler, and, for that purpose, preferably at least one group of $R_1$, $R_2$, $R_3$, and X is a so-called ballasting group (preferably having a total number of carbon atoms of 10 or more, more preferably 10 to 50).

In the present invention, a cyan coupler represented by formula (I) is preferable in view of the effects, for example, for the hue, the color image stability, and the color-forming property, and the cyan coupler represented by formula (I-a) is particularly preferable in view of the above effects.

Specific examples of the coupler of the present invention are shown below, but the present invention is not restricted to them.

C-1
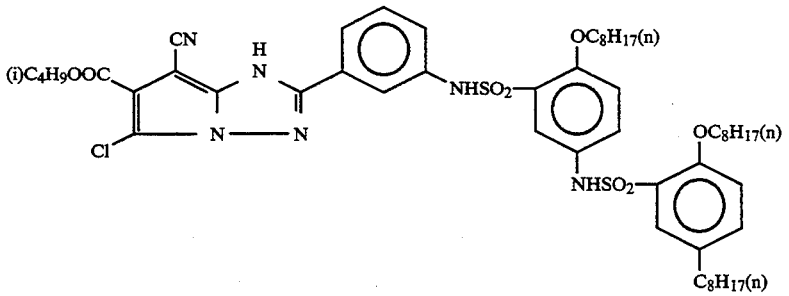
C-2
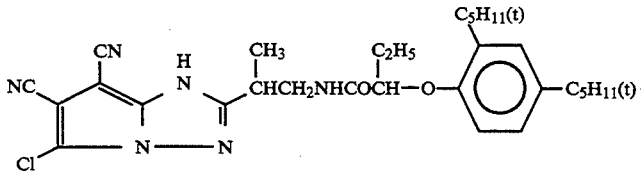
C-3
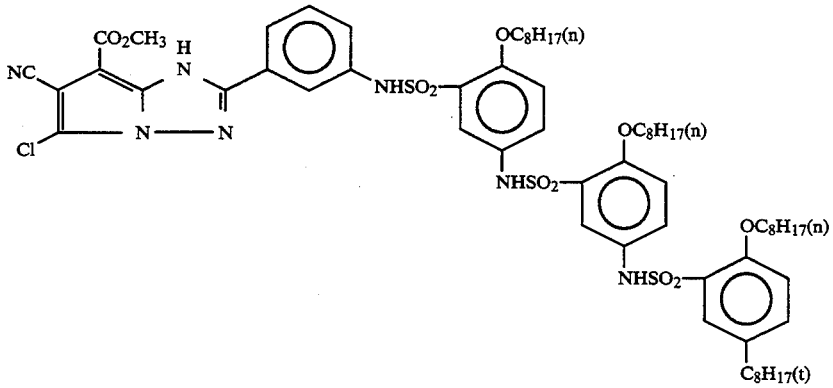
C-4
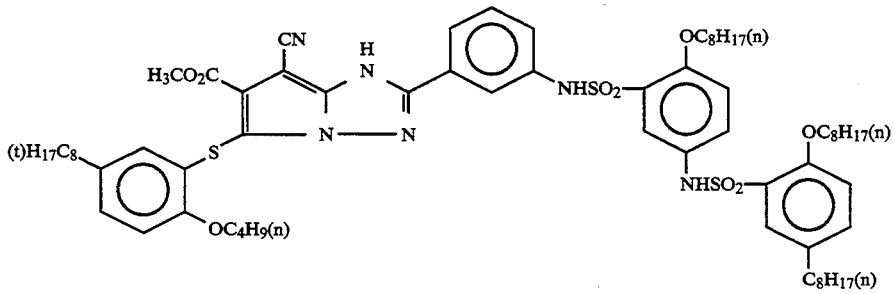
C-5
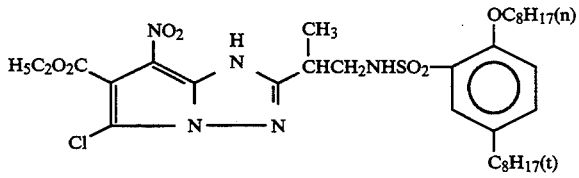
C-6
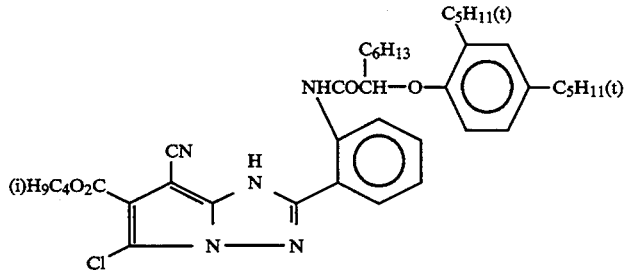

-continued
C-7
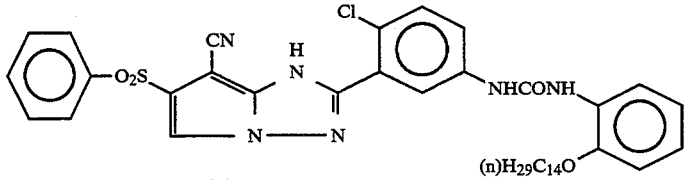
C-8
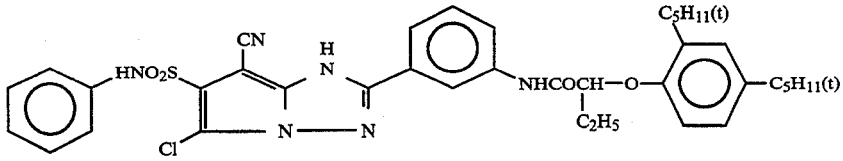
C-9
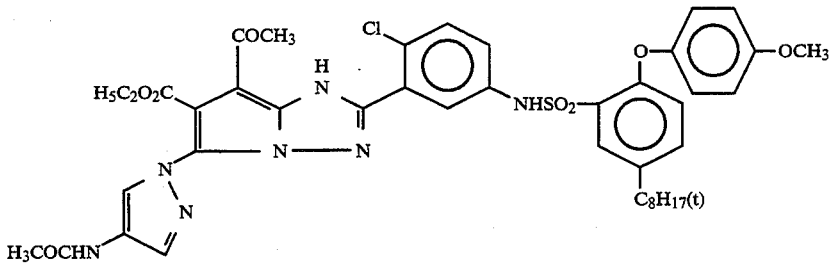
C-10
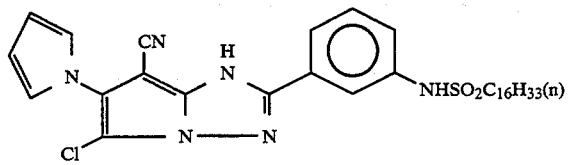
C-11
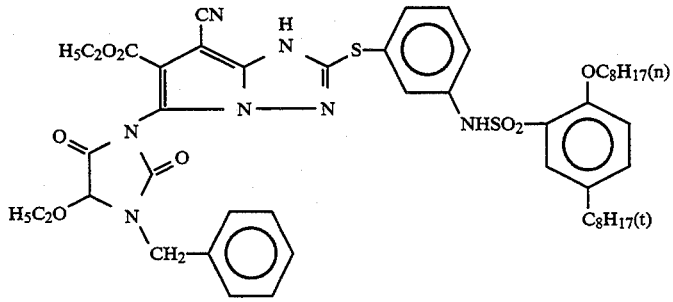
C-12
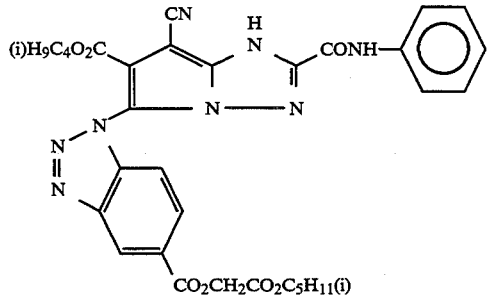
C-13
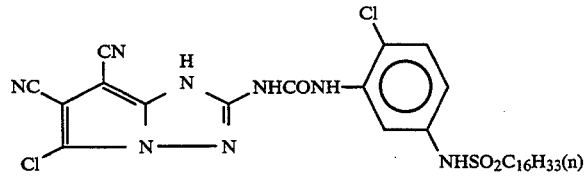

-continued
C-14
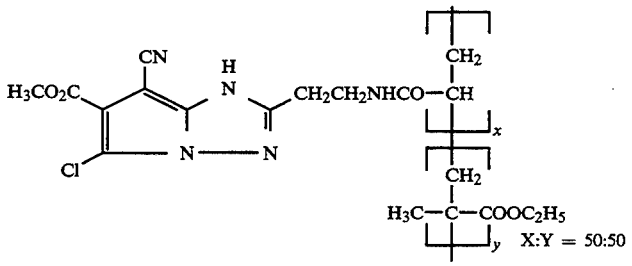
C-15
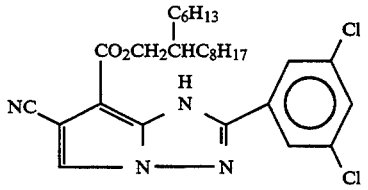
C-16
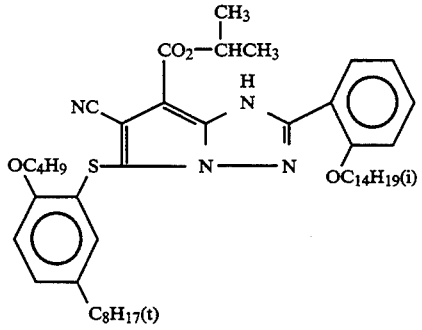
C-17
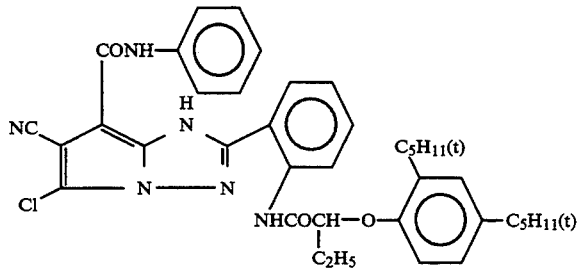
C-18
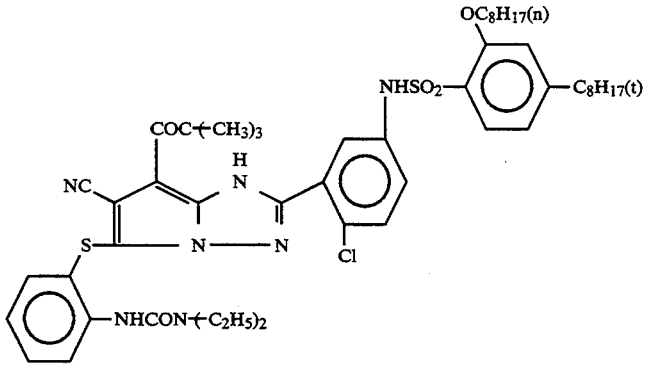

-continued
C-19
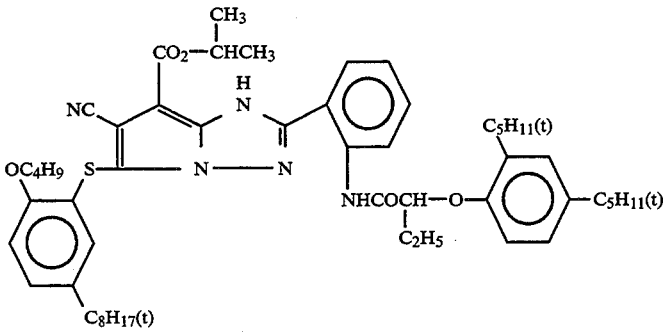
C-20
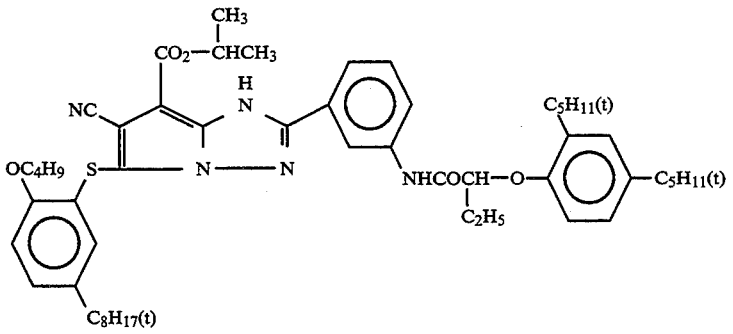
C-21
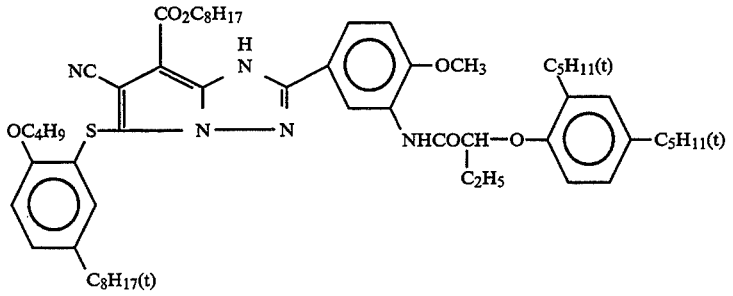
C-22
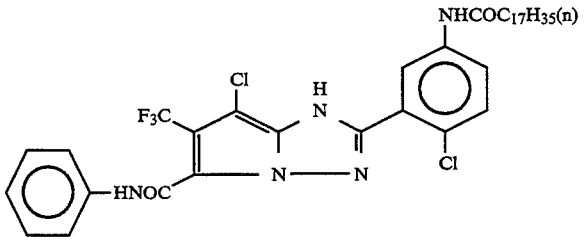
C-23
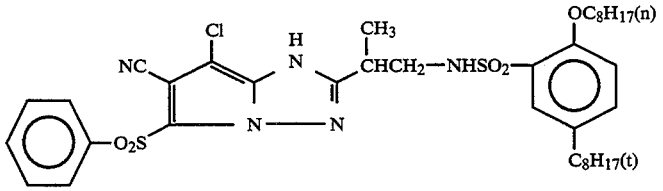
C-24
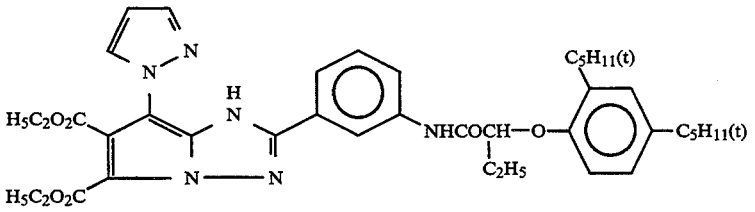

-continued
C-25
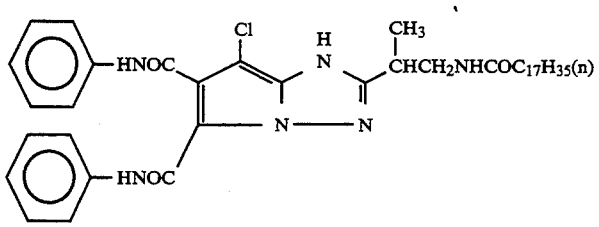
C-26
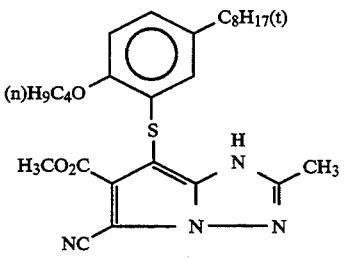
C-27
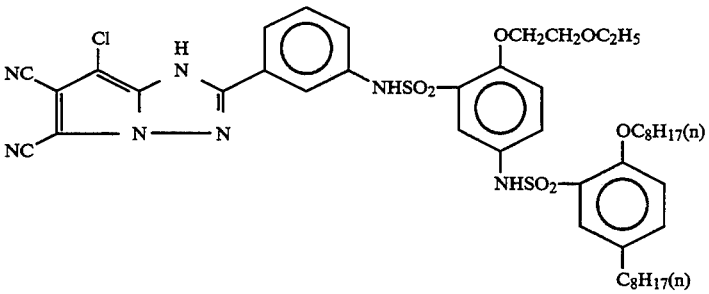
C-28
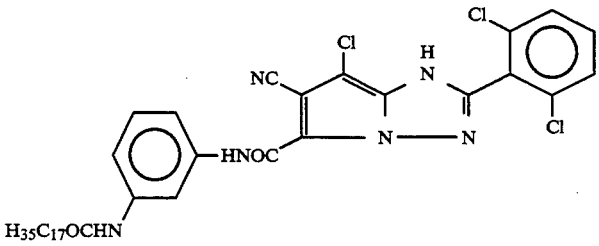
C-29
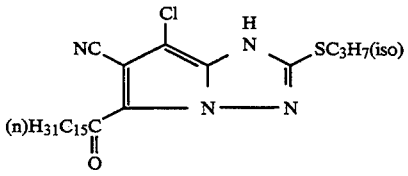
C-30
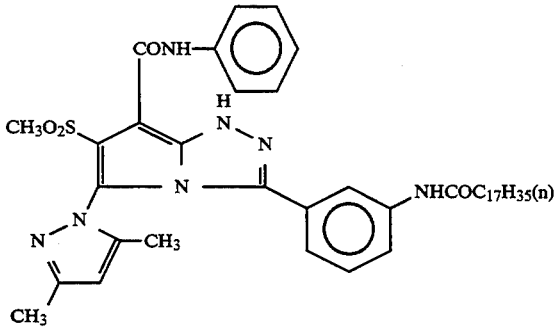

-continued
C-31
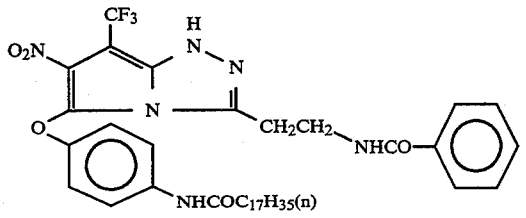
C-32
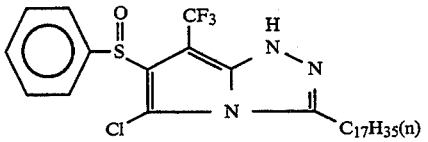
C-33
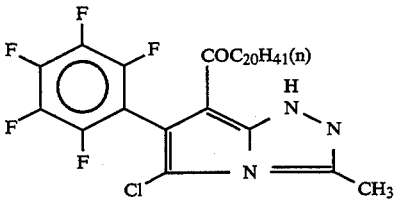
C-34
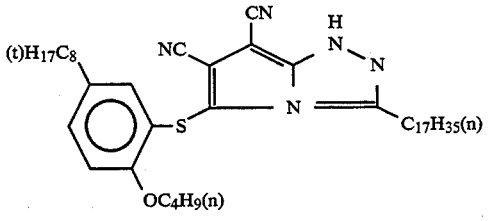
C-35
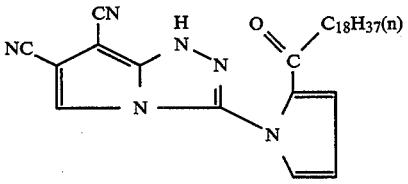
C-36
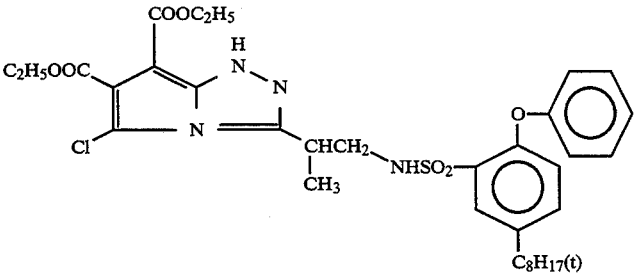
C-37
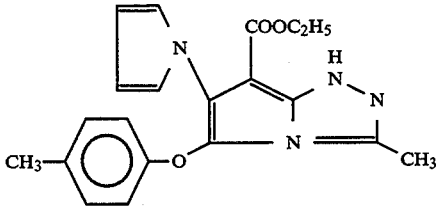

-continued
C-38
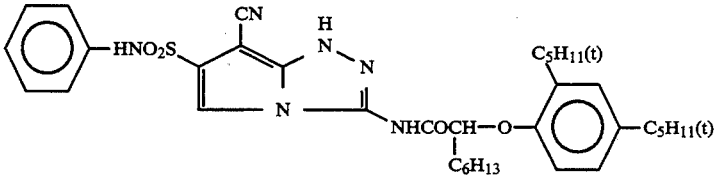
C-39
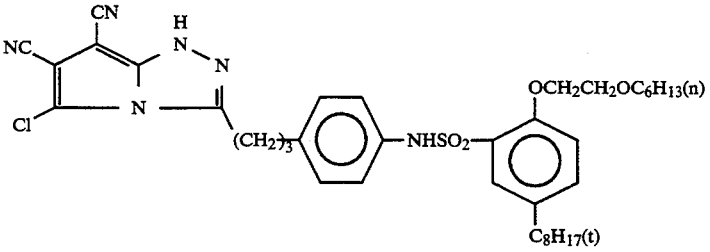
C-40
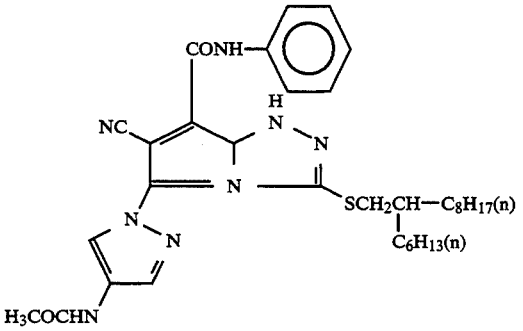
C-41
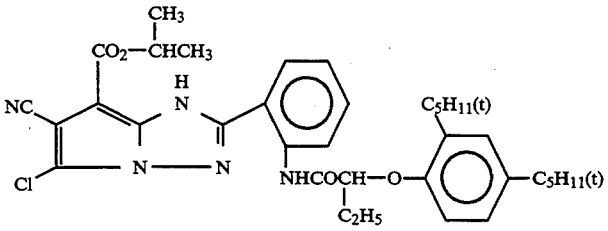
C-42
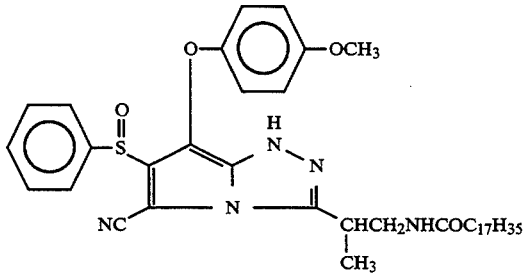
C-43
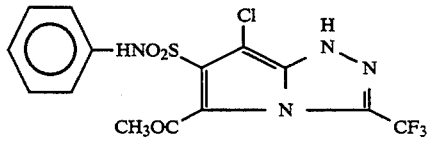
C-44
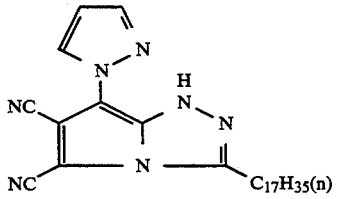

-continued
C-45
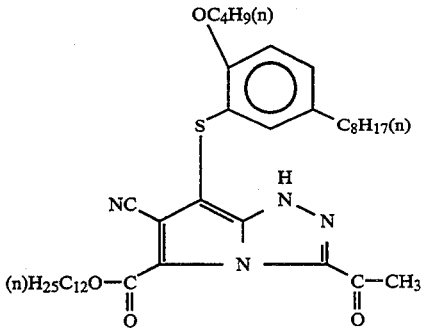
C-46
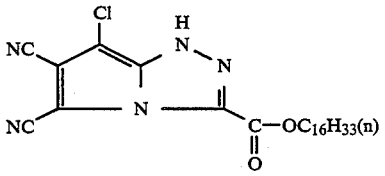
C-47
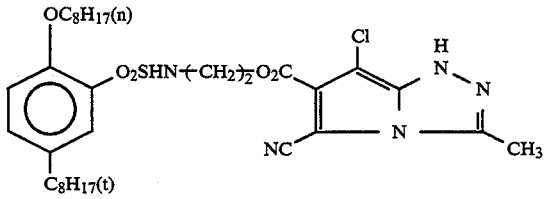
C-48
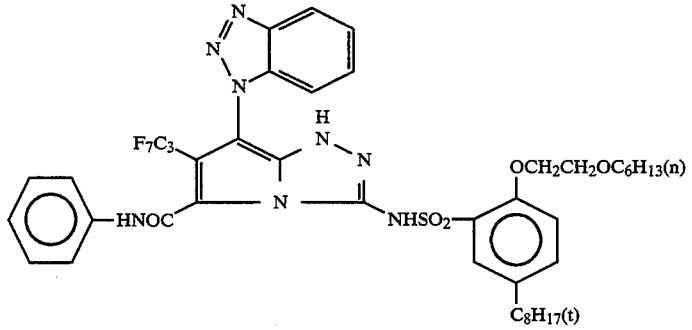
C-49
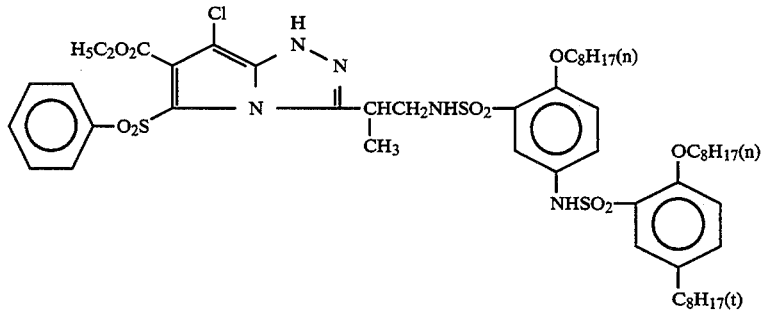

-continued
C-50
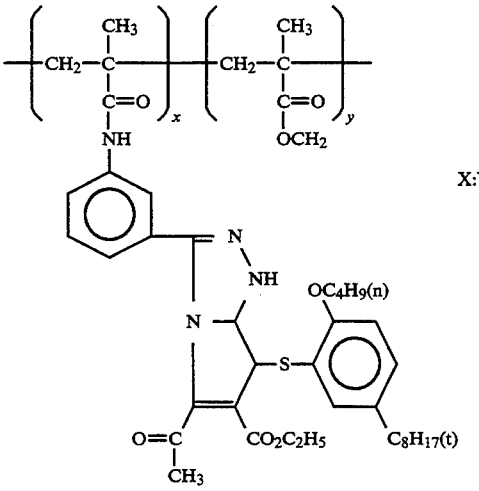
X:Y = 55:45
C-51
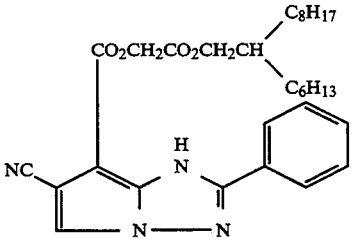
C-52
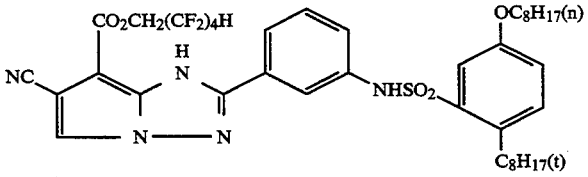
C-53
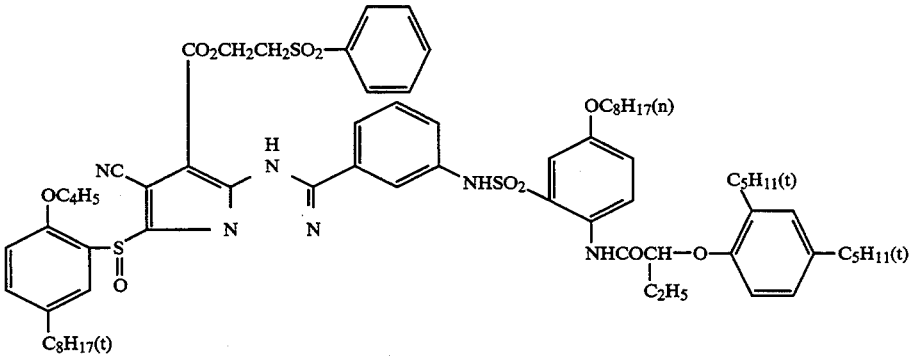
C-54
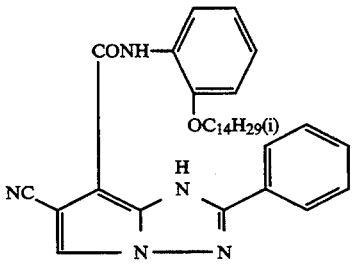

-continued
C-55
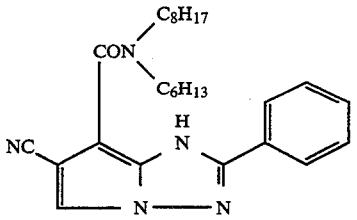
C-56
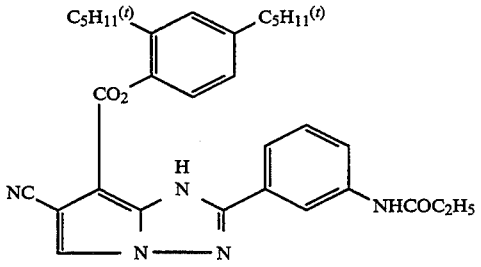
C-57
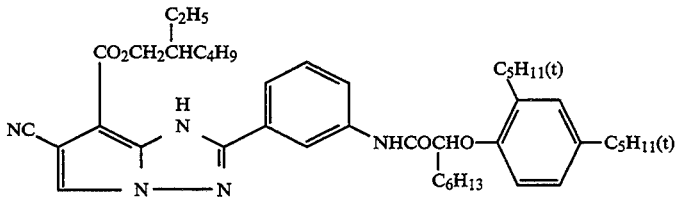
C-58
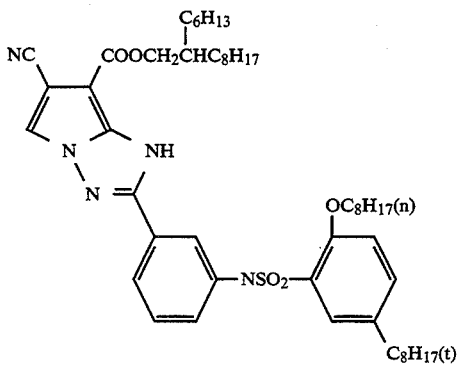
C-59
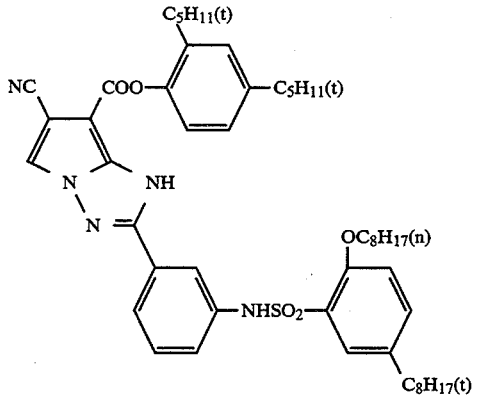

-continued
C-60
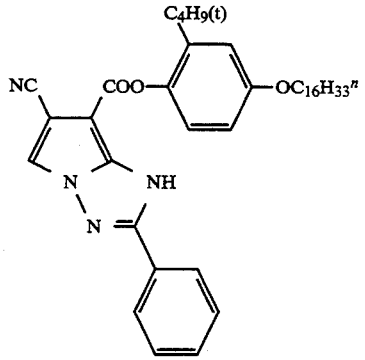
C-61
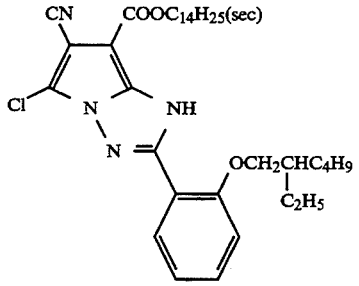
C-62
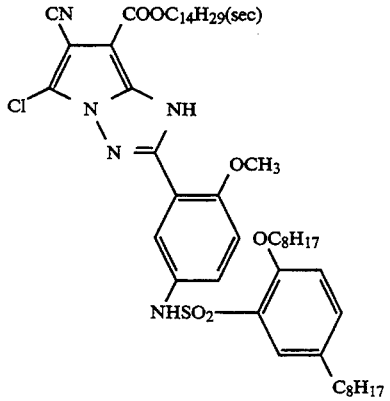
C-63
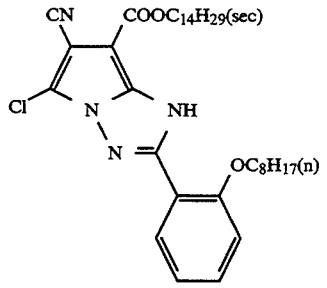
C-64
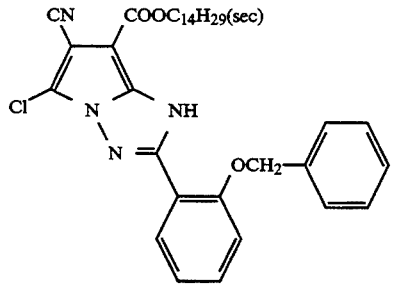

-continued
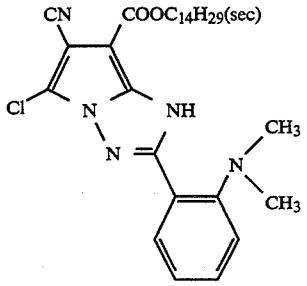
C-65
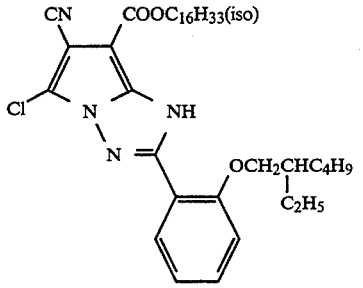
C-66
Now, Synthesis Examples of the cyan coupler of the present invention are shown to describe methods of the synthesis.
Synthesis Example 1 (Synthesis of Exemplified Compound C-1)
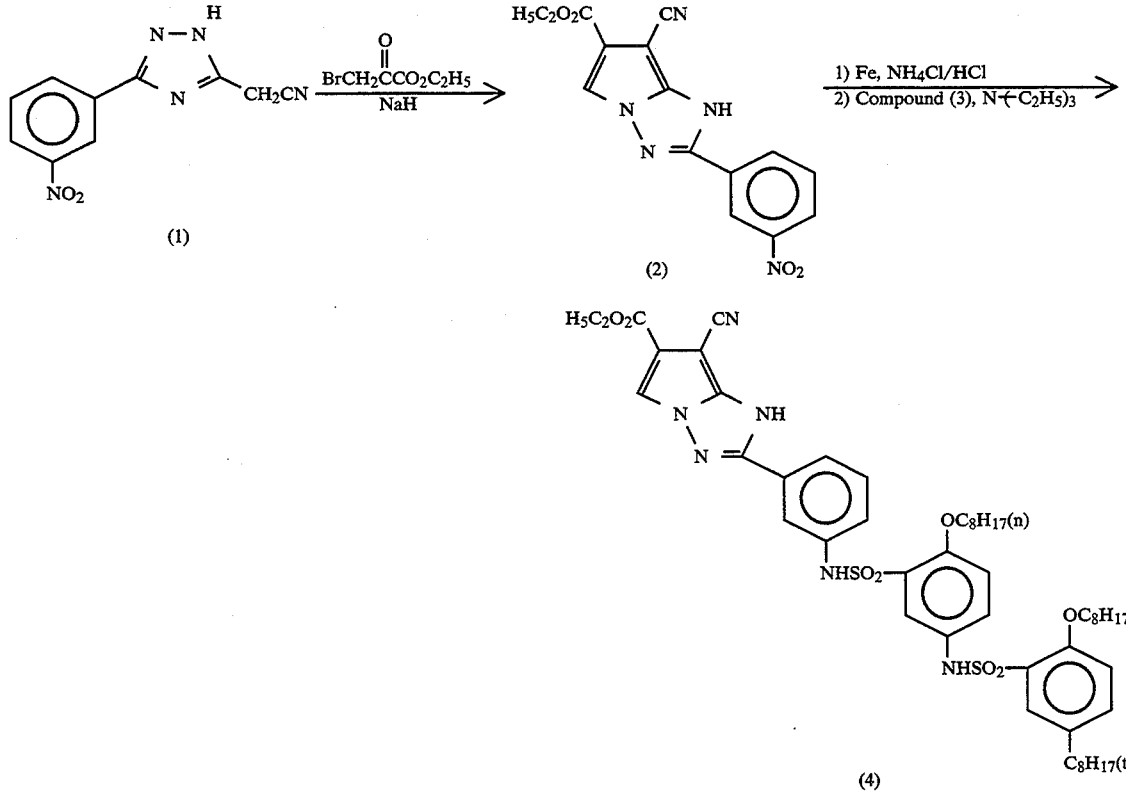

-continued

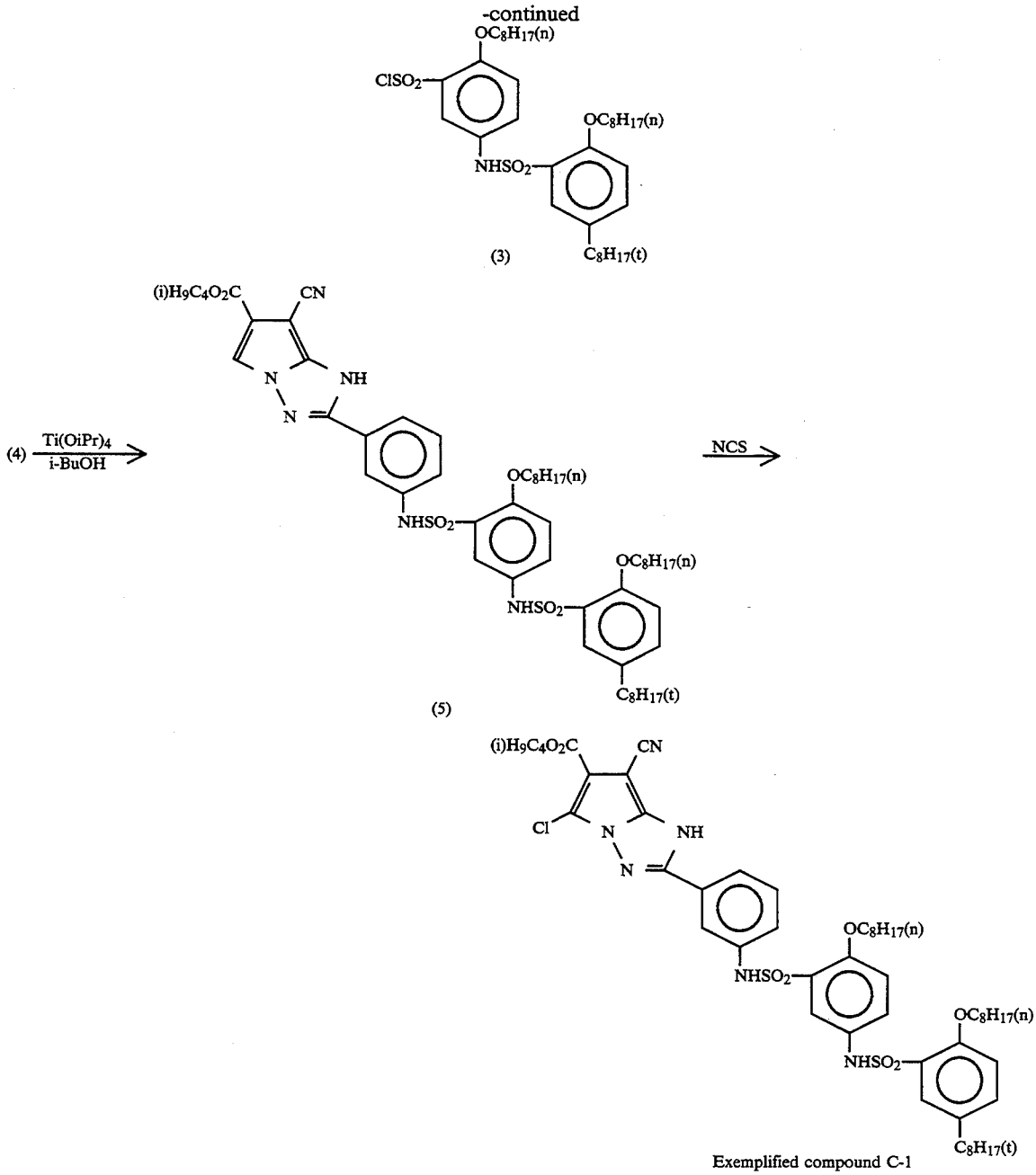

Exemplified compound C-1

3-m-Nitrophenyl-5-methylcyano-1,2,4-triazole (1) (20.0 g, 87.3 mmol) was dissolved in 150 ml of dimethylacetamide; then NaH (60% in oil) (7.3 g, 183 mmol) was added little by little to the solution, and the mixture was heated to 80° C. A solution of ethyl bromopyruvate (13.1 ml, 105 mmol) in 50 ml of dimethylacetamide was added dropwise thereto slowly. After the addition, the mixture was stirred for 30 min at 80° C. and then was cooled to room temperature. Then, after 1N hydrochloric acid was added to the reaction liquid to make the reaction liquid acid, extraction with ethyl acetate was carried out; the organic layer was dried over Glauber's salt; and the solvent was distilled off under reduced pressure. The residue was purified by silica gel chromatography and 10.79 g (38%) of Compound (2) was obtained.

Reduced iron (9.26 g, 166 mmol) and ammonium chloride (0.89 g, 16.6 mmol) were suspended in 300 ml of isopropanol; then 30 ml of water and 2 ml of concentrated hydrochloric acid were added and the mixture was heated for 30 min under reflux. While heating the mixture under reflux, Compound (2) (10.79 g, 33.2 mmol) was added little by little. After 4 hours of the heating under reflux, the reaction mixture was filtered through sellaite and the filtrate was distilled under reduced pressure. The residue was dissolved in a mixture of 40 ml of dimethylacetamide and 60 ml of ethyl acetate, and after Compound (3) (25.6 g, 36.5 mmol) was added to the solution, triethylamine (23.1 ml, 166 mmol) was added thereto, followed by heating at 70° C. for 5 hours. After the reaction liquid was cooled to room temperature, water was added and extraction with ethyl acetate was carried out. Then, after the extract was washed with water, it was dried over Glauber's salt and the solvent was distilled off under reduced pressure.

The residue was purified by silica gel chromatography, and 16.5 g (52%) of Compound (4) was obtained.

The Compound (4) (7.0 g, 7.30 ml) was dissolved in 14 ml of isobutanol, and then tetraisopropyl orthotitanate (0.43 ml, 1.46 mmol) was added to the solution followed by heating under reflux for 6 hours. The reaction liquid was cooled to room temperature, water was added thereto, and extraction with ethyl acetate was carried out. The extract was dried over Glauber's salt, and the solvent was distilled off under reduced pressure. The residue was purified by silica gel chromatography, and 5.0 g (69%) of Compound (5) was obtained.

The Compound (5) (5.0 g, 5.04 mmol) was dissolved in 50 ml of tetrahydrofuran and then $SO_2Cl_2$ (0.40 ml, 5.04 mmol) was added dropwise to the solution under cooling with water, followed by stirring for 4 hours under cooling with water. Water was added to the reaction liquid, extraction with ethyl acetate was carried out, the extract was dried over Glauber's salt, and the solvent was distilled off under reduced pressure. The residue was purified by silica gel chromatography and 3.9 g (76%) of Exemplified Compound C-1 could be obtained.

Synthesis Example 2 (Synthesis of Exemplified Compound C-39)

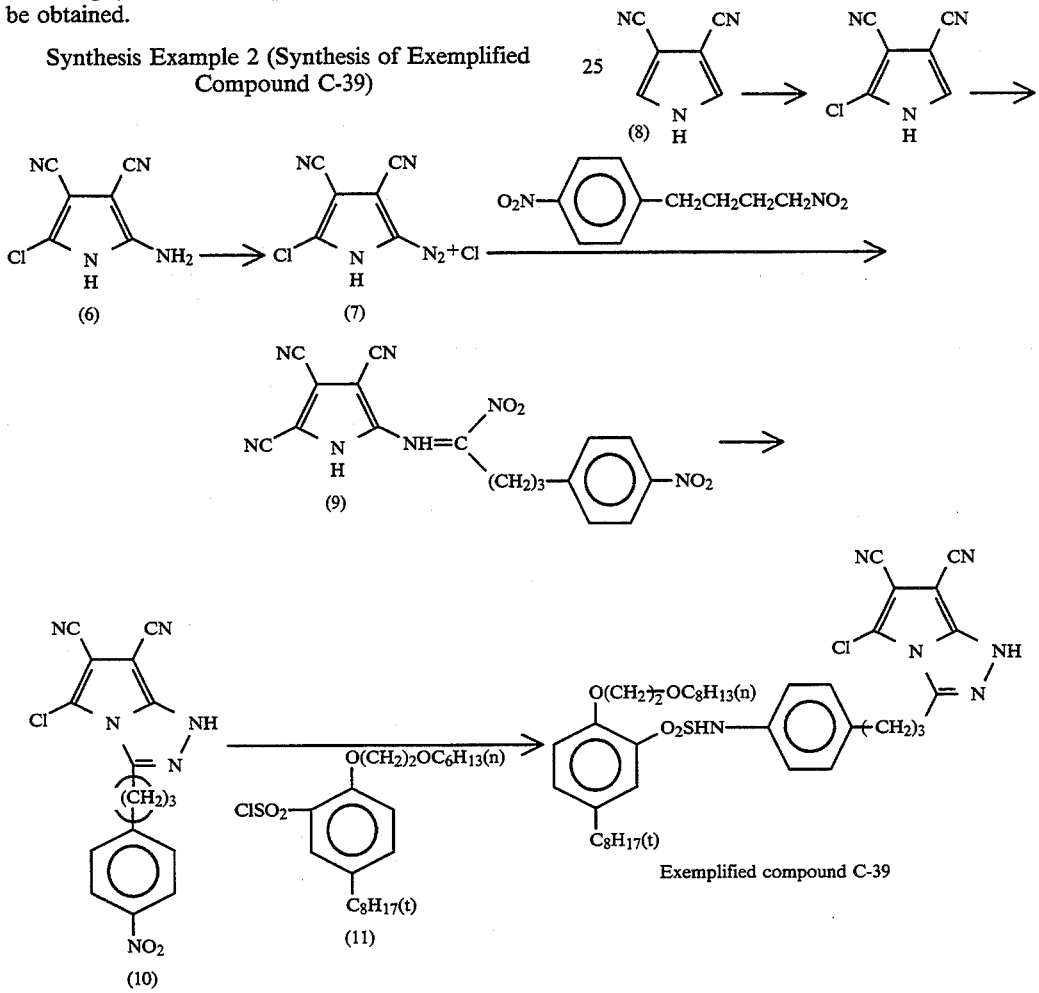

38 Milliliters of 36% hydrochloric acid was added to 2-amino-5-chloro-3,4-dicyanopyrrole (6) (6.78 g, 4.07 mmol), and then a solution of sodium nitrite (2.95 g, 42.7 mmol) in 5.9 ml of water was added dropwise slowly thereto with stirring under cooling with ice, followed by stirring for 1.5 hours, thereby synthesizing Compound (7). The solution of the thus synthesized Compound (7) was added dropwise slowly under cooling with ice to a solution prepared by adding 102 ml of 28% sodium methylate to 177 ml of a solution of Compound (8) (9.58 g, 427 mmol) in ethanol with stirring under cooling with ice. The stirring was continued for a further 1 hour. Then the reaction liquid was heated under reflux for 1.5 hours with stirring. Thereafter, the ethanol was distilled off from the reaction liquid under reduced pressure; the residue was dissolved in chloroform; the solution was washed with saturated brine and was dried over Glauber's salt; and the chloroform was distilled off under reduced pressure. The residue was purified by silica gel column chromatography, and 4.19 g (yield: 29% based on Compound (6)) of Compound (10) was obtained.

The synthesis of Compound (6) was carried out in such a way that the above 3,4-dicyanopyrrole was chlorinated, then nitrated, and reduced with iron. By following the method described in *Journal of the American Chemical Society,* 76, 3209 (1954), Compound (8) was synthesized from Compound (a) synthesized from γ-lactone and benzene in the known manner.

-continued

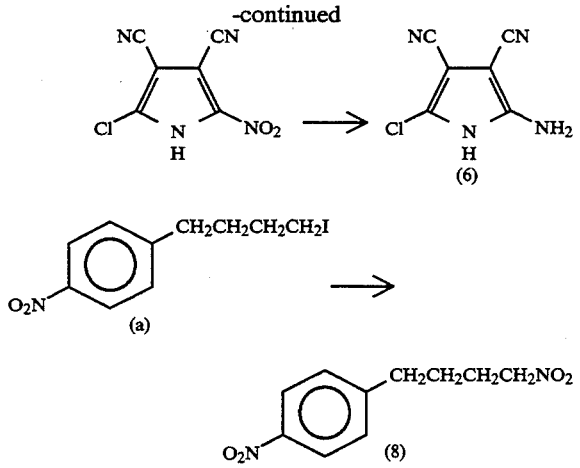

10 Milliliters of water, ammonium chloride (0.3 g, 5.9 mmol), and acetic acid (0.34 ml, 5.9 mmol) were added to reduced powder iron (3.3 g, 59.0 mmol), followed by heating for 15 min under reflux with stirring, and thereafter 31 ml of isopropanol was added, followed by heating for 20 min under reflux with stirring. Then, 14 ml of a solution of Compound (10) (4.1 g, 11.8 mmol) in isopropanol was added dropwise thereto; then, after heating the mixture for 2 hours under reflux with stirring, the reaction liquid was filtered using sellaite as a filter aid, the residue was washed with ethyl acetate, and the solution was distilled under reduced pressure.

The residue was dissolved in a mixture of 16 ml of ethyl acetate and 24 ml of dimethylacetamide, and then Compound (11) (5.6 g, 13.0 mmol) and then triethylamine (8.2 ml, 59.0 mmol) were added to the solution, followed by stirring for 4 hours at room temperature. Water was added to the reaction mixture; extraction with ethyl acetate was carried out; and the extract was washed with a saturated brine. After the extract was dried over Glauber's salt, the solvent was distilled off; the residue was purified by silica gel chromatography; and Exemplified Compound C-39 was obtained in an amount of 6.46 g (76%).

In the color photographic material of the present invention, the silver halide emulsion grains used in the cyan dye forming layer comprises silver chlorobromide containing 90% or more of silver chloride and it is required that the formation of the grains is carried out as defined above. Although the silver halide emulsions used in other dye forming layers of the present invention, i.e., the yellow dye forming layer and the magenta dye forming layer is not particularly restricted, preferably said silver halide emulsions comprises silver chlorobromide containing 90 mol % or more of silver chloride similarly to the silver halide emulsion used in the cyan dye forming layer. The silver halide grains in these silver chlorobromide emulsions may contain silver bromide in various forms. That is, it is possible to form a so-called solid solution wherein silver bromide may be distributed throughout silver halide grains or it is also possible that phases containing silver bromide are present unevenly in grains. In such a case, the layer containing the silver bromide can take various forms. For example, phases different in the silver bromide content may take the form of a core or a shell to form a so-called layered structure, or a phase containing a large amount of silver bromide may form a localized phase separately in a part in the grain or in a part on the surface of the grain. Further, similarly to the silver halide emulsion grains used in the cyan dye forming layer, a water-soluble bromide may be added in the process of the formation of the grains or at the period before the coating process.

When the grains are formed, it is possible to allow the silver halide emulsion used in the photographic material of the present invention to contain polyvalent metal impurity ions (dopants) solely or in some combination for the purpose of securing high sensitivity or high contrast. As is described above, it is preferable to add iridium ions into the silver halide emulsion used in the cyan dye forming layer, but it is also similarly preferable to add iridium ions into the silver halide emulsions used in the yellow dye forming layer and the magenta dye forming layer. Further, besides the iridium salt, salts or complex salts of ions of transition metal in Group VIII such as ions of iron, cobalt, nickel, ruthenium, rhodium, palladium, osmium, or platinum or salts of bivalent metals such as copper, zinc, cadmium, or lead are preferably included. Optionally, a combination of several types of these metal ions may be included.

The average grain size of the silver halide grains (assuming the circles having diameters equivalent to the projected areas of the grains to be the grain sizes and designating the number average thereof as the average grain size) contained in the silver halide emulsion used in the present invention is preferably 0.1 to 2 μm. Further, the grain size distribution of them is preferably such that the deviation coefficient (obtained by dividing the standard deviation of the grain size distribution by the average grain size) is 20% or less, desirably 15% or less, that is, the grain size distribution is preferably a so-called monodisperse distribution. At that time, it is also preferably carried out that such monodisperse emulsions are blended to be used in one layer or are applied in layers for the purpose of taking wide latitude.

The shape of the silver halide grains contained in the photographic emulsion may be a regular crystalline shape such as a cubic shape, a tetradecahedral shape, and an octahedral shape, or an irregular crystalline shape such as a spherical shape and a tabular shape, or a complex shape of these shapes can be used. Also a mixture of these crystalline shapes can be used. In the present invention, out of grains having these shapes, grains containing 50% or more, preferably 70% or more, and more preferably 90% or more, of grains having a cubic crystalline shape or a tetradecahedral crystalline shape are preferred.

The silver chlorobromide or silver chloride emulsion used in producing the silver halide emulsion grains of the present invention can be prepared by a method described, for example, by P. Glafkides in "*Chimie et Phisique Photographique*" (published by Paul Montel, 1967), by G. F. Duffin in "*Photographic Emulsion Chemistry*" (published by Focal Press, 1966), or by V. L. Zelikman "*Making and Coating Photographic Emulsion*" (published by Focal Press, 1964). That is, any of the acid process, the neutral process, the ammonia process, etc. can be used and, as the type of reacting a soluble silver salt with a soluble halide, for example, any of the single-jet method, the double-jet method, and the combination of them may be used. Also a method wherein grains are formed in an atmosphere having excess silver ions (the so-called reverse mixing method) can be used. As one type of the double-jet method, a method for keeping the silver ion concentration constant in a liquid phase wherein a silver halide will be formed, that is, the controlled double-jet method can be used. According to this method, a silver halide emulsion wherein the crystalline shape is regular and the grain size is nearly monodisperse can be obtained.

The silver halide emulsion used in the present invention is chemically sensitized and spectrally sensitized.

The chemical sensitization of the silver halide emulsion of the present invention can be carried out, for example, by using sulfur sensitization, selenium sensitization, reduction sensitization, and noble metal sensitization solely or in combination.

As the compound used in the sulfur sensitization, thiosulfates, rhodanines, thioureas, or thioamides (e.g., compounds described, for example, in U.S. Pat. Nos. 2,410,689, 3,501,313, 2,278,947, 1,574,944, 2,728,668, 3,656,955, 4,001,025, and 4,116,697, and JP-A No. 45016/1980), thioesters (e.g., compounds described, for example, in JP-B ("JP-B" means examined Japanese patent publication) Nos. 13485/1968 and 42374/1980 and British Patent No. 1,190,678), and polysulfur compounds (e.g., compounds described, for example, in U.S. Pat. Nos. 3,647,469, 3,656,955, and 3,689,273, JP-A No. 81230/1978, and JP-B Nos. 20533/1974 and 45134/1984) can be mentioned.

As the compounds used in the selenium sensitization, selenium compounds described, for example, in JP-A No. 150046/1984 can be mentioned.

As the compounds used in the reduction sensitization, for example, inorganic reducing agents such as $SnCl_2$ and $NaBH_4$ or amines, hydrazines, formamidinesulfins, or silanes (e.g., compounds described, for example, in U.S. Pat. Nos. 2,518,698, 2,743,182, 3,369,904, 2,666,700, 2,419,973, 2,419,974, 2,419,975, 2,740,713, 2,521,926, 2,487,850, 2,983,609, 2,983,610, 2,694,637, 3,930,867, and 3,904,415, British Patent No. 1,390,540, and JP-A Nos. 127622/1975 and 163232/1982) and aldehydes (e.g., compounds described, for example, in U.S. Pat. No. 2,604,397) can be mentioned.

As the compounds used in the noble metal sensitization, complex compounds of transition elements of Group VIII of the Periodic Table, such as gold, platinum, iridium, and palladium, (e.g., compounds described, for example, in U.S. Pat. Nos. 2,399,083, 2,448,060, 3,503,749, 2,597,856, 2,597,915, 2,624,674, and 2,642,361 and British Patent No. 618,061) can be mentioned.

To subject the silver halide emulsion of the present invention to the so-called spectral sensitization so as to give spectral sensitivity in a desired wavelength range can be carried out by adding a dye for absorbing light in the wavelength range corresponding to the intended spectral sensitivity (spectrally sensitizing dye).

As the spectrally sensitizing dye used at that time, for example, compounds described by F. M. Harmer in *Heterocyclic compounds—Cyanine dyes and related compounds,* (published by John Wiley & Sons [New York, London], 1964) can be mentioned.

The spectrally sensitizing dye used in the present invention includes, for example, cyanine dyes, merocyanine dyes, and complex merocyanine dyes. In addition, composite cyanine dyes, halopolar cyanine dyes, hemicyanine dyes, styryl dyes, and hemioxnol dyes are used. As the cyanine dyes, simple cyanine dyes, carbocyanine dyes, and dicarbocyanine dyes are preferably used.

The spectrally sensitizing dye to be added may be added as crystals or a powder as it is, but preferably the spectrally sensitizing dye is added after it is dissolved or dispersed in some way. To dissolve the spectrally sensitizing dye, it is recommended to use a water-soluble solvent, such as an alcohol having 1 to 3 carbon atoms, acetone, pyridine, or methyl "Cellosolve," or a mixed solvent of these. Also a surface active agent may be used to form a micellar dispersion or other dispersion method may be used to form a dispersion, and the dispersion is added.

The amount of the spectrally sensitizing dye of the present invention to be added may vary depending on the situation and is $1\times10^{-6}$ to $1\times10^{-2}$ mol, preferably $1\times10^{-5}$ to $1\times10^{-3}$ mol, per mol of a silver halide.

In the silver halide emulsion of the present invention, the following compounds may be contained for the purpose of preventing fogging from occurring in the process of producing the photographic material, during the storage until the development processing of the photographic material, or during the development processing, or for the purpose of enhancing the stability of the photographic performance: antifoggants or stabilizers, for example, first, heterocyclic mercapto compounds, such as mercaptothiazoles, mercaptotetrazoles, mercaptobenzimidazoles, mercaptobenzothiazoles, mercaptopyrimidines, and mercaptothiazoles, and, second, corresponding heterocyclic mercapto compounds having a water-soluble group, such as a carboxyl group or a sulfone group.

The photographic material of the present invention has at least one yellow dye forming layer, at least one magenta dye forming layer, and at least one cyan dye forming layer. Each of these dye forming layers contains a so-called color coupler capable of coupling reaction with the oxidized product of an aromatic primary amine developing agent to form a dye. The formation of an image excellent in color reproduction which is an object of the present invention requires the use of the cyan coupler of the present invention in the cyan dye forming layer, which may be used in combination with a phenol-type cyan coupler or a naphthol-type cyan coupler for the purpose, for example, of controlling the hue.

As the yellow coupler and the magenta coupler used in the present invention, the following couplers are preferably used.

In the present invention, as a yellow dye-forming coupler (hereinafter referred to as a yellow coupler) any well-known yellow coupler can be used. Among them, yellow couplers represented by the following formula (Y) are preferable.

formula (Y)

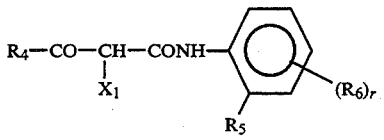

In formula (Y), $R_4$ represents a tertiary alkyl group or an aryl group, $R_5$ represents a hydrogen atom, a halogen atom (e.g., F, Cl, Br, and I, hereinafter the same is applied to in the explanation of formula (Y)), an alkoxy group, an aryloxy group, an alkyl group, or a dialkylamino group, $R_6$ represents a group capable of substitution onto a benzene ring, $X_1$ represents a hydrogen atom or a group capable of being released upon a coupling reaction of coupler represented by formula (Y) with the oxidide product of an aromatic primary amine developing agent (referred to as a coupling-off group), r represents an integer of 0 to 4, provided that when r is 2, 3, or 4, the $R_6$ groups may be the same of different.

Herein, as examples of $R_6$, a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, and an arylsulfonyl group can be mentioned, and as examples of coupling-off group, a heterocyclic group bonding on an active site through a nitrogen atom, an aryloxy group, an arylthio group, an acyloxy group, an alkylsulfonyloxy group, a heterocyclic-oxy group, and a halogen atom can be mentioned. When $R_4$ ida tertiary alkyl group, a cyclic structure, such as cyclopropyl, cyclobutyl, cyclopentyl, and cyclohexyl, may be contained.

In formula (Y), preferably, $R_4$ represents a tert-butyl group, a 1-alkylcyclopropyl group, or a 1-alkylcyclopentyl group, $R_5$ represents a halogen atom, an alkyl group, an alkoxy group, or a phenoxy group, $R_6$ represents a halogen atom, an alkoxy group, an alkoxycarbonyl group, a carbonamido group, a sulfonamido group, a carbamoyl group, or a sulfonamido group, $X_1$ represents an aryloxy group or a 5- to 7-membered ring moiety (further may be contained a heteroatom, such as N, S, O, and P) bonded onto a coupling active site through a nitrogen atom, and r is an integer of 0 to 2.

In formula (Y), when $R_4$ represents a 1-alkylcyclopropyl group or a 1-alkylcyclopentyl group, the alkyl group contained is preferably an alkyl group having 1 to 18 carbon atoms, more preferably a straight-chain alkyl group having 1 to 4 carbon atoms or a benzyl group, and most preferably benzyl group.

The coupler represented by formula (Y) may be a dimer or a higher polymer, homopolymer which bonds at substituent $R_4$, $X_1$ or

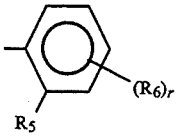

through a divalent or more valent group or a copolymer containing a non-color-forming polymer unit.

Specified examples of coupler represented by formula (Y) are shown below.

(1)

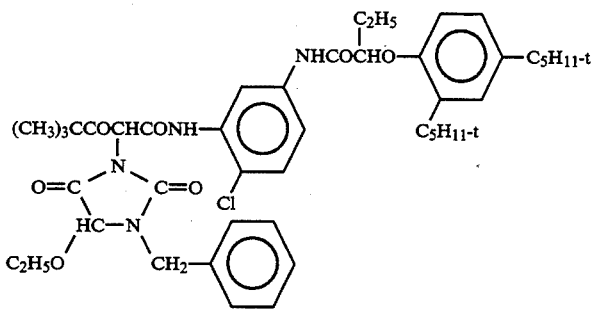

(2)

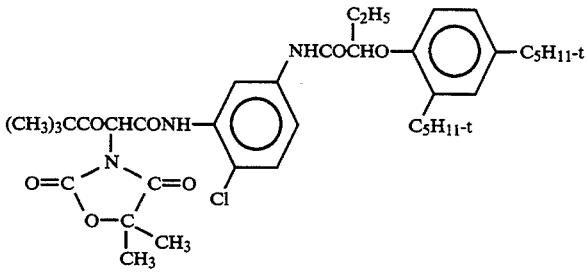

(3)

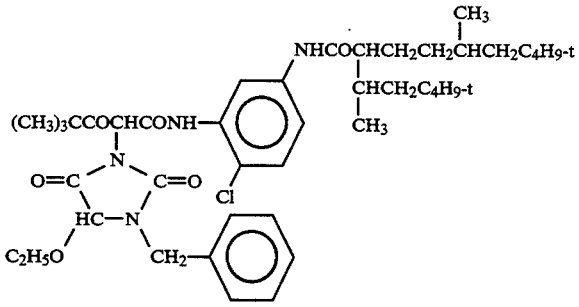

-continued
(4)
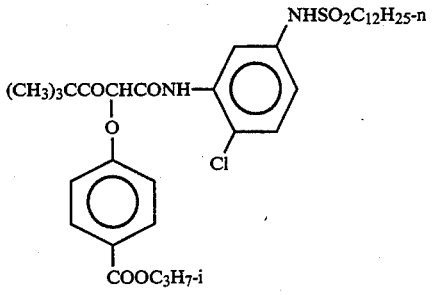
(5)
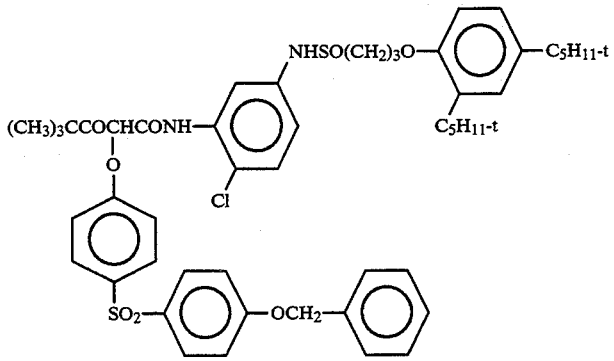
(6)
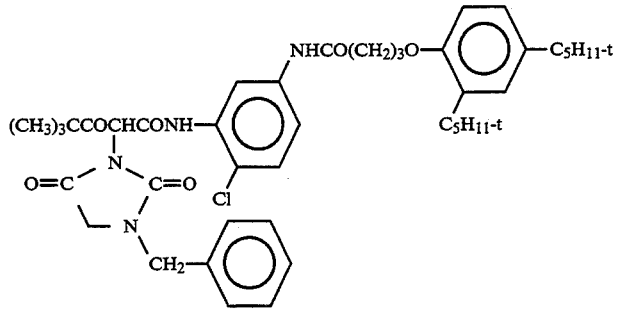
(7)
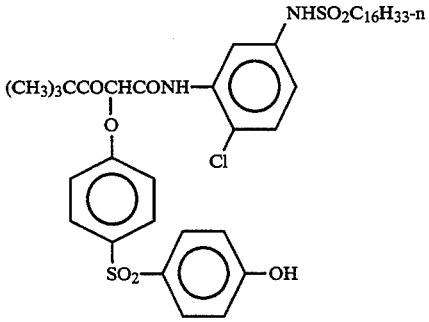
(8)
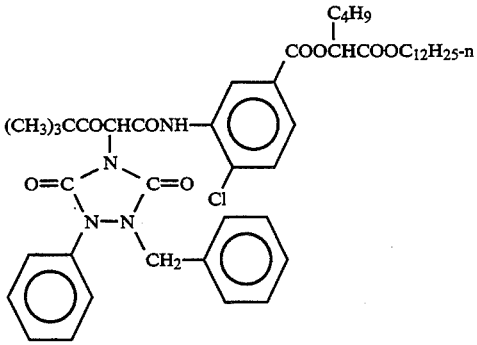

-continued
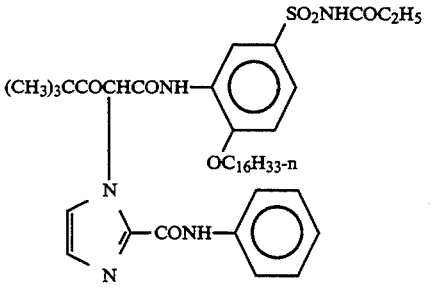
(9)
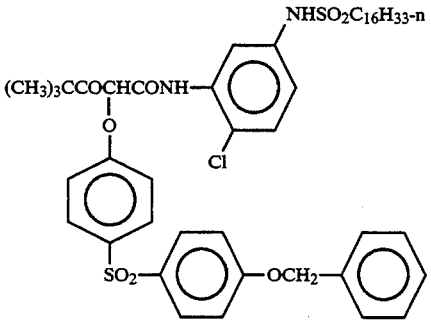
(10)
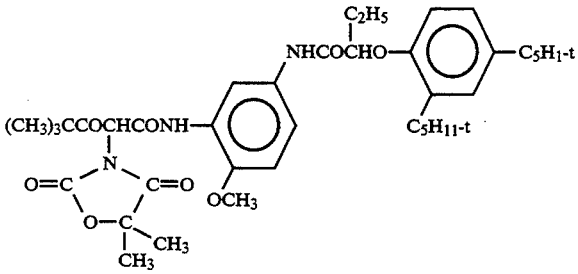
(11)
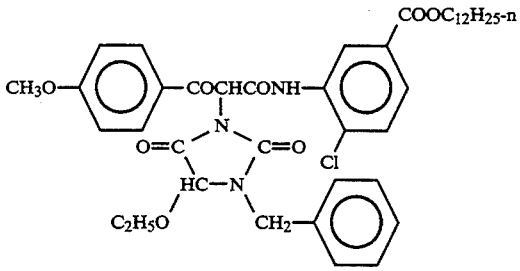
(12)
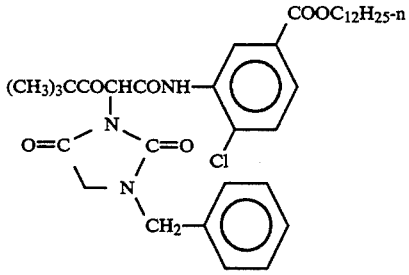
(13)

-continued
(14)
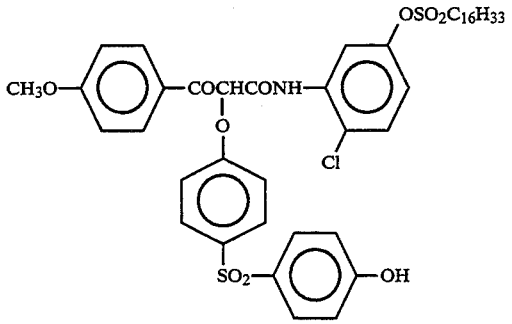
(15)
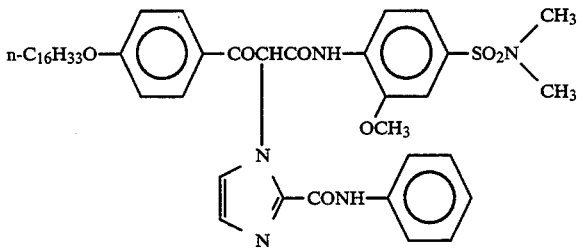
(16)
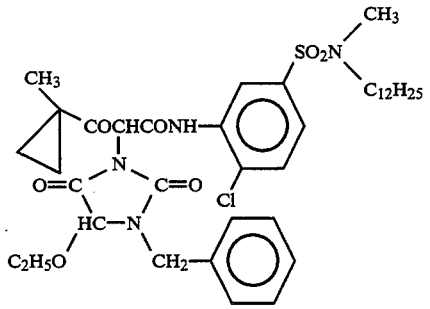
(17)
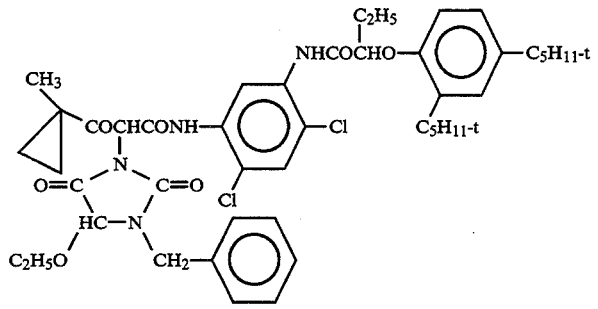
(18)
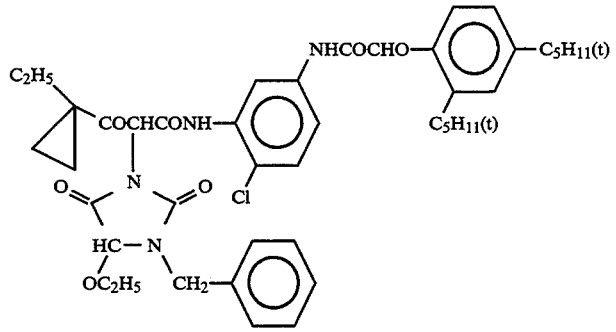

-continued
(19)
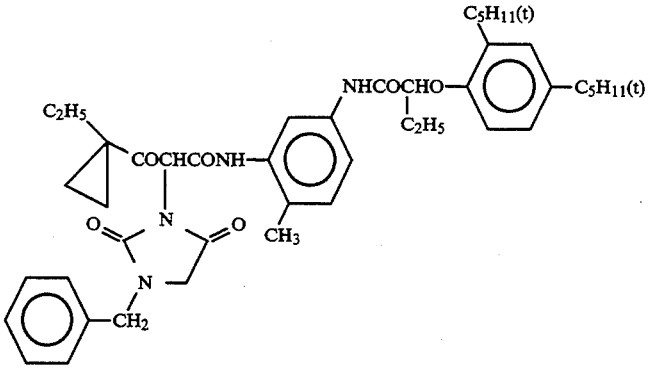
(20)
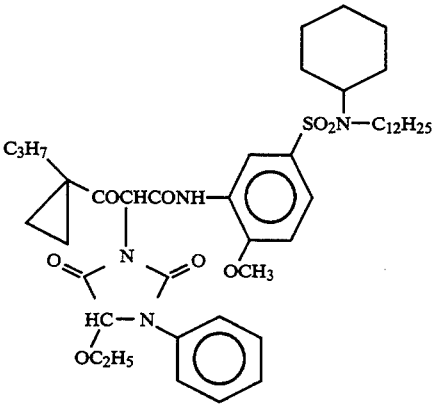
(21)
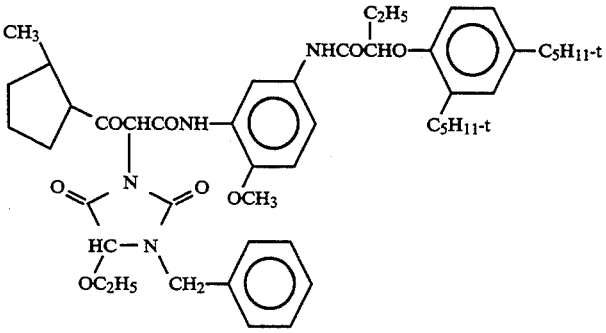
(22)
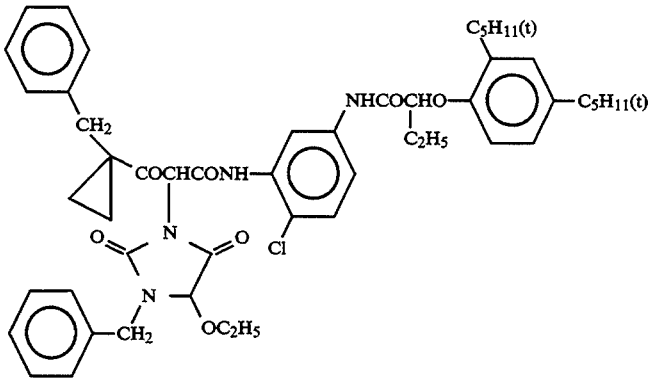

-continued (23)

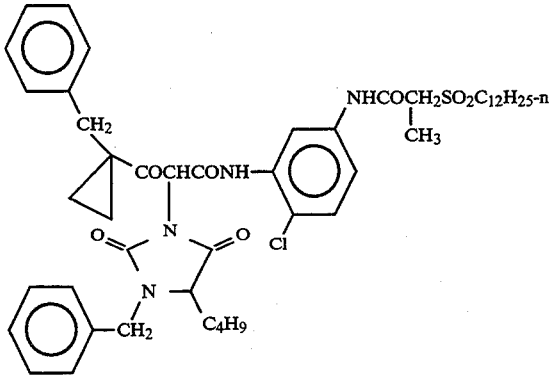

(24)

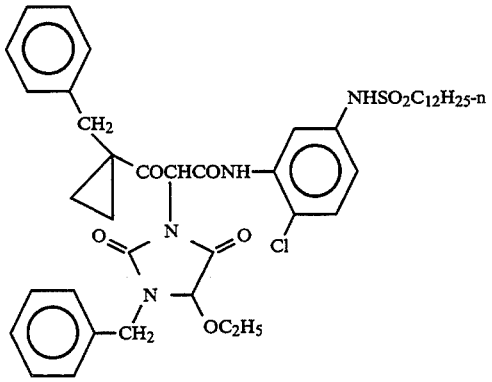

Compounds that can be used as yellow coupler other than the above-described yellow coupler in the present invention and/or methods for synthesizing these yellow couplers are described, for example in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, European Patent Nos. 30,747A, 284,081A, 296,793A, and 313,308A, West Germany Patent No. 3,107,173C, and JP-A Nos. 44/1983, 174839/1984, 276547/1987, and 123047/1988.

As a magenta dye-forming coupler (hereinafter referred to as a magenta coupler) for use in the present invention, any well-known magenta coupler can be used. Among them, magenta coupler represented by the following formula (M-1) or (M-2) is preferable.

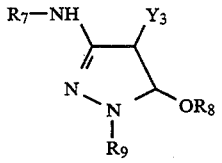

Formula (M-I)

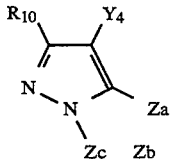

Formula (M-II)

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling releasing-off group. Allowable substituents of the aryl group (preferably phenyl group) represented by $R_7$ and $R_9$ are a halogen atom or a ballasting group, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will release-off at one of a sulfur atom, an oxygen atom, and a nitrogen atom, and particularly preferably of the sulfur atom releasing-off-type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling-off group, and particularly preferably a halogen atom or an aryloxy group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Among the pyrazoloazole type couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

Specified examples of magenta coupler that is preferably used in the present invention are shown below.

(M-1)

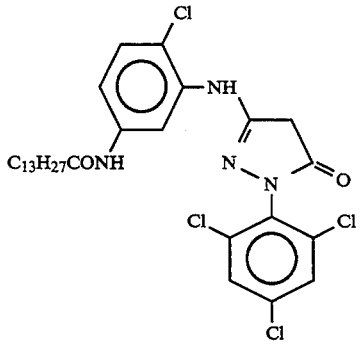

(M-2)

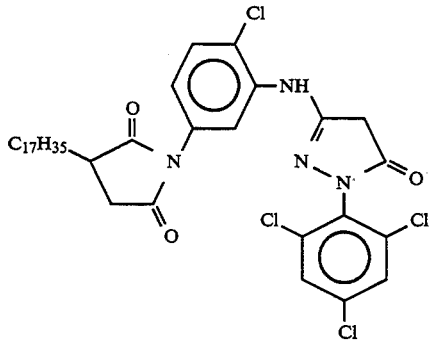

(M-3)

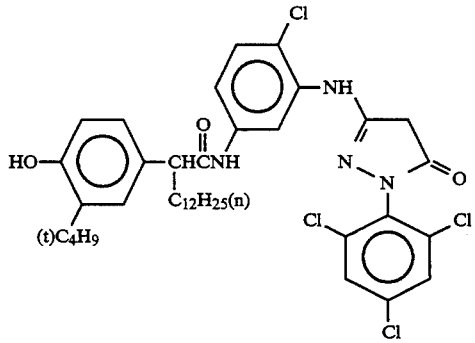

(M-4)

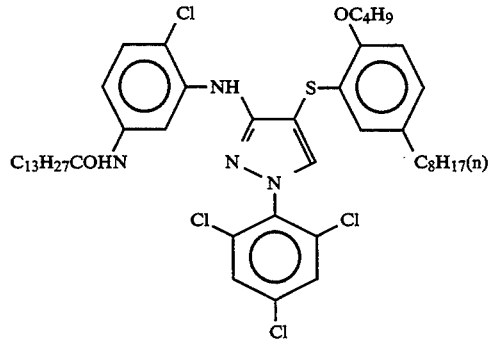

-continued
(M-5)
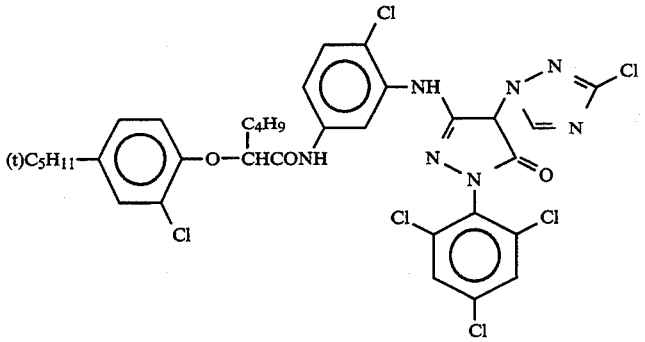
(M-6)
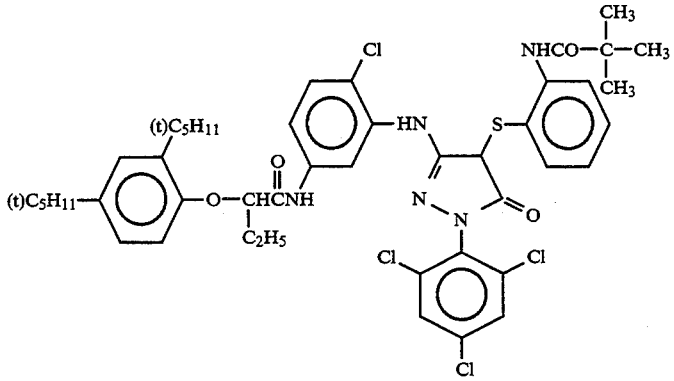
(M-7)
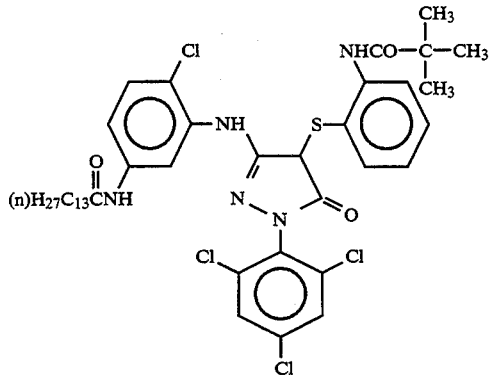
(M-8)
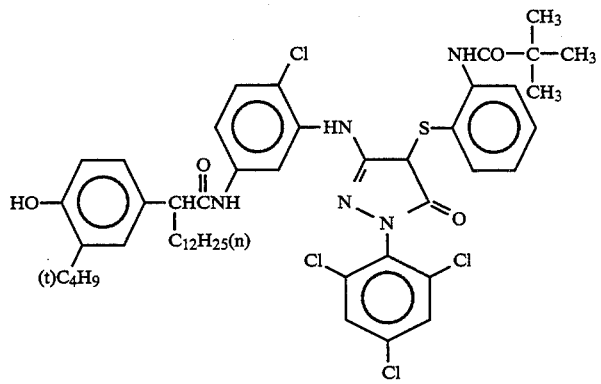

| Compound | $R_{10}$ | $R_{15}$ | $Y_4$ |
|---|---|---|---|
| | | 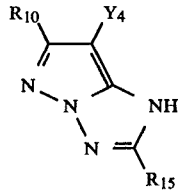 | |
| M-9 | $CH_3$— | 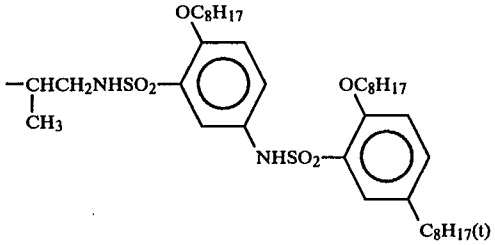 | Cl |
| M-10 | The same as the above | 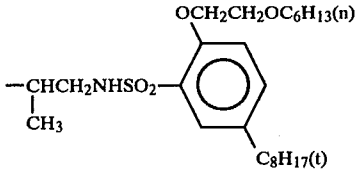 | The same as the above |
| M-11 | $(CH_3)_3C$— | 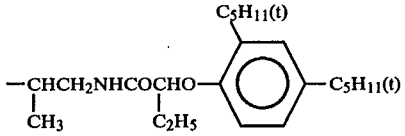 | 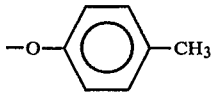 |
| M-12 | 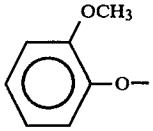 | 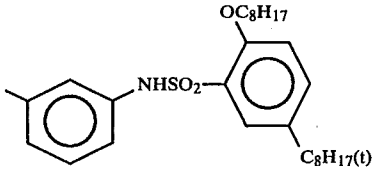 | 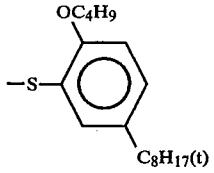 |

-continued
| Compound | $R_{10}$ | $R_{15}$ | $Y_4$ |
|---|---|---|---|
| M-13 | $CH_3$— | 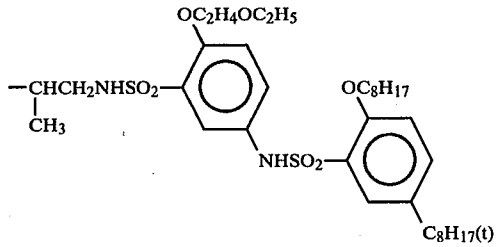 | Cl |
| M-14 | The same as the above | 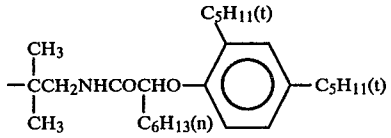 | The same as the above |
| M-15 | The same as the above | 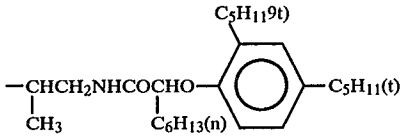 | The same as the above |
| M-16 | $CH_3$— | 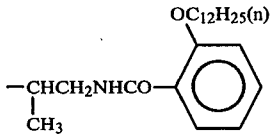 | Cl |
| M-17 | The same as the above | 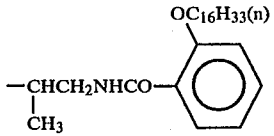 | The same as the above |

-continued
| Compound | $R_{10}$ | $R_{15}$ | $Y_4$ |
|---|---|---|---|
| M-18 | 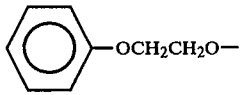 | 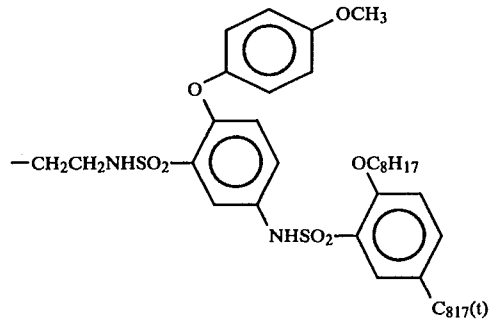 | 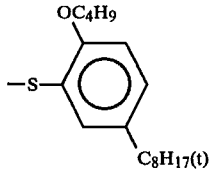 |
| M-19 | $CH_3CH_2O$— | The same as the above | The same as the above |
| M-20 | 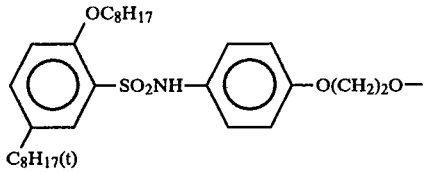 | 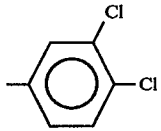 | The same as the above |
| M-21 | 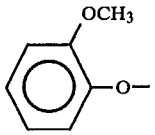 | 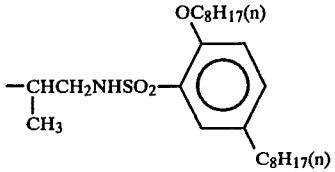 | Cl |
| | 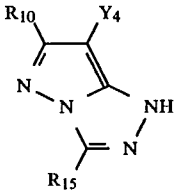 | | |
| M-22 | $CH_3$— | 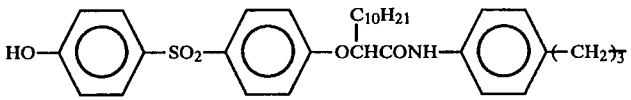 | Cl |

-continued

| Compound | $R_{10}$ | $R_{15}$ | $Y_4$ |
|---|---|---|---|
| M-23 | The same as the above | $(n)C_6H_{13}$ \ $CHCH_2SO_2\text{-}(CH_2)_2\text{-}$ / $(n)C_8H_{17}$ | Cl |
| M-24 | $CH_3$ \ $CH-$ / $CH_3$ | $OC_4H_9$; $-SO_2\text{-}(CH_2)_3\text{-}$; $C_8H_{17}(t)$ | Cl |
| M-25 | $\text{-}(CH-CH_2)_{50}\text{-}(CH_2-C)_{50}\text{-}$; $CH_3$; $CONH-$; $COOCH_2CH_2OCH_3$ | $CH_3-CH-$; $CH_2NHSO_2CH_3$ | Cl |
| M-26 | $-O-$ | $OC_8H_{17}$; $\text{-}(CH_2)_2NHSO_2-$; $C_8H_{17}(t)$ | Cl |
| M-27 | $CH_3-$ | $CH_3$; $CH_3$; $CH_3$; $NHCOCHO-$; $(n)C_{10}H_{21}$; $-SO_2-$; $-OCH_2-$ | Cl |
| M-28 | $(CH_3)_3C$ | $CH_3$; $CH_3$; $CH_3$; $C_5H_{11}(t)$; $NHCOCHO-$; $C_4H_9(n)$; $C_5H_{11}(t)$ | Cl |

-continued
| Compound | $R_{10}$ | $R_{15}$ | $Y_4$ |
|---|---|---|---|
| M-29 | 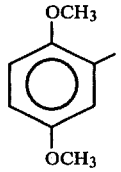 | 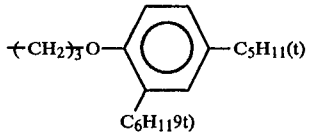 | Cl |
| M-30 | $CH_3$— | $(n)C_8H_{37}$<br>—CH—$NCOCH_2CH_2COOH$<br>$C_2H_5$ | Cl |

M-31
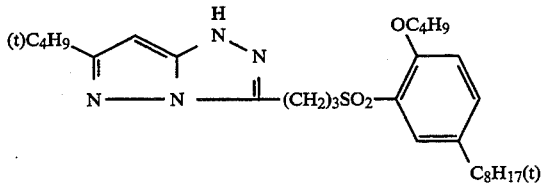
M-32
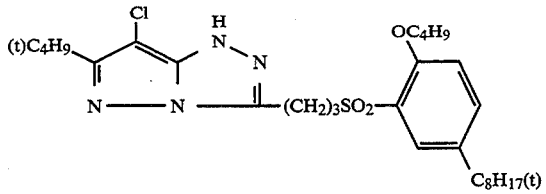
M-33
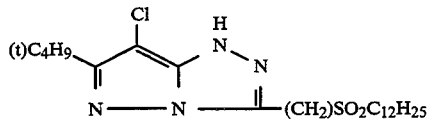
M-34
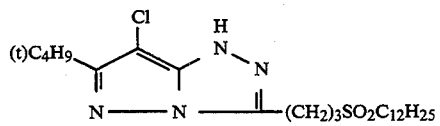
M-35
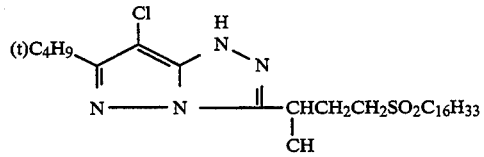
M-36
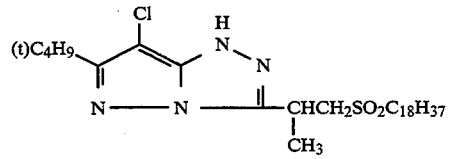
M-37
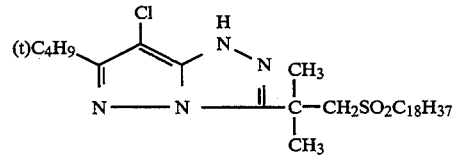
M-38
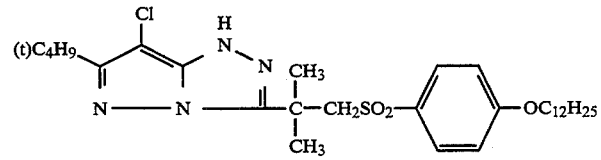
M-39
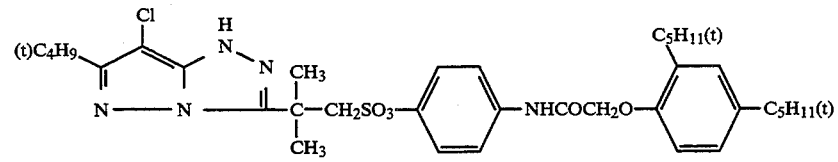

-continued
M-40
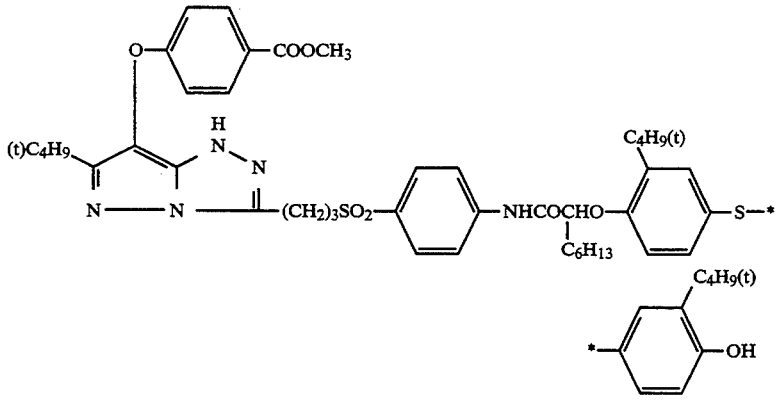
M-41
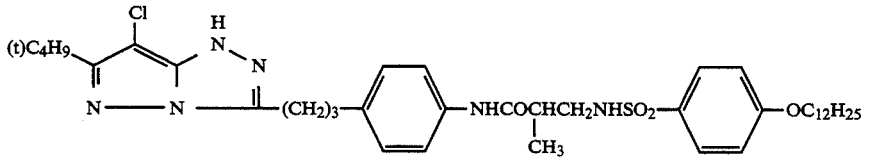
M-42
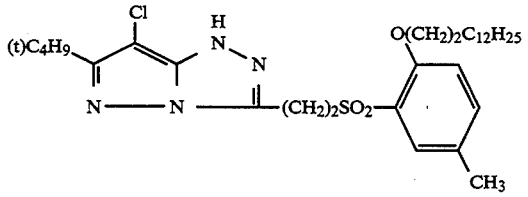
M-43
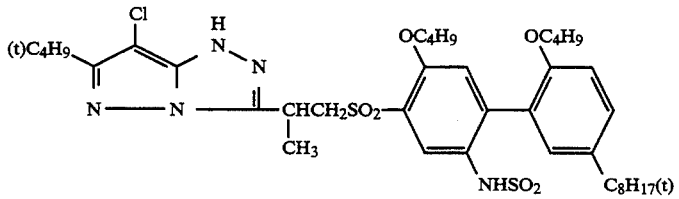
M-44
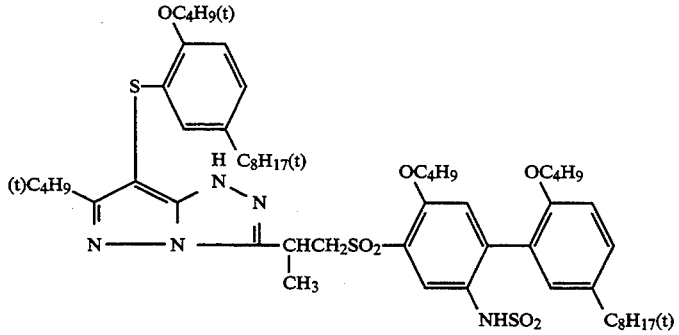
M-45
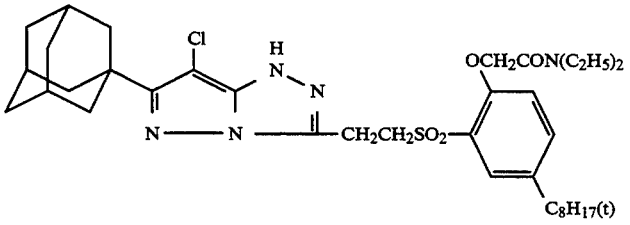

-continued
M-46
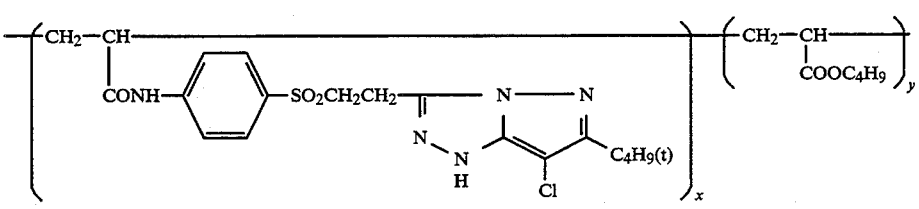
X:Y=50:50
M-47
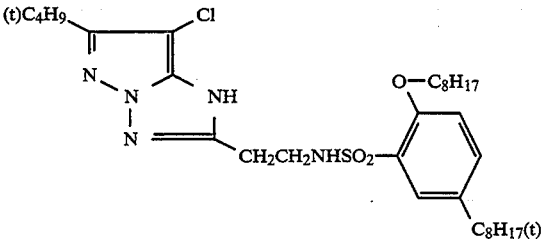
M-48
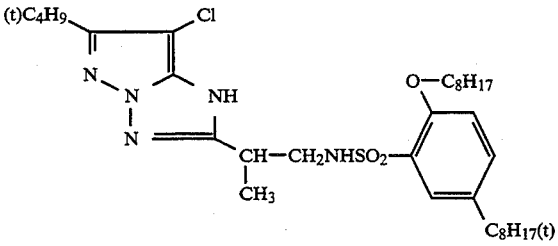
M-49
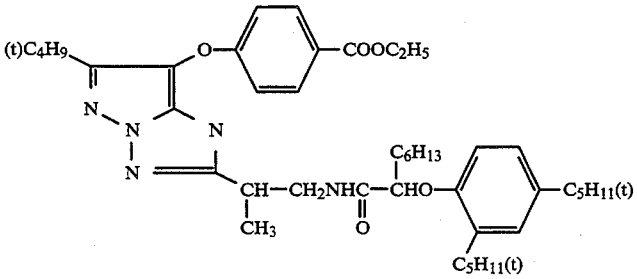
M-50
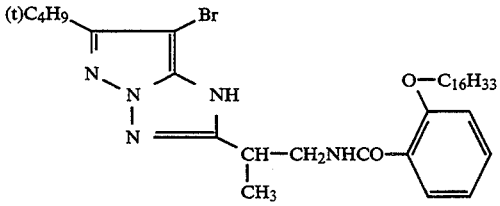
M-51
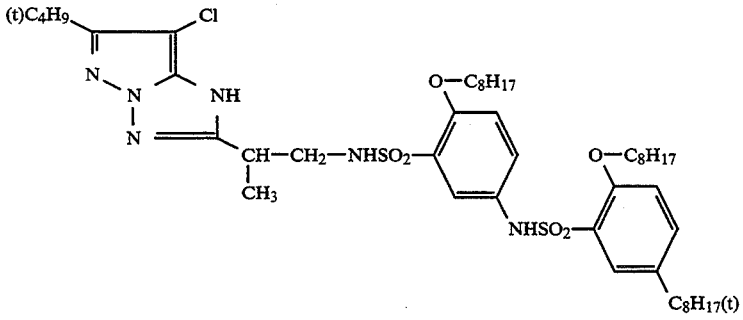

-continued
M-52
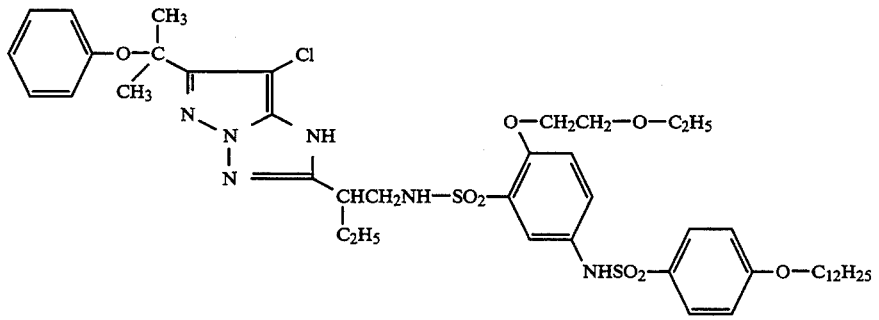
M-53
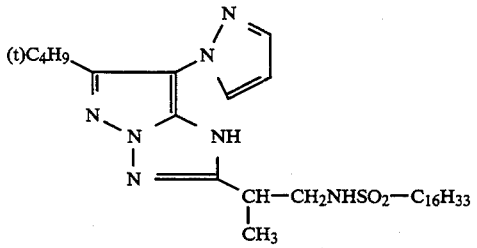
M-54
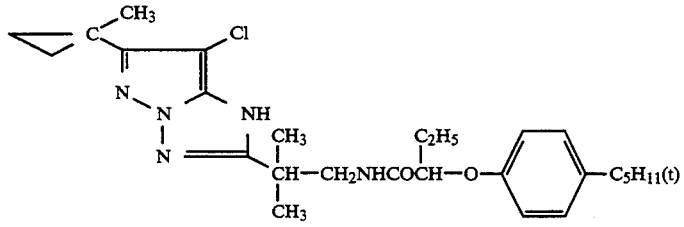
M-55
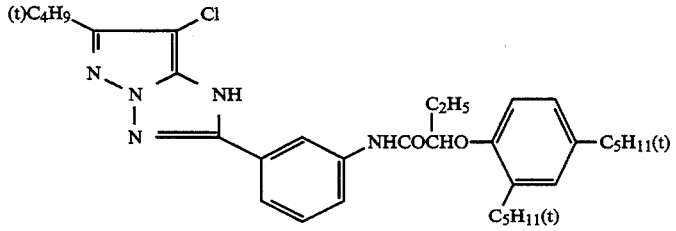
M-56
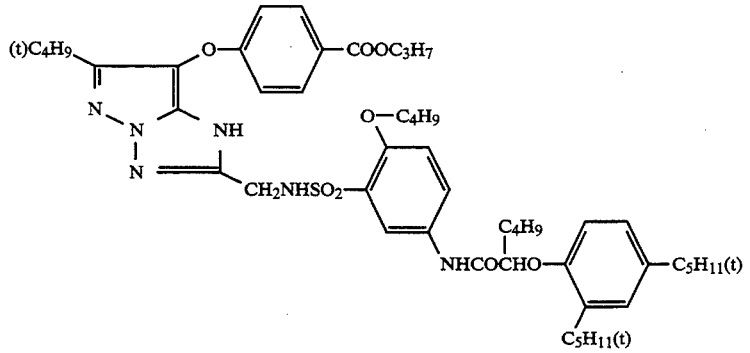
M-57
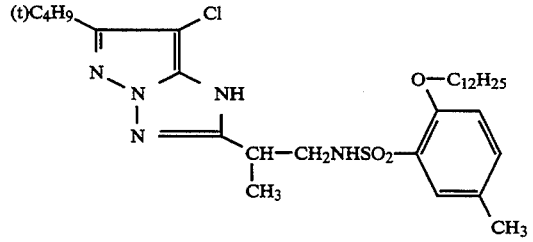

The color photographic material of the present invention may be made by applying on a support at least one blue-sensitive silver halide emulsion layer, at least one green-sensitive silver halide emulsion layer, and at least one red-sensitive silver halide emulsion layer. Generally, in color papers, it is common that the emulsion layers are applied in the above-stated order, although the order may be different therefrom. An infrared-sensitive silver halide emulsion layer can be used instead of at least one of the above emulsion layers. By incorporating, into the photosensitive emulsion layers, silver halide emulsions sensitive to respective wavelength regions, and dyes complementary to the lights to which they are sensitive, that is, so-called color couplers for forming yellow for blue, magenta for green, and cyan for red, color reproduction of the subtractive color process can be effected. However, the photosensitive layers and the color-forming hues of the couplers may be constituted not to have the above correspondence.

Couplers for use in the present invention are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed-from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A), (B), (C), (D), or (E) is preferably used.

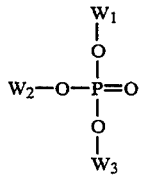
Formula (A)

$W_1-COO-W_2$ Formula (B)

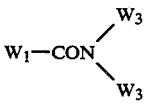
Formula (C)

-continued

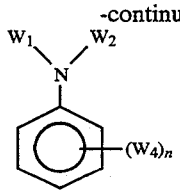
Formula (D)

$W_1-O-W_2$ Formula (E)

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized. When the couplers are emulsified and dispersed, the compounds described in EP0435179A2, pages 21 to 71, can also be used.

The photographic material that is prepared in accordance with the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 5-hydroxycoumarans, spirochromans, p-alkoxyphenols, hindered phenols, including bisphenols, gallic acid derivatives, ethylenedioxybenzenes, aminophenols, hindered amines, and ether or ester derivatives obtained by silylating or alkylating the phenolic hydroxyl group of these compounds can be mentioned typically. Metal complexes such as (bis-salicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

Together with the above couplers, in particular together with the pyrazoloazole coupler or pyrroloazole coupler, the following compounds are preferably used.

That is, it is preferred that a compound (F), which will chemically bond to the aromatic amine developing agent remaining after the color-developing process, to form a chemically inactive and substantially colorless compound, and/or a compound (G), which will chemically bond to the oxidized product of the aromatic amine color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine at the second-order reaction-specific rate $k_2$ (in trioctyl phosphate at 80° C.) in the range of 1.0 to $1\times10^{-5}$ l/mol.sec. The second- order reaction-specific rate can be determined by the method described in JP-A No. 158545/1983. If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{21} - (A_1)n - X \qquad \text{Formula (FI)}$$
$$R_{22} - C(B_1) = Y \qquad \text{Formula (FII)}$$

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{21}$ and X, or Y and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, and European Published Patent Nos. 298321, 277589.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{23} - Z \qquad \text{Formula (GI)}$$

wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application Nos. 136724/1988, 214681/1987, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes or dyes that change to water-soluble dyes by photographic process as filter dyes or to prevent irradiation or haration, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the photographic material of the present invention, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a support for use in the present invention, a transparent film, such as cellulose nitrate film, and polyethylene terephthalate film or a reflection-type support that is generally used in photographic materials can be used. For the objects of the present invention, the use of a reflective support is more preferable.

The "reflective support" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflective support, a support having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin on the metal surface. The opposite side to metal surface side of the support according to the present invention is preferably provided with an antistatic layer. The details of such support are described, for example, in JP-A Nos. 210346/1986, 24247/1988, 24251/1988 and 24255/1988.

These supports may be selected suitably in accordance with the purpose of usage.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio s/Rav, wherein s stands for the standard deviation of Ri, and Rav stands for the average value of Ri. Preferably, the number (n) of the unit areas to be subjected is 6 or over. Therefore, the deviation coefficient s/Rav can be obtained by $$\sqrt{\frac{\sum_{i=i}^{n}(Ri - Rav)^2}{n-1} \Big/ \frac{\sum_{i=i}^{n}(Ri}{n}}$$

In the present invention, preferably the deviation coefficient of the occupied area ratio (%) of the finely divided particles of a pigment is 0.15 or below, and particularly 0.12 or below. If the deviation coefficient is 0.08 or below, it can be considered that the substantial dispersibility of the particles is substantially "uniform."

It is preferable that the color photographic material of the present invention is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/liter or below, and more preferably 0.5 ml/liter or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is resumed that such actions are one of causes for an increase in the fluctuation of the photographic characteristics during continuous process. Herein the term "substantially free from sulfite ions" means that preferably the concentration of sulfite ions is $3.0\times10^{-3}$ mol/liter or below, and most preferably sulfite ions are not contained at all. However, in the present invention, a quite small amount of sulfite ions used for the prevention of oxidation of the processing agent kit in which the developing agent is condensed before use is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/liter or below, and most preferably hydroxylamine is not contained at all.

It is preferable that the developer used in the present invention contains an organic preservative instead of hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary ammonium slats, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 53551/1988, 43140/1988, 56654/1988, 58346/1988, 43138/1988, 146041/1988, 44657/1988, and 44656/1988, U.S. Pat. Nos. 3,615,503 and 2,494,903, JP-A No. 143020/1977, and JP-B No. 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

Examples of the above-mentioned amines include cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/liter, more preferably $4\times10^{-2}$ to $1\times10^{-1}$ mol/liter. If the concentration of chloride ions exceeds $1.5\times10^{-1}$ mol/liter, it is not preferable that the development is made disadvantageously slow, not leading to attainment of the objects of the present invention such as rapid processing and high density of the maximum density. On the other hand, if the concentration of chloride ions is less than $3.5\times10^{-2}$ mol/liter, fogging is not prevented.

In the present invention, the color developer contains bromide ions preferably in an amount of $3.0\times10^{-5}$ to $1.0\times10^{-3}$ mol/liter. More preferably bromide ions are contained in an amount $5.0\times10^{-5}$ to $5.0\times10^{-4}$ mol/liter, most preferably $1.0\times10^{-4}$ to $3.0\times10^{-4}$ mol/liter. If the concentration of bromide ions is more than $1.0\times10^{-3}$mol/liter, the development is made slow, the maximum density and the sensitivity are made low, and if the concentration of bromide ions is less than $3.0\times10^{-5}$ mol/liter, fogging is not prevented sufficiently.

Herein, chloride ions and bromide ions may be added directly to the developer, or they may be allowed to dissolve out from the photographic material in the developer during developing process.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent added to the developer.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer during developing process, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/liter or more, and particularly preferably 0.1 to 0.4 mol/liter or more.

In addition to the color developer can be added various chelating agents to prevent calcium or magnesium from precipitating or to improve the stability of the color developer. As the example of chelating agents can be mentioned nitrilotriacetic acid, diethylenedi-triaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1963, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/liter, and preferably 0.1 to 4 g/liter.

If necessary, various surface-active agents may be added, such as alkyl sulfonates, aryl sulfonates, aliphatic carboxylic acids, and aromatic carboxylic acids.

The processing temperature of the color developer of the present invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in the present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/liter, and more preferably 0.05 to 0.50 mol/liter.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July, 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali metal salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the fixing solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol, which is a known fixing agent. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution preferably contains the compounds releasing sulfite ion, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/liter, and more preferably 0.04 to 0.40 mol/liter, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers,* Vol. 64, pp. 248 to 253 (May, 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 liter per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 26761/1986, copper ions, and bactericides described by Hiroshi Horiguchi in *Bokin Bobai-zai no Kagaku,* (1986) published by Sankyo Shuppan, *Biseibutsu no Mekkin, Sakkin, Bobai Gijutsu* (edited by Eiseigijutsu-kyokai) (1982 published by Kogyo Gijutsu-kai), and *Bokin Bobai-zai Jiten* (edited by Nihon Bokin Bobai-gakkai) (1986), can be used.

Further, the washing water can contain surface-active agents as a water draining agent, and chelating agents such as EDTA as a water softener.

After the washing step mentioned above, or without the washing step, the photographic material is processed with a stabilizer directly. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Further, a surface-active agent, a brightening agent, and a hardening agent can be added. In processing the photographic material of the present invention, if stabilization is directly carried out without a washing step, any known process described, for example, in JP-A Nos. 8543/1982, 14834/1983, and 220345/1985 can be used.

In addition, use of a chelating agent, such as 1-hydroxyethylidene-1,1-diphosphoric acid and ethylenediaminetetramethylenephosphoric acid, a magnesium compound, and a bismuth compound is a preferable mode.

As a washing liquid or a stabilizing liquid used after the desilvering process, a so-called rinse liquid is also used similarly.

A preferable pH of the washing step or the stabilizing step is 4 to 10, more preferably 5 to 8. The temperature may be set variously depending, for example, on the application and properties of the photographic material and is generally 15° to 45° C., preferably 20° to 40° C. Although the time may be set arbitrarily, the shorter the time is, the more desirable it is because the processing time can be shortened. Preferably the time is 15 sec to 1 min and 45 sec, more preferably 30 sec to 1 min and 30 sec.

By carrying out the present invention, the pressure marks that will occur when a pyrrolotriazole cyan coupler, whose absorption profile of the color hue is sharp, and of which is small in undesirable absorption in the blue light section, is combined with a high-silver chloride emulsion excellent in rapid development can effectively be suppressed.

If low-replenishing-type continuous processing, wherein the discharge of the waste liquid is less, is carried out, the fluctuation of the performance is small, and, through the present invention, a color print excellent in color reproduction can be supplied rapidly and stably without a problem being caused by pressure applied to the photographic material.

Now, the present invention will be described with reference to the following Examples, but the present invention is not restricted to these Examples.

EXAMPLE 1

Silver halide emulsions were prepared as follows.

6.4 Grams of sodium chloride was added to an aqueous 3% solution of lime-processed gelatin and then 3.2 ml of N,N'-dimethylimidazolidine-2-thion (a 1% aqueous solution) was added. The pH of this solution was adjusted to 3.5 and then an aqueous solution containing 0.2 mol of silver nitrate and an aqueous solution containing 0.12 mol of sodium chloride and 0.8 mol of potassium bromide were added to and mixed with the solution at 52° C. with violent stirring. Then, an aqueous solution containing 0.8 mol of silver nitrate and an aqueous solution containing 0.48 mol of sodium chloride and 0.32 mol of potassium bromide were added to and mixed with the resulting solution at 52° C. with violent stirring. After the resulting mixture was kept at 52° C. for 5 min, the desalting and washing were carried out, and then 90.0 g of lime-processed gelatin was added thereto. The pH of the obtained emulsion was adjusted to 6.5, then 25 mg of Spectrally Sensitizing Dye R-1 was added at 54° C., and sodium thiosulfate and chloroauric acid were added, so that the spectral sensitization, the sulfur sensitization, and the gold sensitization were carried out. After the completion of the chemical sensitization, for the purpose of stabilizing and preventing fogging from occurring, 150 mg of 1-(3-methylureidophenyl)-5-mercaptotetrazole was added. Further, 2.6 g of Compound R-2 was added.

Spectral sensitizing dye R-1

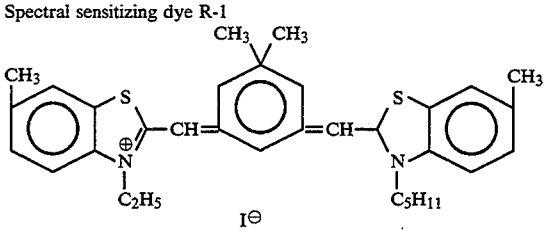

Compound R-2

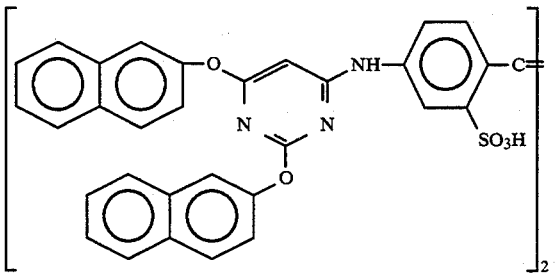

The thus obtained silver chlorobromide emulsion (having an average grain size of 0.53 μm, consisting of cubic grains wherein the deviation coefficient of the grain size distribution was 8%, and containing 40 mol % of silver bromide) was named Emulsion 101.

Next, in the same manner as Emulsion 101, except that the ratio of the sodium chloride to the potassium bromide contained in the alkali halide solution to be reacted was changed, a silver chlorobromide emulsion having an average grain size of 0.52 μm, consisting of cubic grains wherein the deviation coefficient of the grain size distribution was 7%, and containing 20 mol % of silver bromide was prepared, and was named Emulsion 102.

Next, in the same manner as Emulsion 101, except that the ratio of the sodium chloride to the potassium bromide contained in the alkali halide solution to be reacted was changed, a silver chlorobromide emulsion having an average grain size of 0.53 μm, consisting of cubic grains wherein the deviation coefficient of the grain size distribution was 7%, and containing 2 mol % of silver bromide was prepared, and was named Emulsion 103.

Next, in the same manner as Emulsion 101, except that, as the alkali halide solution to be reacted, a solution containing only sodium chloride was used, a silver chloride emulsion having an average grain size of 0.54 μm and consisting of cubic grains wherein the deviation coefficient of the grain size distribution was 7% was prepared, and was named Emulsion 104.

In the preparation of Emulsions 102 to 104, the amounts of the sulfur sensitizer and the gold sensitizer were controlled so that the chemical sensitization might be optimum.

Next, 25.0 g of Cyan Coupler (a), 31.25 g of Image-dye Stabilizer (b), 14.06 g of Image-dye Stabilizer (c), and 3.91 g of Image-dye Stabilizer (d) were dissolved in 100 ml of ethyl acetate and 16.0 g of Solvent (e) and the solution was emulsified and dispersed in 500 ml of a 10% aqueous gelatin solution containing 40 ml of a 10% sodium dodecyl benzene sulfonate solution. The thus obtained emulsified dispersion was named Coupler dispersion I.

Emulsified dispersion II was prepared in the same manner as Coupler Dispersion I, except that the cyan coupler to be used was changed to C-58 (18.6 g).

These emulsion and emulsified dispersion were dissolved and mixed at 40° C. and gelatin was added thereto to prepare coating solutions so that the compositions might be as shown in Table 1, and each coating liquid was applied together with a protective layer on a paper support, both sides of which are laminated with polyethylene, thereby preparing Photographic Materials 101 to 108.

Photographic materials 109 to 116 were prepared in the same manner as photographic Materials 101 to 108, except that when the coating solution was prepared, a 1% aqueous potassium bromide solution was added in an amount of 0.5 mol % in terms of potassium bromide per mol of the silver halide (Table 2).

TABLE 1

| Photographic material | 101 | 102 | 103 | 104 | 105 | 106 | 107 | 108 |
|---|---|---|---|---|---|---|---|---|
| Seccond layer (protective layer) | | | | | | | | |
| Gelatin (g/m$^2$) | | | | | 1.20 | | | |
| Acryl-modified polyvinyl alcohol polymer (modification degree: 17%) (g/m$^2$) | | | | | 0.17 | | | |
| Liquid paraffin (g/m$^2$) | | | | | 0.03 | | | |
| First layer (Red-sensitive emulsion layer) | | | | | | | | |
| Silver halide emulsion | 101 | 102 | 103 | 104 | 101 | 102 | 103 | 104 |
| (g/m$^2$) | 0.23 | 0.23 | 0.23 | 0.23 | 0.16 | 0.16 | 0.16 | 0.16 |
| Gelatin (g/m$^2$) | 1.34 | 1.34 | 1.34 | 1.34 | 1.34 | 1.34 | 1.34 | 1.34 |
| Cyan coupler | (a) | (a) | (a) | (a) | C-58 | C-58 | C-58 | C-58 |
| (g/m$^2$) | 0.32 | 0.32 | 0.32 | 0.32 | 0.24 | 0.24 | 0.24 | 0.24 |
| Image-dye stabilizer | | | | | | | | |
| (b) (g/m$^2$) | 0.40 | 0.40 | 0.40 | 0.40 | 0.40 | 0.40 | 0.40 | 0.40 |
| (c) (g/m$^2$) | 0.18 | 0.18 | 0.18 | 0.18 | 0.18 | 0.18 | 0.18 | 0.18 |
| (d) (g/m$^2$) | 0.05 | 0.05 | 0.05 | 0.05 | 0.05 | 0.05 | 0.05 | 0.05 |
| Solvent (e) (g/m$^2$) | 0.20 | 0.20 | 0.20 | 0.20 | 0.20 | 0.20 | 0.20 | 0.20 |
| Support | | | | | | | | |
| Both side polyethylene film laminated paper ($TiO_2$ and ultramarine are contained in polyethylene film of emulsion layer side) | | | | | | | | |

TABLE 2

| Photographic material | 109 | 110 | 111 | 112 | 113 | 114 | 115 | 116 |
|---|---|---|---|---|---|---|---|---|
| Seccond layer (protective layer) | | | | | | | | |
| Gelatin (g/m$^2$) | | | | | 1.20 | | | |
| Acryl-modified polyvinyl alcohol polymer (modification degree: 17%) (g/m$^2$) | | | | | 0.17 | | | |
| Liquid paraffin (g/m$^2$) | | | | | 0.03 | | | |
| First layer (Red-sensitive emulsion layer) | | | | | | | | |
| Silver halide emulsion | 101 | 102 | 103 | 104 | 101 | 102 | 103 | 104 |
| (g/m$^2$) | 0.23 | 0.23 | 0.23 | 0.23 | 0.16 | 0.16 | 0.16 | 0.16 |
| Gelatin (g/m$^2$) | 1.34 | 1.34 | 1.34 | 1.34 | 1.34 | 1.34 | 1.34 | 1.34 |
| Cyan coupler | (a) | (a) | (a) | (a) | C-58 | C-58 | C-58 | C-58 |
| (g/m$^2$) | 0.32 | 0.32 | 0.32 | 0.32 | 0.24 | 0.24 | 0.24 | 0.24 |
| Image-dye stabilizer | | | | | | | | |
| (b) (g/m$^2$) | 0.40 | 0.40 | 0.40 | 0.40 | 0.40 | 0.40 | 0.40 | 0.40 |
| (c) (g/m$^2$) | 0.18 | 0.18 | 0.18 | 0.18 | 0.18 | 0.18 | 0.18 | 0.18 |
| (d) (g/m$^2$) | 0.05 | 0.05 | 0.05 | 0.05 | 0.05 | 0.05 | 0.05 | 0.05 |
| Solvent (e) (g/m$^2$) | 0.20 | 0.20 | 0.20 | 0.20 | 0.20 | 0.20 | 0.20 | 0.20 |
| Support | | | | | | | | ive Example |
| Both side polyethylene film laminated paper ($TiO_2$ and ultramarine are contained in polyethylene film of emulsion layer side) | | | | | | | | |

Note;
*In photographic materials 109 to 116, silver bromide was added in an amount of 0.005 mol per mol of silver halide at the preparation of first layer oating solution.

As the hardening agent for each photographic material, 1-oxy-3,5-dichloro-s-triazine sodium salt was used.

The thus obtained photographic materials were exposed to light of 250 CMS for 1 sec for sensitometry using a sensitometer (FWH model manufactured by Fuji Photo Film Co. Ltd.; the color temperature of the light source: 3200 K) through a red filter and an optical wedge and were subjected to color development processing in the following processing steps using the following processing solutions and the reflection densities of the processed samples were measured to obtain so-called characteristic curves. At that time, the development time was varied to be 20 sec and 45 sec to investigate the developing speed.

From the characteristic curves, the exposure amount that gave a density 0.5 higher than the fog density was found and the reciprocal thereof was designated as the sensitivity, which was expressed as a relative value by assuming the value of the 45-sec development of Photographic Material 101 to be 100.

Also, the resistance to damage by pressure was tested in such a way that an easel mask of an automatic printer with a load of 100 g was pressed to the emulsion layer-coated surface of each of the photographic materials that had not been exposed and was moved at a rate of 60 cm/sec to abrade the sample, and thereafter the photographic material was subjected to color development processing to investigate occurrence of pressure marks in the form of abrasions.

Results are shown in Table 3.

Cyan coupler (a)

Mixture (1:1 in molar ratio) of

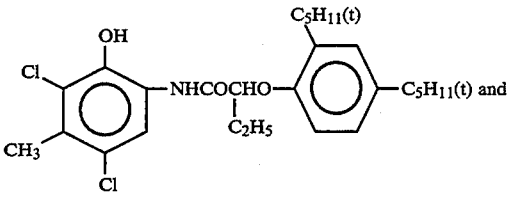

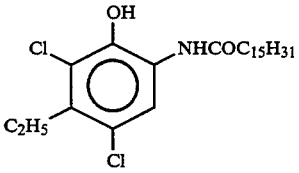

Image-dye stabilizer (b)

$$\left(CH_2-\underset{\underset{CONHC_4H_9(t)}{|}}{CH}\right)_n$$

av. molecular weight: 60,000

Image-dye stabilizer (c)

Mixture (2:4:4 in weight ratio) of

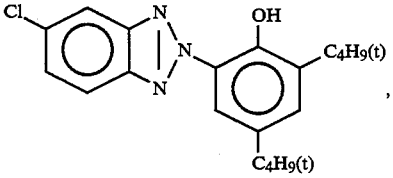

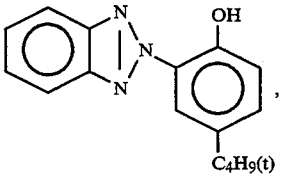

and

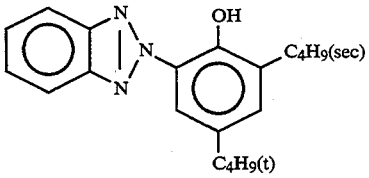

Image-dye stabilizer (d)

Mixture (1:1 in weight ratio) of

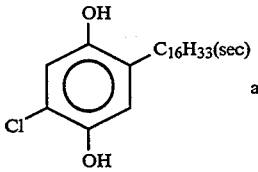

and

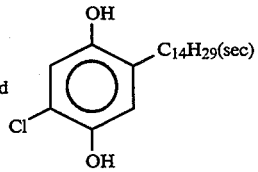

Solvent (e)

Mixture (80:20 in volume ratio) of

-continued

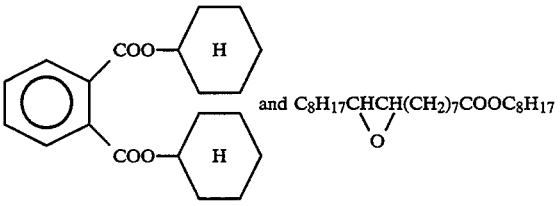

| Processing process | Temperature | Processing time |
|---|---|---|
| Color developing | 35° C. | 20 sec or 45 sec |
| Bleach-fixing | 30–35° C. | 45 sec |
| Rinse 1 | 30–35° C. | 20 sec |
| Rinse 2 | 30–35° C. | 20 sec |
| Rinse 3 | 30–35° C. | 20 sec |
| Drying | 70–80° C. | 60 sec |

Processing process Temperature Processing time

| | |
|---|---|
| Color-developer | |
| Water | 800 ml |
| Ethylenediamine-N,N,N',N'-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfate | 5.0 g |
| N,N-Bis(carboxymethyl)hydrazine | 4.0 g |
| N,N-di(sulfoethyl)hydroxylamine.1Na | 4.0 g |
| Fluorescent whitening agent (WHITEX-4B, made by Sumitomo Chemical Ind.) | 2.0 g |
| Water to make | 1000 ml |
| pH | 10.20 |
| Bleach-fixing solution | |
| Water | 400 ml |
| Ammonium thiosulfate (700 g/liter) | 100 ml |
| Sodium sulfite | 17 g |
| Iron (III) ammonium ethylenediamine-tetraacetate | 55 g |
| Disodium ethylenediaminetetraacetate | 5 g |
| Ammonium bromide | 10 g |
| Water to make | 1000 ml |
| pH | 6.0 |
| Rinse solution | |
| Ion-exchanged water (each content of calcium and magnesium is 3 ppm or less) | |

TABLE 3

| Photo-graphic material | Relative density 20 sec-developing | Relative density 45 sec-developing | Occurrence of pressure marks | Remarks |
|---|---|---|---|---|
| 101 | 26 | 100 | ∘ | Comparison |
| 102 | 37 | 92 | ∘ | Comparison |
| 103 | 44 | 88 | Δ | Comparison |
| 104 | 36 | 57 | Δ | Comparison |
| 105 | 32 | 115 | Δ | Comparison |
| 106 | 47 | 104 | Δ | Comparison |
| 107 | 58 | 103 | x | Comparison |
| 108 | 43 | 65 | xx | Comparison |
| 109 | 31 | 128 | ∘ | Comparison |
| 110 | 30 | 133 | ∘ | Comparison |
| 111 | 68 | 142 | Δ–∘ | Comparison |
| 112 | 88 | 141 | Δ–∘ | Comparison |
| 113 | 35 | 143 | ∘ | Comparison |
| 114 | 58 | 153 | ∘ | Comparison |
| 115 | 79 | 164 | Δ–∘ | This Invention |

TABLE 3-continued

| Photo-graphic material | Relative density 20 sec-developing | Relative density 45 sec-developing | Occurrence of pressure marks | Remarks |
|---|---|---|---|---|
| 116 | 98 | 161 | Δ-∘ | This Invention |

Note;
Occurrence of pressure marks
∘: Pressure marks in stripe-like is not observed.
Δ: Pressure marks in stripe-like are observed in a part of sample.
x: Pressure marks in stripe-like are observed on almost whole surface of sample.
xx: Pressure marks in stripe-like are remarkably observed on whole surface of sample.

The color-formed density of the samples after the color development was low for the photographic materials that used emulsions having silver bromide contents of 40% and 80% (101, 102, 105, 106, 109, 110, 113, and 114), which effect was more conspicuous when the development processing time was short, and it was found that they were unsuitable for rapid development processing. With respect to the cyan color-formed hue, the photographic materials that used the Cyan Coupler of the present invention C-58 (Photographic Materials 105 to 108 and 113 to 116) were good because undesirable absorption in the blue region was less. However, when this coupler was combined with an emulsion high in silver chloride content that was high in development speed (e.g., Emulsions 103 and 104), the occurrence of pressure marks was remarkable, which is a problem practically.

Finally, as is apparent from the results of Photographic Materials 115 and 116, by applying the present invention, wherein a water-soluble bromide is added to a coating liquid, a high sensitivity can be obtained in rapid processing and the occurrence of pressure marks when a cyan coupler of the present invention is combined with a high-silver-chloride emulsion can be effectively prevented.

EXAMPLE 2

Emulsions 201 and 202 were prepared in the same manners as Emulsions 103 and 104 in Example 1, except that $2\times10^{-8}$ mol and $8\times10^{-8}$ mol of potassium hexachloroiridate (IV) were added to the first and second aqueous alkali halide solutions, respectively, and the amounts of the added sulfur sensitizer and the added gold sensitizer were adjusted so that the chemical sensitization might be optimized.

Emulsions 203 and 204 were prepared in the same manners as Emulsions 103 and 104 in Example 1, except that the second aqueous silver nitrate solution and the second aqueous alkali halide solution were divided into two parts, respectively, so that the reaction solutions might be added separately in six portions in all; $1\times10^{-7}$ mol of potassium hexachloroiridate(IV) was added to the third aqueous alkali halide solution to be added to the emulsion; and the amounts of the added sulfur sensitizer and the added gold sensitizer were adjusted so that the chemical sensitization might be optimized.

Using the thus obtained emulsions, photographic materials were prepared in the same manner as in Example 1, and similarly to Example 1, the performance test was carried out. However, the development processing time was only 45 sec.

The results are summarized in Table 4. The sensitivity is a relative value by assuming the value of Photographic Material 201 to be 100.

TABLE 4

| Photo-graphic material | Emulsion | Emulsified dispersion | Water-soluble bromide | Relative sensitivity 45 sec-developinig | Occurrence of pressure marks | Remarks |
|---|---|---|---|---|---|---|
| 201 | 201 | I | not added | 100 | Δ | Comparison |
| 202 | 202 | I | not added | 72 | Δ | Comparison |
| 203 | 203 | I | not added | 113 | Δ | Comparison |
| 204 | 204 | I | not added | 81 | Δ | Comparison |
| 205 | 201 | II | not added | 117 | x | Comparison |
| 206 | 202 | II | not added | 86 | xx | Comparison |
| 207 | 203 | II | not added | 129 | x | Comparison |
| 208 | 204 | II | not added | 95 | xx | Comparison |
| 209 | 201 | I | added | 163 | Δ~∘ | Comparison |
| 210 | 202 | I | added | 168 | Δ~∘ | Comparison |
| 211 | 203 | I | added | 171 | ∘ | Comparison |
| 212 | 204 | I | added | 174 | ∘ | Comparison |
| 213 | 201 | II | added | 185 | Δ~∘ | This Invention |
| 214 | 202 | II | added | 192 | Δ~∘ | This Invention |
| 215 | 203 | II | added | 197 | ∘ | This Invention |
| 216 | 204 | II | added | 199 | ∘ | This Invention |

From the measurement of the color-formed density of the photographic materials prepared by using the emulsions in this Example, it was observed that the addition of the iridium compound at the time of preparation of the emulsions increases contrast remarkably.

As is apparent from the results in Table 4, when the iridium compound is incorporated particularly near the surface of the grains, the occurrence of pressure marks can be suppressed to a lower level.

That is, as is apparent from comparing of the results of Sample 213 and 214 with the results of Sample 215 and 216, it can be understood that, in the cases of Samples 215 and 216, which used Emulsions 203 and 204, which were prepared such that the iridium compound was added after 60% of the volume of the grains was formed, pressure marks can be more effectively suppressed.

It is also understood that, as seen in Samples 215 and 216, higher sensitivities can be obtained.

EXAMPLE 3

Silver chlorobromide emulsions (silver bromide: 0.5 mol %) of various grain sizes were prepared in the same procedure for the preparation of Emulsion 203 in Example 2, except that the ratio of the sodium chloride in the added aqueous alkali halide solution to the potassium bromide was changed; the temperature at the time of the formation of the grains and the feeding speeds of the reaction liquids were changed; the position of the addition of the iridium compound added at the time of the formation of the grains was the same as that of Emulsion 203: and the amount of the iridium compound was varied inversely proportionally to the grain volume of the silver halide grains. Then multi-layer color photographic materials were formed based on the following method.

With respect to the spectral sensitization of the raw emulsions, for the red-sensitive emulsion, Spectrally Sensitizing Dye R-1 used in Example 1 was added in an amount of $4\times10^{-5}$ mol per mol of the silver halide, for the large-size emulsions, and in an amount of $4.9\times10^{-5}$ mol per mol of the silver halide, for the small-size emulsions. In the preparation of emulsions to be used in the green-sensitive emulsion layer and the blue-sensitive emulsion layer, Spectrally Sensitizing Dye R-1 and Compound R-2 used in Example 1 were not added, but instead Spectrally Sensitizing Dyes G-1, G-2, B-1, and B-2 shown below were added in the amounts shown below, at the time of chemical sensitization of the emulsions.

Using these silver halide emulsions, multi-layer color photographic printing paper were produced by the following method.

After the surface of a paper support, both surfaces of which were laminated with polyethylene, was subjected to corona discharge treatment, a gelatin undercoat layer containing sodium dodecyl benzene sulfonate was applied thereon, and various photographic constitutional layers were applied thereon, thereby preparing multi-layer color photographic printing paper (301) having the layer constitution shown below. The coating solutions for each layer were prepared as follows:

Preparation of first layer coating solution

Emulsified Dispersion A was prepared by dissolving 153.0 g of yellow coupler (ExY), 15.0 g of image-dye stabilizer (Cpd-1), 7.5 g of image-dye stabilizer (Cpd-2), 16.0 g of image-dye stabilizer (Cpd-3) in 25 g of solvent (Solv-1), 25 g of solvent (Solv-2), and 180 ml of ethyl acetate, and dispersing and emulsifying the resulting solution in 1,000 g of 10% aqueous gelatin solution containing 60 ml of 10% aqueous sodium dodecylbenzenesulfonate solution and 10 g of citric acid.

Separately silver chlorobromide emulsion A (cubic grains, 3:7 (silver molar ratio) blend of large size emulsion having 0.88 μm of average grain size and small size emulsion having 0.70 μm of average grain size, each in which 0.3 mol % of silver bromide was contained) was prepared with a method disclosed above. These emulsions were mixed after each emulsion completed the formation of emulsion grains of respective size was independently spectrally sensitized and chemically sensitized. The spectral sensitizing was conducted by adding the spectral sensitizing agent described above. Further, the chemical sensitizing of each emulsion of respective sizes was carried out optimumly by changing the added amounts of sulfur sensitizing agent and gold sensitizing agent. The above-described emulsified dispersion A and this silver chlorobromide emulsion A were mixed together and dissolved to give the composition shown below, thereby preparing the first layer coating solution. The fifth layer coating solution was prepared in the same manner as described in Example 1.

Coating solutions for the second to fourth, sixth and seventh layers were prepared in the same manner as the first layer coating solution. As gelatin hardener for each layer, 1-oxy-3,5-dichloro-s-triazine sodium salt was used.

Further, Cpd-14 and Cpd-15 were added into each layer in an amount so as to the total amount being 25 mg/m$^2$ and 50 mg/m$^2$, respectively.

Further, to each of the blue-sensitive emulsion layer, the green-sensitive emulsion layer, and the red-sensitive emulsion layer, 1-(5-methylureidophenyl)-5-mercaptotetrazole was added in an amount of $6\times10^{-5}$ mol, $7.8\times10^{-4}$ mol, and $2.2\times10^{-4}$ mol, per mol of silver halide, respectively.

Further, to the blue-sensitive emulsion layer and the green-sensitive emulsion layer, 4-hydroxy-6-methyl-1,3,3a,7-tetrazaindene was added in an amount of $1\times10^{-4}$ mol and $2\times10^{-4}$ mol, per mol of silver halide, respectively.

Further, to each emulsion layer, the following dyes (figure in parentheses represents a coating amount) were added for preventing irradiation.

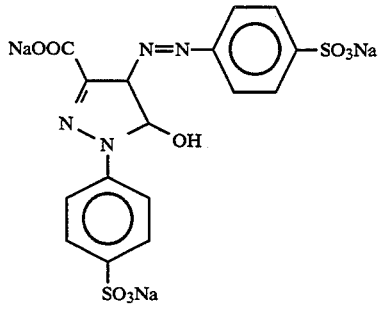

(10 mg/m$^2$)

-continued

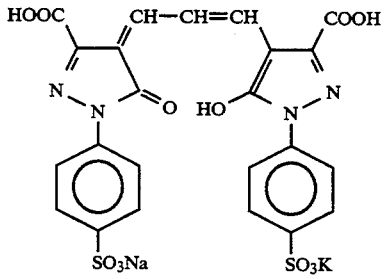

(10 mg /m$^2$)

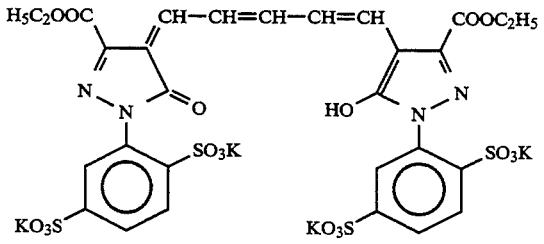

(40 mg/m$^2$)

and

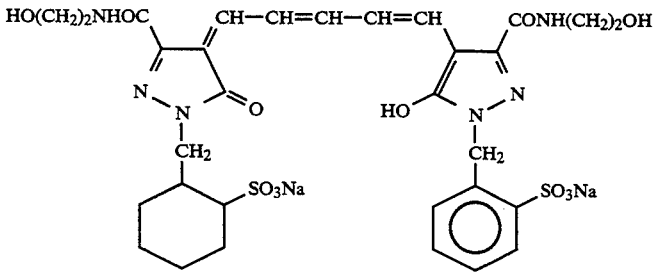

(20 mg/m$^2$)

Sensitizing dyes used are as follows:

Blue-sensitive emulsion layer

Sensitizing dye B-1

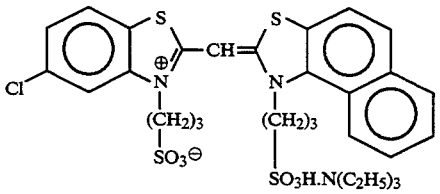

and

Sensitizing dye B-2

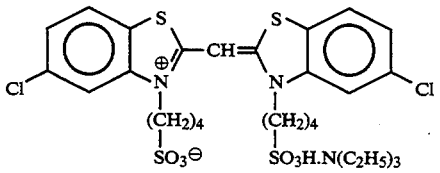

(Each dye 2.0 × 10$^{-4}$ mol for the large size emulsion and 2.5 × 10$^{-4}$ mol for the small size emulsion, per mol of silver halide)

Green-sensitive emulsion layer

-continued

Sensitizing dye G-1

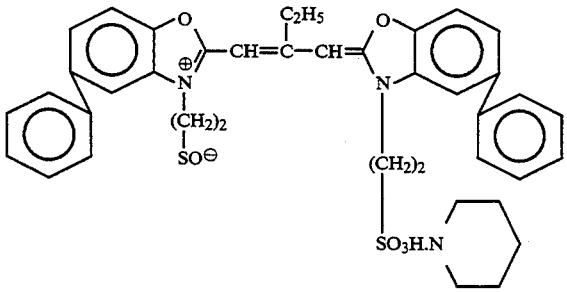

(4.0 × 10$^{-4}$ mol for the large size emulsion and 2.5 × 10$^{-4}$ mol for the small size emulsion, per mol of silver halide), and Sensitizing dye G-2

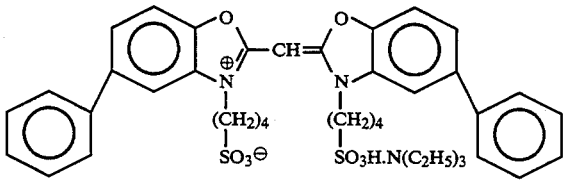

(7.0 × 10$^{-5}$ mol for the large size emulsion and 1.0 × 10$^{-4}$ mol for the small size emulsion, -continued per mol of silver halide)

Composition of Layers

The compositions of the layers are shown below. The figures indicate coating amounts (g/m$^2$). The amount of the silver halide emulsion is given in terms of applied silver.

| | |
|---|---|
| Support: Polyethylene-laminated paper (White pigment ($TiO_2$) and blueing dye (marine blue), are contained in polyethylene film of first layer side) | |
| First Layer (Blue-sensitive emulsion layer): | |
| Silver chlorobromide emulsion Δ above described | 0.27 |
| Gelatin | 1.36 |
| Yellow coupler (ExY) | 0.79 |
| Image-dye stabilizer (Cpd-1) | 0.08 |
| Image-dye stabilizer (Cpd-2) | 0.04 |
| Image-dye stabilizer (Cpd-3) | 0.08 |
| Solvent (Solv-1) | 0.13 |
| Solvent (Solv-2) | 0.13 |
| Second Layer (Color-mix preventing layer): | |
| Gelatin | 1.00 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer): | |
| Silver chlorobromide emulsion (cubic grains, 1:3 (silver molar ratio) blend of large size emulsion B having 0.55 μm of average grain size and small size emulsion B having 0.39 μm of average grain size, which have 0.10 and 0.08 of deviation coefficient of grain size distribution, respectively, and each emulsion containing 0.8 mol % of AgBr) | 0.13 |
| Gelatin | 1.45 |
| Magenta coupler (ExM) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |

-continued

| | |
|---|---|
| Support: Polyethylene-laminated paper (White pigment ($TiO_2$) and blueing dye (marine blue), are contained in polyethylene film of first layer side) | |
| Image-dye stabilizer (Cpd-8) | 0.08 |
| Solvent (Solv-7) | 0.50 |
| Solvent (Solv-2) | 0.15 |
| Solvent (Solv-3) | 0.15 |
| Fourth Layer (Color-mix preventing layer): | |
| Gelatin | 0.70 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer): | |
| Silver chlorobromide emulsion (cubic grains, 1:4 (silver molar ratio) blend of large size emulsion C having 0.50 μm of average grain size and small size emulsion C having 0.41 μm of average grain size, which have 0.09 and 0.11 of deviation coefficient of grain size distribution, respectively, and each emulsion containing 0.5 mol % of AgBr) | 0.20 |
| Gelatin | 0.85 |
| Cyan coupler (ExC) | 0.33 |
| Ultraviolet rays absorber (UV-2) | 0.18 |
| Image-dye stabilizer (Cpd-9) | 0.01 |
| Image-dye stabilizer (Cpd-10) | 0.01 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Sixth layer (Ultraviolet rays absorbing layer): | |
| Gelatin | 0.55 |
| Ultraviolet rays absorber (UV-1) | 0.38 |
| Image-dye stabilizer (Cpd-12) | 0.15 |
| Image-dye stabilizer (Cpd-5) | 0.02 |
| Seventh layer (Protective layer): | |
| Gelatin | 1.13 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used are as follows:

(ExY) Yellow coupler

Mixture (1:1 in molar ratio) of

R =

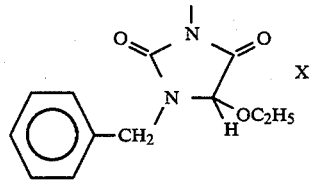

X = Cl and

R =

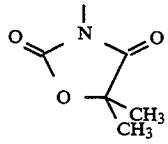

X = $OCH_3$ of

-continued
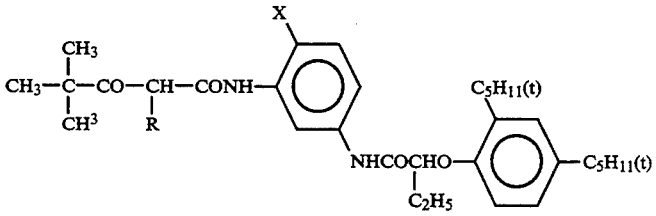
(ExM) Magenta coupler
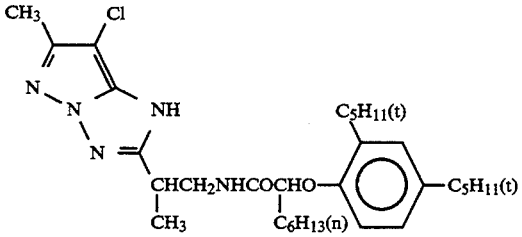
(ExC) Cyan coupler
Mixture (3:7 in molar ratio) of
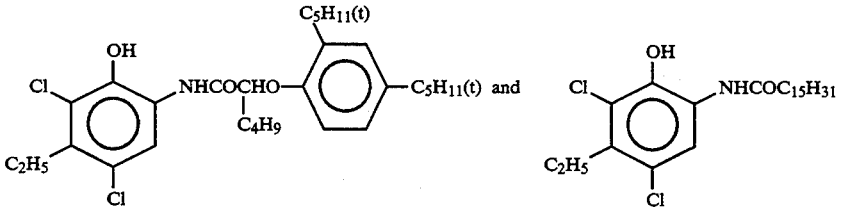
(Cpd-1) Image-dye stabilizer
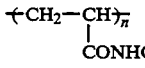
Av. Molecular Weight: 60,000
(Cpd-2) Image-dye stabilizer
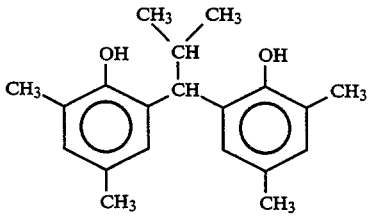
(Cpd-3) Image-dye stabilizer
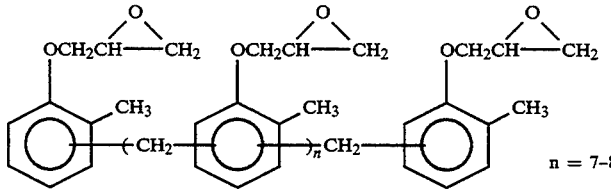
n = 7–8 (average)
(Cpd-4) Color-mix inhibitor
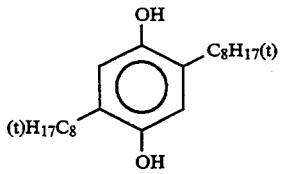
(Cpd-5) Image-dye stabilizer
(Cpd-6) Image-dye stabilizer -continued
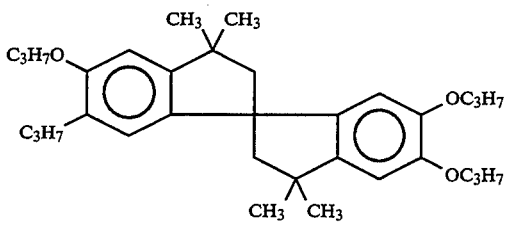
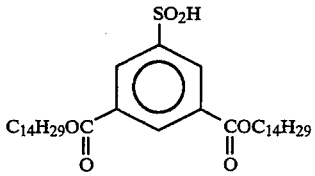
(Cpd-7) Image-dye stabilizer
(Cpd-8) Image-dye stabilizer
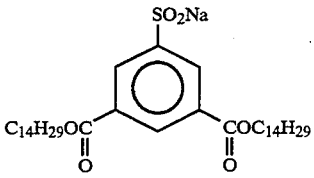
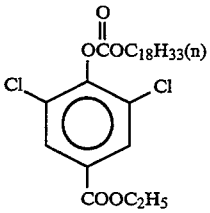
(Cpd-9) Image-dye stabilizer
(Cpd-10) Image dye stabilizer
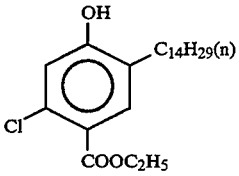
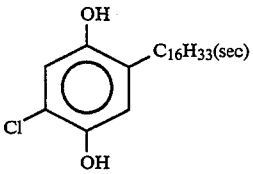
(Cpd-11) Image-dye stabilizer
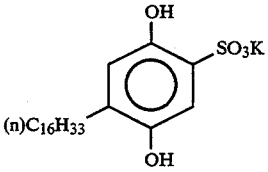
(Cpd-12) Image-dye stabilizer
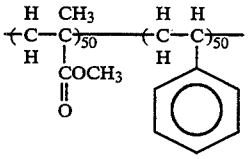
av. molecular weight: 60,000
(Cpd-13) Image-dye stabilizer
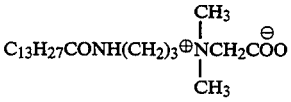
Cpd-14) Antisepsis
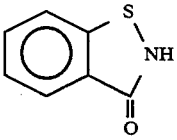
(Cpd-15) Antisepsis
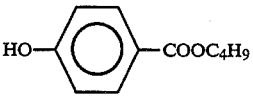
(UV-1) Ultraviolet rays absorber
Mixture (1:5:10:5 in weight ratio) of following compounds of (i), (ii), (iii), and (iv)
(i)
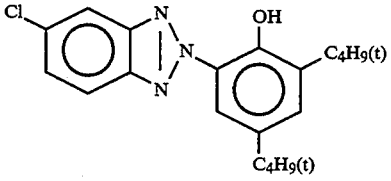
(ii)
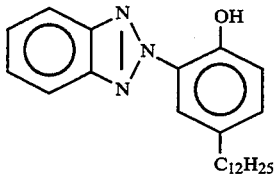

-continued (iii)

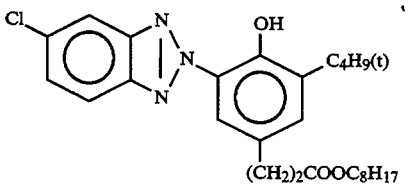

(iv)

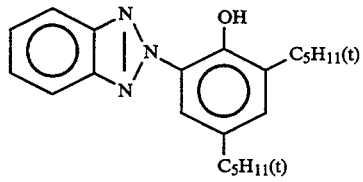

(UV-2) Ultraviolet rays absorber
Mixture (1:2:2 in weight ratio) of following compounds of (v), (vi), and (vii)

(v)

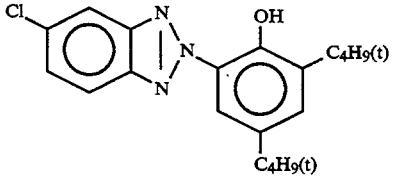

(vi)

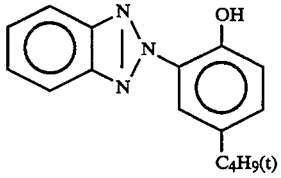

(vii)

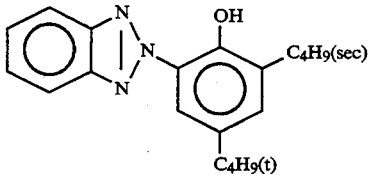

(Solv-1) Solvent

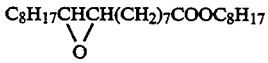

(Solv-2) Solvent

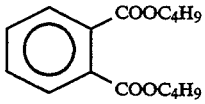

(Solv-3) Solvent

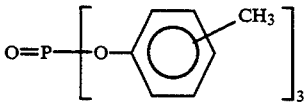

(Solv-4) Solvent

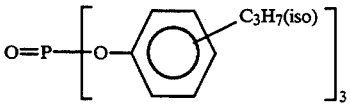

(Solv-5) Solvent

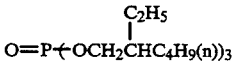

(Solv-6) Solvent

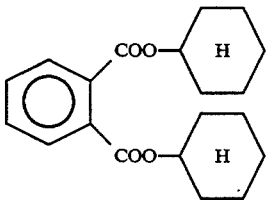

(Solv-7) Solvent

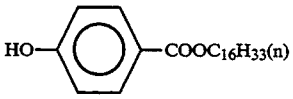

A multi-layer color photographic printing paper (302) was prepared in the same manner as the multilayer color photographic printing paper (301), except that Cyan Coupler ExC (0.33 g/m$^2$) used in the fifth layer was changed to Exemplified Compound C-58 (0.24 g/m$^2$) and the coating amount of the silver halide emulsion was changed from 0.20 g/m$^2$ (in terms of silver) to 0.14 g/m$^2$. A photographic printing paper (303) was prepared that was different from the photographic printing paper (302) only in that the applied positions of the fifth layer and the third layer were changed, and the green-sensitive emulsion layer of the photosensitive layers was applied farthest from the support. Photographic printing papers (304), (305), (306) and (307) were prepared in the same procedure for the preparation of the photographic printing paper (302), except that in the preparation of the coating liquid for the fifth layer, that is, the red-sensitive emulsion layer, potassium bromide was added in amounts of 0.0003 mol, 0.0006 mol, 0.005 mol, and 0.012 mol for respective cases per mol of a silver halide.

The obtained photographic materials were exposed to light of 250 CMS for 1 sec for sensitometry using a sensitometer (FWH, model manufactured by Fuji Photo Film Co. Ltd.; the color temperature of the light source: 3200 K) through a red filter and an optical wedge and were subjected to color development processing in the following processing steps using the following processing solutions, and the reflection densities of the processed samples were measured, to obtain so-called characteristic curves.

The development time was varied to be 20 sec and 45 sec to investigate the developing speed from a change in contrast. The contrast was expressed as a color-formed density corresponding to the exposure amount 0.6 log E greater than the exposure amount that gave a color-formed density of 0.5. This corresponds to the so-called shoulder density of the characteristic curve and it is considered that the higher this value is in a shorter developing time, the higher the developing speed is.

Also, similarly to Examples 1 and 2, the resistance to damage by pressure was tested in such a way that an easel mask of an automatic printer with a load of 100 g was pressed to the emulsion-layer-coated surface of each of the photographic materials that had not been exposed, and was moved at a rate of 60 cm/sec, to abrade the sample, and thereafter the photographic material was subjected to color development processing, to investigate the occurrence of pressure marks in the form of abrasions.

In order to test the change in performance when these photographic materials were processed continuously, each of the photographic materials was exposed to light so that gray color formation with a development rate of 30% might be obtained, and then each photographic material was processed continuously by using a test-processing machine having a tank volume shown below, until the replenishing amount of the color developer reached twice the tank volume. At the start of the continuous processing, and at its end, the above sensitometry was carried out to measure the change of contrast described above, which was used as a scale of the fluctuation. The change of contrast is the remainder obtained by subtracting the contrast before continuous processing from the contrast after continuous processing.

The results are summarized in Table 5.

| Processing step | Temperature | Time | Replenisher* | Tank Volume |
|---|---|---|---|---|
| Color developing | 38° C. | 20 sec, 45 sec | 90 ml | 1 liter |
| Bleach-fixing | 30–36° C. | 45 sec | 161 ml | 2 liter |
| Rinse (1) | 30–35° C. | 30 sec | — | 2 liter |
| Rinse (2) | 30–35° C. | 30 sec | — | 2 liter |
| Rinse (3) | 30–35° C. | 30 sec | 200 ml | 2 liter |
| Drying | 70–80° C. | 60 sec | | |

Note:
*Replenisher amount per $m^2$ of photographic material.
Rinsing steps were carried out in 3-tanks countercurrent mode from the tank of rinse (3) toward the tank of rinse (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 3.0 g | 6.0 g |
| Potassium bromide | 0.015 g | — |
| Triethanolamine | 10.0 g | 10.0 g |
| Sodium chloride | 4.2 g | — |
| Potassium carbonate | 25 g | 25 g |
| N-ethyl-N-(β-methanesulfonamidoethyl)-3-methyl-4-aminoaniline sulfate | 5.0 g | 11.0 g |
| N,N-Bis(carboxymethyl)hydrazine | 4.4 g | 10.4 g |
| Sodium N,N-di(sulfoethyl)hydroxylamine | 4.0 g | 8.0 g |
| Fluorescent whitening agent (WHITEX-4B, made by Sumitomo Chemical Ind.) | 2.0 g | 4.0 g |
| Water to make | 1000 m | 1000 m |
| pH | 10.20 | 10.85 |
| Bleach-fixing solution (Both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate-dihydrate | 55 g | |
| Disodium ethylenediaminetetraacetate | 5 g | |
| Ammonium bromide | 40 g | |
| Glacial acetic acid | 9 g | |
| Water to make | 1000 ml | |
| pH | 5.40 | |
| Rinsing solution (Both tank solution and replenisher) | | |
| Ion-exchanged water (calcium and magnesium each are 3 ppm or below) | | |

TABLE 5

| Sample No. | Contrast 20 sec-developing | Contrast 45 sec-developing | Occurrence of pressure marks | Contrast change between before and after continuous processing | Remarks |
|---|---|---|---|---|---|
| 301 | 1.81 | 2.03 | Δ | −0.11 | Comparison |
| 302 | 1.90 | 2.21 | x | −0.18 | Comparison |
| 303 | 1.77 | 2.02 | ∘ | −0.21 | Comparison |
| 304 | 1.89 | 2.20 | x~∘ | −0.17 | Comparison |
| 305 | 1.88 | 2.19 | ∘ | −0.09 | This Invention |
| 306 | 1.87 | 2.19 | ∘ | −0.07 | This Invention |
| 307 | 1.64 | 2.04 | ∘ | −0.15 | Comparison |

As is shown in the results in Table 5, when a cyan coupler of the present invention is combined with a high-silver chloride emulsion, the occurrence of pressure marks increases. Although, by applying a cyan coupler-containing red-sensitive emulsion layer as the third layer, the occurrence of pressure marks decreases, contrast lowers and deterioration of the developing speed takes place, which are unpreferable. By adding the water-soluble bromide to the red-sensitive emulsion, the occurrence of pressure marks when the cyan coupler of the present invention is used can be prevented effectively.

Further, in the photographic material of the present invention, the decrease of contrast is small even when a continuous processing of less replenishing amount of color developer is conducted.

EXAMPLE 4

A multilayer color photographic material was prepared according to the following method.

A multilayer color print paper (401) having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzenesulfonate and polystyrenesulfonate polymer. Preparations of respective emulsions were conducted in the same manner as in Example 3. Coating solutions of respective layer were prepared as follows:

Preparation of the first layer coating solution 133.5 Grams of yellow coupler (ExY-2), 50.0 g of image-dye stabilizer (Cpd-16), 178.1 g of image-dye stabilizer (Cpd-17), color fogging-preventing agent (Cpd-4) were dissolved in 50 g of solvent (Solv-8) and 180 ml of ethyl acetate, and the resulting solution was dispersed and emulsified in 1,000 g of 10% aqueous gelatin solution containing 60 ml of 10% sodium dodecylbenzenesulfonate solution, thereby preparing emulsified dispersion B. Separately silver chlorobromide emulsion B (cubic grains, 3:7 (silver molar ratio) mixture of large size emulsion having 0.88 μm of average grain size and small size emulsion having 0.70 μm of average grain size, and 0.07 and 0.08 of deviation coefficient of grain size distribution, respectively, each in which 0.5 mol % of silver bromide was contained) was prepared in the same manner as in the emulsions used in the layers in Example 3. The chemical sensitization and spectral sensitization of Emulsion B were independently carried out on each size emulsion before mixing thereof. As spectral sensitizing agents, blue-sensitive sensitizing dyes B-3 and B-4, shown below, were added in amounts of dyes that corresponds to $2.0\times10^{-4}$ mol and $2.5\times10^{-4}$ mol to the large size emulsion and small size emulsion, per mol of a silver halide, respectively. The chemical sensitizing of these emulsions were carried out, so as to be optimumly for each size emulsion, by adding sodium thiosulfate and chloroauric acid. The above-described emulsified dispersion B and this silver chlorobromide emulsion B were mixed together, dissolved and added gelatin to give the composition shown below, thereby preparing the first layer coating solution.

The fifth layer coating solution was prepared in the same manner as in Example 1.

Coating solutions for the second to fourth, and sixth and seventh layers were also prepared in the same manner as above described. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 mg/m$^2$ and 50.0 mg/m$^2$. In the silver chlorobromide emulsion of each photosensitive emulsion layer, spectral sensitizing dyes, shown below, were added, respectively.

Blue-sensitive emulsion layer:
Spectral sensitizing dye B-3

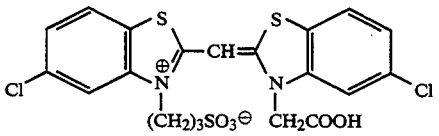

and
Spectral sensitizing dye B-4

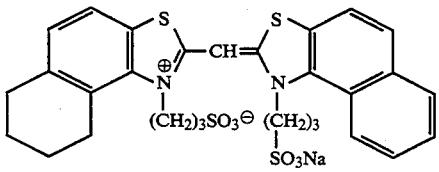

Green-sensitive emulsion layer:
Spectral sensitizing dye G-3

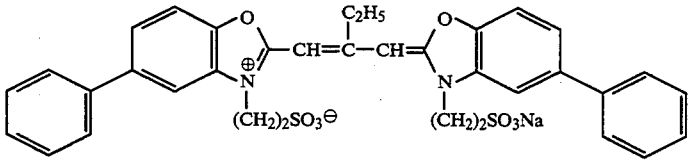

($4\times10^{4}$ mol to the large size emulsion and $5.6\times10^{4}$ mol to the small size emulsion, per mol of silver halide)

Red-sensitive emulsion layer:
Spectral sensitizing dye R-3

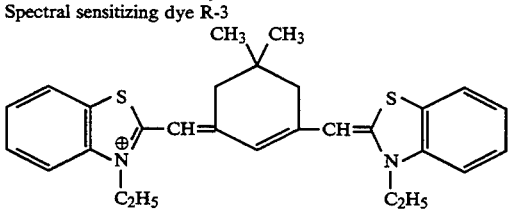

($1.6\times10^{-5}$ mol to the large size emulsion and

-continued 2.0 × $10^{31\ 5}$ mol to the small size emulsion, per mol of silver halide)

To the blue-sensitive emulsion layer, green-sensitive emulsion layer, and red-sensitive emulsion layer, mixture (1:1 in molar ratio) of 1-(3-acetamodophenyl)-5-mercaptotetrazole and 1-(5-methylureidophenyl) -5-mercaptotetrazole was added in an amount of $8\times10^{-5}$ mol, $7.2\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

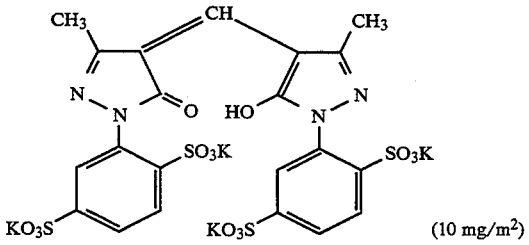

(10 mg/m²)

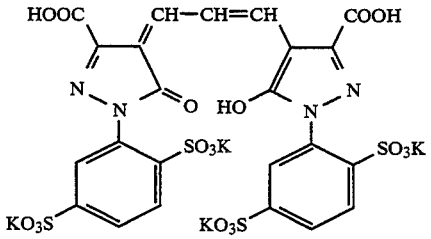

(10 mg/m²)

and

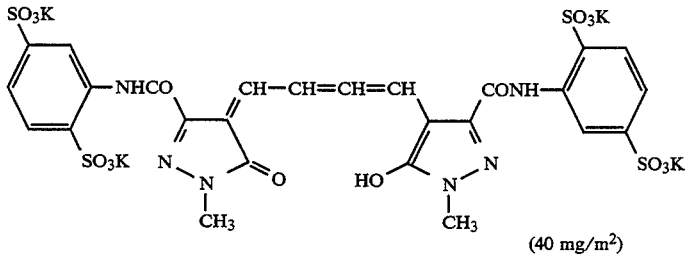

(40 mg/m²)

Composition of Layers

The composition of each layer is shown below. The figures represent coating amount (g/m²). The coating amount of each silver halide emulsion is given in terms of silver.

| | |
|---|---|
| Support<br>Paper laminated on both sides with polyethylene (a white pigment, $TiO_2$, and a bluish dye, ultramarine, were included in the first layer side of the polyethylene-laminated film) | |
| First Layer (Blue-sensitive emulsion layer) | |
| The above described silver chlorobromide emulsion B | 0.26 |
| Gelatin | 1.20 |

-continued

| | |
|---|---|
| Support<br>Paper laminated on both sides with polyethylene (a white pigment, $TiO_2$, and a bluish dye, ultramarine, were included in the first layer side of the polyethylene-laminated film) | |
| Yellow coupler (ExY-2) | 0.80 |
| Image-dye stabilizer (Cpd-16) | 0.30 |
| Image-dye stabilizer (Cpd-17) | 0.20 |
| Image dye stabilizer (Cpd-4) | 0.02 |
| Solvent (Solv-8) | 0.20 |
| Second Layer (Color-mix preventing layer) | |
| Gelatin | 1.25 |
| Color-mix inhibitor (Cpd-18) | 0.03 |
| Color-mix inhibitor (Cpd-19) | 0.03 |
| Color-mix inhibitor (Cpd-20) | 0.03 |
| Color-mix inhibitor (Cpd-21) | 0.23 |
| Solvent (Solv-9) | 0.06 |
| Third Layer (Green-sensitive emulsion layer) | |
| Silver chlorobromide emulsion (cubic grains, 3:7 (Ag molar ratio) mixture of large size emulsion having average grain size of 0.55 μm and small size emulsion having average grain size of 0.39 μm, whose deviation coefficient of grain size distribution is 0.08 and 0.09, respectively, each in which emulsion 0.5 mol % of silver bromide was contained) | 0.14 |
| Gelatin | 1.40 |
| Magenta coupler (ExM-2) | 0.24 |
| Image-dye stabilizer (Cpd-22) | 0.24 |
| Image-dye stabilizer (Cpd-23) | 0.21 |
| Solvent (Solv-9) | 0.17 |
| Fourth Layer (Ultraviolet rays absorbing layer) | |
| Gelatin | 0.94 |

-continued

| | |
|---|---|
| Support<br>Paper laminated on both sides with polyethylene (a white pigment, $TiO_2$, and a bluish dye, ultramarine, were included in the first layer side of the polyethylene-laminated film) | |
| Ultraviolet absorber (UV-3) | 0.75 |
| Color-mix inhibitor (Cpd-20) | 0.10 |
| Solvent (Solv-8) | 0.40 |
| Fifth Layer (Red-sensitive emulsion layer) | |
| Silver chlorobromide emulsion (cubic grains, 4:6 (Ag molar ratio) mixture of large size emulsion having average grain size of 0.52 μm and small size emulsion having average grain size of 0.41 μm, whose deviation coefficient of grain size distribution is 0.08 and 0.09, respectively, each in which emulsion 0.5 mol % of silver bromide was contained) | 0.22 |
| Gelatin | 1.30 |

-continued

| | |
|---|---|
| Support<br>Paper laminated on both sides with polyethylene (a white pigment, $TiO_2$, and a bluish dye, ultramarine, were included in the first layer side of the polyethylene-laminated film) | |
| Cyan coupler (ExC-2) | 0.40 |
| Image-dye stabilizer (Cpd-16) | 0.20 |
| Color-fogging inhibitor (Cpd-24) | 0.01 |
| Solvent (Solv-10) | 0.20 |
| Solvent (Solv-11) | 0.20 |
| Sixth Layer (Ultraviolet rays absorbing layer) | |
| Gelatin | 0.94 |
| Ultraviolet absorber (UV-3) | 0.75 |
| Color-mix inhibitor (Cpd-20) | 0.10 |
| Color-fogging inhibitor (Cpd-24) | 0.03 |
| Solvent (Solv-8) | 0.40 |
| Seventh Layer (Protective layer) | |
| Gelatin | 1.00 |

Compounds used are as follows:

Yellow coupler (ExY-2)

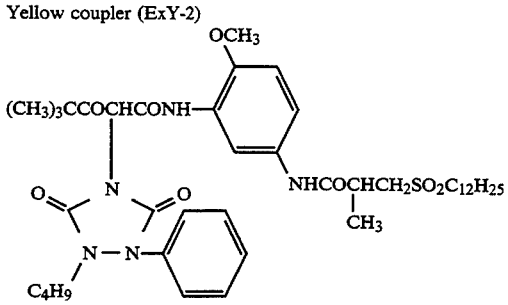

Magenta coupler (ExM-2)

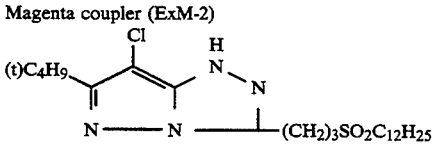

Cyan coupler (ExC-2)
Mixture (7:2 in molar ratio) of

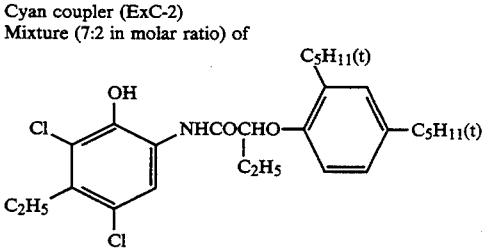

and

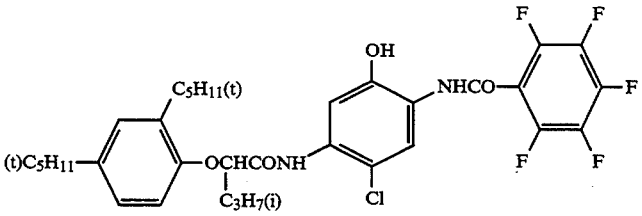

Image-dye stabilizer (Cpd-16)

Image-dye stabilizer (Cpd-17)

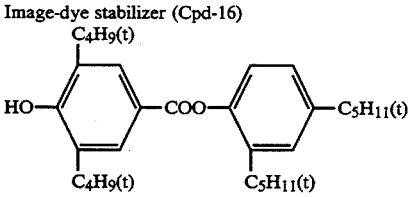

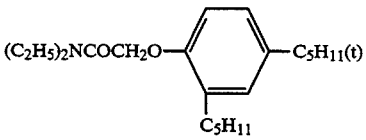

Image-dye stabilizer (Cpd-18)

Image-dye stabilizer (Cpd-19)

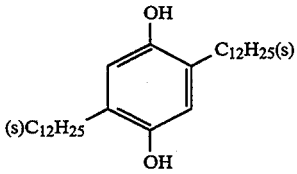
-continued
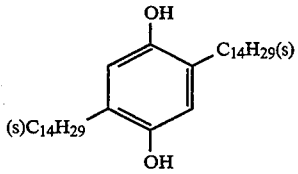
Color-mix inhibitor (Cpd-20)
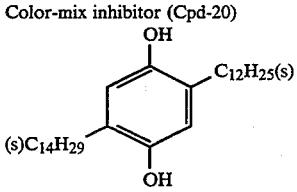
Color-mix inhibitor (Cpd-21)
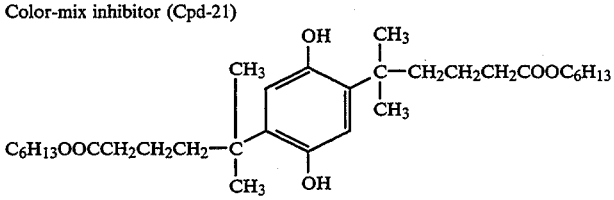
Image-dye stabilizer (Cpd-22)
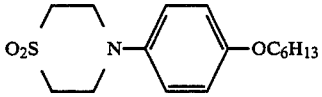
Image-dye stabilizer (Cpd-23)
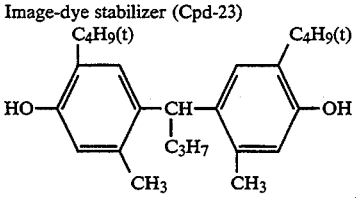
Color-fogging inhibitor (Cpd-24)
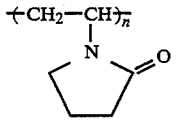
Ultraviolet rays absorber (UV-3)
Mixture of (i), (ii), (iii), and (iv) (10:5:1:5)
(i)
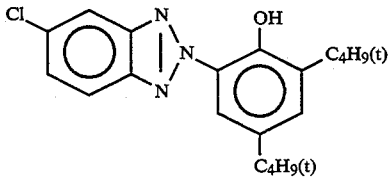
(ii)
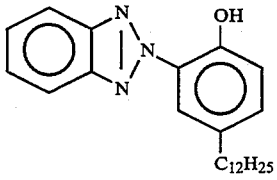
(iii)
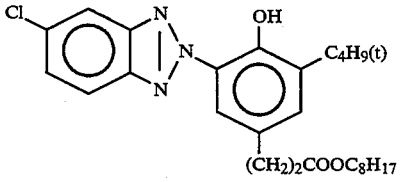
(iv)
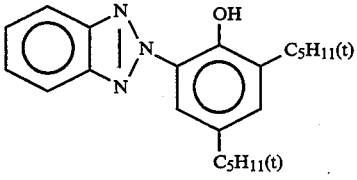
Solvent (Solv-8)
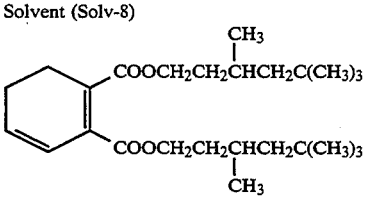
Solvent (Solv-9)
Mixture (1:1 in weight ratio) of -continued

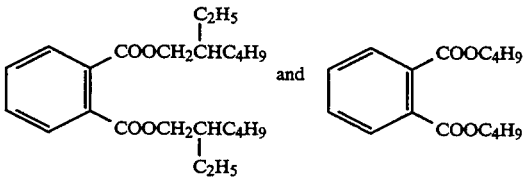

Solvent (Solv-10)

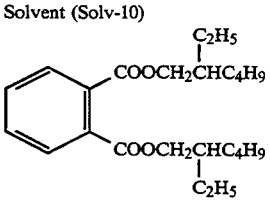

Solvent (Solv-11)

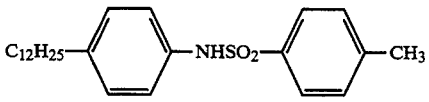

A multi-layer color photographic printing paper (402) was prepared that was different from the multi-layer photographic printing paper (401) only in that, instead of ExC-2 (0.40 g/m$^2$) as the cyan coupler used in the fifth layer, Exemplified Compound C-52 (0.25 g/m$^2$) was used, and the coating amount of the silver halide emulsion was 0.16 g/m$^2$ instead of 0.22 g/m$^2$ in terms of silver. A photographic printing paper (403) was prepared in the same procedure for the preparation of the photographic printing paper (402), except that the prepared red-sensitive emulsion used in the fifth layer was different in that only 0.005 mol of potassium bromide per mol of the silver halide was added to the reaction vessel when the formation of the grains was completed 50%. Further, a photographic printing paper (404) was prepared in the same procedure for the preparation of the photographic printing paper (402), except that the prepared red-sensitive emulsion used in the fifth layer was different in that only 0.005 mol of potassium bromide per mol of the silver halide was added just before 1-(5-methylureidophenyl)-5-mercaptotetrazole, which was to be added after the completion of the chemical sensitization. Further, a photographic printing paper (405) was prepared in the same procedure for the preparation of the photographic printing paper (402), except that the prepared red sensitive emulsion used in the fifth layer was different in that only 0.005 mol of potassium bromide per mol of the silver halide was added just after 1-(5-methylureidophenyl)-5-mercaptotetrazole which was added after the completion of the chemical sensitization. Further, a photographic printing paper (406) was prepared in the same procedure for the preparation of the photographic printing paper (402), except that when the coating solution for the red-sensitive emulsion layer of the fifth layer was prepared, only 0.005 mol of potassium bromide per mol of the silver halide was added.

With respect to the obtained photographic materials, they were processed and tested in the same way as in Example 3. The results are shown in Table 6.

TABLE 6

| Sample No. | Contrast 20 sec-developing | Contrast 45 sec-developing | Occurrence of pressure marks | Contrast change between before and after continuous processing | Remarks |
|---|---|---|---|---|---|
| 401 | 1.82 | 2.07 | Δ | −0.12 | Comparison |
| 402 | 1.96 | 2.29 | x | −0.19 | Comparison |
| 403 | 1.88 | 2.21 | Δ | −0.12 | This Invention |
| 404 | 1.90 | 2.25 | ∘ | −0.09 | This Invention |
| 405 | 1.92 | 2.27 | ∘ | −0.08 | This Invention |
| 406 | 1.93 | 2.28 | ∘ | −0.06 | This Invention |

As is apparent from the results in Table 6, also in the multi-layer color photographic printing papers having the constitutions of this Example, the effect of the present invention was exhibited remarkably. That is, the occurrence of pressure marks which is a problem that occurs when the cyan coupler of the present invention is used in combination with the high-silver halide emulsion can be effectively suppressed by adding the water-soluble bromide after the formation of grains of the red-sensitive emulsion. Even when the photographic material of the present invention is processed continuously, the lowering of the contrast is small.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for forming a color image, which comprises the following steps:

(i) exposing imagewise a silver halide color photographic material having at least one yellow dye-forming layer, at least one magenta dye-forming layer, and at least one cyan dye-forming layer, on a support, wherein said cyan dye-forming layer contains silver halide emulsion grains comprising silver chlorobromide having a silver chloride content of 90 mol % or more, and being substantially free from silver iodide, and at least one cyan dye-forming coupler represented by formula (I) or (II), said silver halide emulsion grains being formed by adding at a grain formation step, a water-soluble bromide in a total amount of 0.0005 to 0.01 mol per mol of the silver halide, to a system containing initially formed silver halide grains in a short period of time when any part of the silver halide grains corresponding to 20% or less of the volume of the grains is formed, and/or by adding a water-soluble bromide in a total amount of 0.0005 to 0.01 mol per mol of the silver halide to an initially formed silver halide emulsion at any period of time from the completion of the formation of the initial silver halide grains to a coating of the cyan dye-forming layer onto the support:

formula (I)

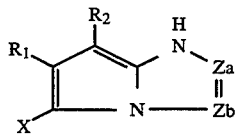

formula (II)

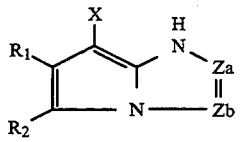

wherein Za and Zb each represent —N= or —C($R_3$)=, with one of Za and Zb being —N= and the other being —C($R_3$)=; $R_1$ and $R_2$ each represent an electron-attracting group, whose Hammett substituent constant $\sigma_p$ value is 0.20 or more, with the sum of the $\sigma_p$ values of $R_1$ and $R_2$ being 0.65 or more; $R_3$ represents a hydrogen atom or a substituent; X represents a hydrogen atom or a group capable of being released upon a coupling reaction with the oxidized product of an aromatic primary amine developing agent; and $R_1$, $R_2$, $R_3$, or X may become a bivalent group to form a dimer or a higher polymer, or may bond to a polymer molecular chain to form a homopolymer or a copolymer; and then (ii) processing continuously said exposed silver halide color photographic material with a color developer wherein a replenishing amount of said color developer is in the range of 20 ml to 100 ml per square meter of said silver halide color photographic material.

2. The method for forming a color image according to claim 1, wherein, among photosensitive emulsion layers constituting the photographic material, said cyan dye-forming layer is positioned farthest from the support.

3. The method for forming a color image according to claim 1, wherein the silver halide grains incorporated in said cyan dye-forming layer contain an iridium compound, and 60% or more of the said iridium compound is localized near the surface of the grains.

4. The method for forming a color image according to claim 3, wherein the amount of iridium compound to be added is in the range of $10^{-9}$ to $10^{-4}$ mol per mol of silver halide.

5. The method for forming a color image according to claim 1, wherein the cyan dye-forming coupler is represented by the following formula (I-a), (I-b), (II-a), or (II-b):

formula (I-a)

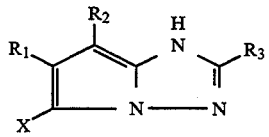

formula (II-a)

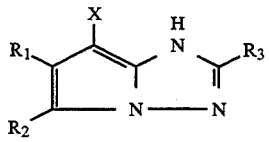

formula (I-b)

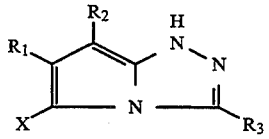

formula (II-b)

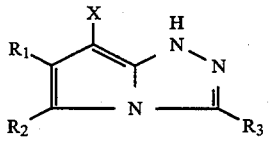

wherein $R_1$, $R_2$, $R_3$, and X each have the same meaning as those of $R_1$, $R_2$, $R_3$, and X in formula (I) or (II).

6. The method for forming a color image according to claim 5, wherein $R_3$ in formula (I-a), (I-b), (II-a), or (II-b) represents an aryl group having an alkoxy group or an alkylamino group at the ortho position.

7. The method for forming a color image according to claim 5, wherein $R_3$ in formula (I-a), (I-b), (II-a), or (II-b) represents an aryl group having an alkoxy group at the ortho position.

8. The method for forming a color image according to claim 1, wherein the Hammett substituent constant $\sigma_p$ of the electron-attracting group represented by $R_1$ or $R_2$ in formula (I) or (II) is 0.30 to 1.0.

9. The method for forming a color image according to claim 1, wherein the sum of the $\sigma_p$ values of $R_1$ and $R_2$ in formula (I) or (II) is 0.70 to 1.80.

10. The method for forming a color image according to claim 1, wherein the cyan dye-forming coupler represented by formula (I) or (II) is added to the silver halide color photographic material in an amount of 0.1 to 1.0 mol per mol of the silver halide.

11. The method for forming a color image according to claim 1, wherein the water-soluble bromide is added to a system containing initially formed silver halide grains, in a short period of time when any part of the silver halide grains corresponding to 10% or less of the volume of the grains is formed.

12. The method for forming a color image according to claim 1, wherein the water-soluble bromide is added to an initially formed silver halide emulsion after the completion of the formation of grains, but not later than the completion of the preparation for a coating solution of the cyan dye-forming layer.

13. The method for forming a color image according to claim 1, wherein the amount of the water-soluble bromide to be added is in the range of 0.001 to 0.008 mol per mol of silver halide.

14. The method for forming a color image according to claim 1, wherein the yellow dye-forming layer contains a coupler represented by the following formula (Y):

formula (Y)

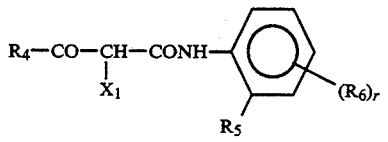

wherein $R_4$ represents a tertiary alkyl group or an aryl group, $R_5$ represents a hydrogen atom, a halogen atom, an alkoxy group, an aryloxy group, an alkyl group, or a dialkylamino group, $R_6$ represents a group substitutable onto a benzene ring, $X_1$ represents a hydrogen atom or a coupling-off group, and r is an integer of 0 to 4, and when r is an integer of 2 to 4, $R_6$'s may be the same or different.

15. The method for forming a color image according to claim 14, wherein $R_4$ in formula (Y) represents a t-butyl group, an 1-alkylcyclopropyl group, or an 1-alkylcyclopentyl group.

16. The method for forming a color image according to claim 15, wherein the 1-alkyl moiety of $R_4$ is a straight-chain alkyl group having 1 to 4 carbon atoms or a benzyl group.

17. The method for forming a color image according to claim 15, wherein the 1-alkyl moiety of $R_4$ is a benzyl group.

* * * * *